US012163383B2

(12) United States Patent
Zabaloy et al.

(10) Patent No.: US 12,163,383 B2
(45) Date of Patent: Dec. 10, 2024

(54) THREADED CONNECTION FOR EXPLORATION AND PRODUCTION OF A HYDROCARBON WELL

(71) Applicant: Tenaris Connections B.V., Amsterdam (NL)

(72) Inventors: Julian Ignacio Zabaloy, Buenos Aires (AR); Luciano Omar Mantovano, Buenos Aires (AR); Gaston Mauro Mazzaferro, Buenos Aires (AR)

(73) Assignee: Tenaris Connections B.V., Amsterdam (NL)

( * ) Notice: Subject to any disclaimer, the term of this patent is extended or adjusted under 35 U.S.C. 154(b) by 0 days.

(21) Appl. No.: 18/555,598

(22) PCT Filed: Apr. 21, 2022

(86) PCT No.: PCT/EP2022/060548
§ 371 (c)(1),
(2) Date: Oct. 16, 2023

(87) PCT Pub. No.: WO2022/228991
PCT Pub. Date: Nov. 3, 2022

(65) Prior Publication Data

US 2024/0200411 A1 Jun. 20, 2024

(30) Foreign Application Priority Data

Apr. 26, 2021 (NL) ..... 2028072

(51) Int. Cl.
*E21B 17/043* (2006.01)

(52) U.S. Cl.
CPC ..... *E21B 17/043* (2013.01)

(58) Field of Classification Search
CPC ..... E21B 17/043; F16L 15/08
See application file for complete search history.

(56) References Cited

U.S. PATENT DOCUMENTS

| | | | | |
|---|---|---|---|---|
| 9,708,865 | B2 * | 7/2017 | Steen | F16L 15/08 |
| 10,132,124 | B2 * | 11/2018 | Gallagher | E21B 17/043 |
| 10,597,950 | B2 * | 3/2020 | McGowan | F16L 15/06 |
| 10,612,319 | B2 * | 4/2020 | Nelson | F16L 15/08 |

* cited by examiner

*Primary Examiner* — D. Andrews
(74) *Attorney, Agent, or Firm* — Morgan, Lewis & Bockius LLP

(57) ABSTRACT

Threaded connection for exploration and production of a hydrocarbon well, said threaded connection includes a pin including an outer pin surface with an external thread, a box including an inner box surface with an internal thread for mating with the external thread during make-up of the threaded connection, and an anti-rotation device to allow relative rotation between the pin and the box in a make-up rotation direction and prevent relative rotation between the pin and the box in an opposite break-out rotation direction. The pin and the box extend along a longitudinal axis. The anti-rotation device can include a first anti-rotation member which is arranged in a first radial recess provided in the outer pin surface or the inner box surface, and a second anti-rotation member provided at the other of the outer pin surface and the inner box surface.

9 Claims, 57 Drawing Sheets

THREADED CONNECTION FOR EXPLORATION AND PRODUCTION OF A HYDROCARBON WELL

FIELD OF THE INVENTION

The invention relates to a threaded connection for exploration and production of a hydrocarbon well.

The threaded connection comprises a pin comprising an outer pin surface provided with an external thread, a box comprising an inner box surface provided with an internal thread for mating with the external thread during rotational make-up of the threaded connection, and an anti-rotation device to allow relative rotation between the pin and the box in a make-up rotation direction and prevent relative rotation between the pin and the box in an opposite break-out rotation direction.

The first anti-rotation member comprises a first ratchet part provided with radially extending first ratchet teeth, and the second anti-rotation member comprises a second ratchet part provided with radially extending second ratchet teeth which engage the first ratchet teeth of the first anti-rotation member at final make-up of the threaded connection.

Spring means are provided which allows radial movement of the first ratchet part in radial direction relative to the longitudinal axis of the threaded connection when first ratchet teeth slide along second ratchet teeth during relative rotation between the pin and the box in the make-up rotation direction.

The pin and the box of the threaded connection are generally formed at the end sections of longitudinal tubular members suitable for transporting a medium, such as a liquid of gas. For exploration and production of a hydrocarbon well, the end sections of said tubular members are connected with each other to form a string of tubular members to transport said medium. Said tubular member can have at an end section thereof a pin, and at an opposite end section thereof another pin. Alternatively, said tubular member can have at an end section thereof a pin, and at an opposite end section thereof a box. It is also possible that said tubular member is provided with a box at an end section of said tubular member, and with another box at an opposite end section of said tubular member.

BACKGROUND OF THE INVENTION

This type of anti-rotation device having the first anti-rotation member provided with the first ratchet part, the second anti-rotation member provided with the second ratchet part, and the spring means allow that the anti-rotation device is activated by rotational make-up of the threaded connection until final make-up is reached.

SUMMARY OF THE INVENTION

The known threaded connections have the disadvantage that the anti-rotation device is relatively susceptible to damage. Damage may occur when the anti-rotation device is subjected to forces, for example during rotational make-up of the threaded connection and when preventing relative rotation between the pin and the box in the break-out rotation direction.

BRIEF DESCRIPTION OF THE INVENTION

The invention has the objective to provide an improved, or at least alternative, threaded connection for exploration and production of a hydrocarbon well. Said threaded connection comprises:

a pin comprising an outer pin surface provided with an external thread, a box comprising an inner box surface provided with an internal thread for mating with the external thread during rotational make-up of the threaded connection, and an anti-rotation device to allow relative rotation between the pin and the box in a make-up rotation direction and prevent relative rotation between the pin and the box in an opposite break-out rotation direction, wherein:

the pin and the box extend along a longitudinal axis, the anti-rotation device comprises a releasably mounted first anti-rotation member which is arranged in a first radial recess provided in one of the outer pin surface of the pin and the inner box surface of the box, and a second anti-rotation member provided at the other of the outer pin surface of the pin and the inner box surface of the box, the first anti-rotation member comprises a first ratchet part provided with radially extending first ratchet teeth, the second anti-rotation member comprises a second ratchet part provided with radially extending second ratchet teeth which engage the first ratchet teeth of the first anti-rotation member at final make-up of the threaded connection, the first anti-rotation member comprises a spring part which allows radial movement of the first ratchet part in radial direction relative to the longitudinal axis when first ratchet teeth slide along second ratchet teeth during relative rotation between the pin and the box in the make-up rotation direction, and the first ratchet part and the spring part of the first anti-rotation member are integrally formed.

By providing a threaded connection for exploration and production of a hydrocarbon well, wherein said first ratchet part and said spring part of said first anti-rotation member are integrally formed, a relatively robust anti-rotation device may be provided. As said first ratchet part and said spring part are formed from a single piece of material, a homogeneous anti-rotation member is provided. Such homogeneous anti-rotation member may provide a strong material connection between said first ratchet part and said spring part. Accordingly, said device may be less susceptible to damage, and thus a relatively robust anti-rotation device can be provided.

Differently put; as the first ratchet part and the spring part are formed from a single piece of material, the first anti-rotation member may be free from connection components, e.g. a screw, connecting the first ratchet part with the spring part. The invention is amongst others based on the obtained insight that such connection components may be particularly susceptible to material deformations caused by shear stresses, in particular when the first anti-rotation member is subjected to a relatively large break-out torque in the break-out direction. By omitting the presence of such connection components, damage to these connection components may be prevented.

In an embodiment of the threaded connection according to the invention, the spring part has a spring stiffness which is smaller than a first ratchet stiffness of the first ratchet part. The spring part may have a spring part section having a radial spring thickness that is smaller than a radial first ratchet thickness of the first ratchet part.

In an embodiment of the threaded connection according to the invention, the first anti-rotation member comprises a first mounting part to releasably mount the first anti-rotation member in the first radial recess.

In an embodiment of the threaded connection according to the invention, the first mounting part comprises a first mounting through hole to receive a first mounting member, such as a first screw, which releasably mounts the first anti-rotation member to said one of the pin and box in which the first radial recess is provided.

In an embodiment of the threaded connection according to the invention, the first ratchet part, the spring part and the first mounting part of the first anti-rotation member are integrally formed.

In an embodiment of the threaded connection according to the invention, the spring part has a spring stiffness which is smaller than a first ratchet stiffness of the first ratchet part and/or smaller than a first mounting stiffness of the first mounting part. The spring part may have a spring part section having a radial spring thickness that is smaller than a radial first ratchet thickness of the first ratchet part and/or smaller than a radial first mounting thickness of the first mounting part.

In an embodiment of the threaded connection according to the invention, a first recess contact surface of the pin and the box in which the first radial recess is provided defines a first recess boundary of the first radial recess, the first anti-rotation member comprises a first member contact surface facing the first recess contact surface, and the first mounting part is configured to allow tangential movement in a tangential direction relative to the longitudinal axis of the first anti-rotation member in the first radial recess from a first tangential member position wherein the first member contact surface of the first anti-rotation member is in contact with the first recess contact surface into a second tangential member position wherein the first member contact surface of the first anti-rotation member is located at a first tangential member distance from the first recess contact surface, and vice versa.

This has the advantage that the anti-rotation device may be even less susceptible to damage. As the first mounting part is configured to allow tangential movement (e.g. to allow sliding movement) of the first anti-rotation member from said first tangential member position to said second tangential member position stresses in the material may be directed away from said first mounting part (and a first mounting member, e.g. a screw, provided in said first mounting part) wherein there are relatively few stresses present at said first mounting part. As such, said first mounting part may be substantially free from (shear) stresses. In particular, said anti-rotation device may be configured to allow said first recess contact surface and said first member contact surface to abut while said teeth limit rotation of the pin with respect to the box in the break-out direction. As such, relatively few connection parts (e.g. said first mounting part) may be subjected to stresses under the influence of a break-out torque.

The tangential movement in tangential direction is not restricted to movement only in tangential direction relative to the longitudinal axis. It may have a certain degree of movement in other directions relative to the longitudinal axis, for example to create a movement partly around the longitudinal axis.

In an embodiment of the threaded connection according to the invention, the first recess contact surface and the first member contact surface are configured to distribute forces as a result of a break-out torque applied to the pin and the box in the break-out rotation direction mainly through the teeth of the first ratchet part and the second ratchet part.

In an embodiment of the threaded connection according to the invention, the first recess contact surface and the first member contact surface are configured to direct (e.g. guide) forces from the first ratchet teeth of the first ratchet part towards the second ratchet teeth of the second ratchet part and/or from the second ratchet teeth of the second ratchet part towards the first ratchet teeth of the first ratchet part.

In an embodiment of the threaded connection according to the invention, the recess contact surface is faced towards the first ratchet part.

In an embodiment of the threaded connection according to the invention, the first recess contact surface is faced towards the first ratchet part and the second ratchet part.

In an embodiment of the threaded connection according to the invention, the second anti-rotation member is configured to push the first anti-rotation member into the second tangential member position when a predetermined make-up torque is applied to the pin and the box in the make-up rotation direction, and into the first tangential member position when a predetermined break-out torque is applied to the pin and the box in the break-out rotation direction.

In an embodiment of the threaded connection according to the invention, second ratchet teeth which engage first ratchet teeth push the first anti-rotation member into the second tangential member position when the predetermined make-up torque is applied, and into the first tangential member position when the predetermined break-out torque is applied.

In an embodiment of the threaded connection according to the invention, the first recess contact surface and the first member contact surface are configured to create a radial counter force acting against radial movement of the first ratchet part in radial direction relative to the longitudinal axis when the first anti-rotation member is located in the first tangential member position and a break-out torque is applied to the pin and the box in the break-out rotation direction.

In an embodiment of the threaded connection according to the invention, the radial counter force is formed by a friction force between the first recess contact surface and the first member contact surface when the break-out torque is applied to the pin and the box in the break-out rotation direction.

In an embodiment of the threaded connection according to the invention, the first mounting through hole is in tangential direction relative to the longitudinal axis larger than a first mounting portion of the first mounting member being surrounded by the first mounting through hole to allow movement of the first anti-rotation member in tangential direction and relative to the first mounting member.

In an embodiment of the threaded connection according to the invention, the first mounting through hole has an elongate form in tangential direction relative to the longitudinal axis or a circular form.

In an embodiment of the threaded connection according to the invention, the first recess contact surface and the first member contact surface are configured to block tangential movement of the first anti-rotation member beyond the first tangential member position when a break-out torque is applied to the pin and the box in the break-out rotation.

In an embodiment of the threaded connection according to the invention, the first mounting through hole is dimensioned to avoid forces in tangential direction working on the first mounting member by the first anti-rotation member being located in the first tangential member position when a break-out torque is applied to the pin and the box in the break-out rotation.

In an embodiment of the threaded connection according to the invention, the first tangential member distance allows radial movement of the first ratchet part in radial direction relative to the longitudinal axis when first ratchet teeth slide along second ratchet teeth during relative rotation between the pin and the box in the make-up rotation direction.

In an embodiment of the threaded connection according to the invention, the first mounting part comprises a first mounting slide surface surrounding the first mounting through hole and being in contact with a corresponding first recess slide surface provided at the first radial recess to facilitate the tangential movement of the first anti-rotation member from the first tangential member position into the second tangential member position, and vice versa.

In an embodiment of the threaded connection according to the invention, the spring part of the first anti-rotation member is in tangential direction relative to the longitudinal axis located between the first ratchet part and the first mounting part.

In an embodiment of the threaded connection according to the invention, the first member contact surface of the first anti-rotation member is located at the first ratchet part and the first ratchet teeth are in tangential direction relative to the longitudinal axis located between the first member contact surface and the spring part.

In an embodiment of the threaded connection according to the invention, a radial first ratchet thickness of the first ratchet part increases in tangential direction relative to the longitudinal axis from the spring part to the first member contact surface.

In an embodiment of the threaded connection according to the invention, the first anti-rotation member is only mounted to said one of the pin and the box in which the first radial recess is provided via the first mounting part.

In an embodiment of the threaded connection according to the invention, the first anti-rotation member comprises one, and only one, first mounting part. In particular, said first anti-rotation member comprises a single mounting part. Even more in particular, said first anti-rotation member comprises at one end said first mounting part and at a further end, being opposite to said one end, said first ratchet part, wherein said first ratchet part is a free end of said first anti-rotation member. As such, said first ratchet part is free from mounting elements. Accordingly, said first anti-rotation member may be arranged as a cantilever beam.

In an embodiment of the threaded connection according to the invention, the first anti-rotation member comprises one, and only one, spring part. In particular, said spring part starts at said first mounting part and ends at said first ratchet part. As such, said spring part is located (substantially) between said mounting part and said first ratchet part. Even more in particular, said first anti-rotation member comprises said first mounting part at said one end, and said first ratchet part at said further end, wherein said spring part is located (substantially) between said first mounting part and said first ratchet part. As such, a flexible cantilever beam is provided.

In an embodiment of the threaded connection according to the invention, the second ratchet part of the second anti-rotation member is fixed in radial direction relative to the longitudinal axis In an embodiment of the threaded connection according to the invention, the second anti-rotation member is releasably mounted in a second radial recess provided in said other of the outer pin surface of the pin and the inner box surface of the box.

In an embodiment of the threaded connection according to the invention, the first anti-rotation member is arranged in the first radial recess being provided in the outer pin surface of the pin, and the second anti-rotation member is provided at the inner box surface of the box.

This has the advantage that a relatively robust and sustainable threaded connection may be provided. By having the first anti-rotation member located in the pin, the first anti-rotation member may be kept within the outer dimensions of the threaded connection, even when the first anti-rotation member is pushed in a radially outwards direction with respect to the longitudinal axis of the threaded connection. In other words; the first anti-rotation member may be arranged wherein radial movement of the first anti-rotation member does not lead to a situation wherein the first anti-rotation member extends radially outwards beyond the outer diameter of the box. Said outer diameter of said threaded connection may be defined by the outer dimensions of said box in radial direction with respect to said longitudinal axis of said box. In addition, the mounting elements for mounting the first anti-rotation member to the pin, also extend within the outer dimensions of the connection. As such, the mounting elements will also not extend radially beyond the outer diameter of the box. Further, the insight was obtained that with said first anti-rotation member being accommodated in said pin, the movable components (e.g. said spring part) are generally less exposed to environmental influences (e.g. to the dirty environment at a bore well).

In an embodiment of the threaded connection according to the invention, the second anti-rotation member is releasably mounted in a second radial recess being provided in the inner box surface of the box.

In an embodiment of the threaded connection according to the invention, the second radial recess comprises a second recess through hole in which the second ratchet part of the second anti-rotation member is located.

In an embodiment of the threaded connection according to the invention, the second anti-rotation member comprises at least one second mounting part to releasably mount the second anti-rotation member to the box.

In an embodiment of the threaded connection according to the invention, the box comprises an outer box surface and the at least one second mounting part is releasably mounted to the box at the outer box surface.

In an embodiment of the threaded connection according to the invention, the second anti-rotation member comprises two second mounting parts to releasably mount the second anti-rotation member to the box.

In an embodiment of the threaded connection according to the invention, the two second mounting parts are located at opposite sides of the second radial recess.

In an embodiment of the threaded connection according to the invention, the pin comprises a pin retainer part, the second anti-rotation member comprises a member retainer part, the member retainer part is in radial direction located closer to the longitudinal axis than the pin retainer part, and the pin retainer part overlaps the member retainer part at least partly in axial direction relative to the longitudinal axis at final make-up of the threaded connection.

In an embodiment of the threaded connection according to the invention, the pin retainer part and the member retainer part are configured to block movement of the second anti-rotation member in radial direction away from the longitudinal axis at final make-up of the threaded connection.

In an embodiment of the threaded connection according to the invention, the pin retaining part comprises a pin retainer surface, the member retaining part comprises a member retainer surface, the member retainer surface is in radial direction located closer to the longitudinal axis than the pin retainer surface, and the pin retainer surface overlaps the member retainer surface at least party in axial direction relative to the longitudinal axis at final make-up of the threaded connection.

In an embodiment of the threaded connection according to the invention, the pin retainer surface and the member retainer surface are configured to contact each other in order to block movement of the second anti-rotation member in radial direction away from the longitudinal axis at final make-up of the threaded connection.

The fact that the pin retainer surface and the member retainer surface overlap each other at least party in axial direction relative to the longitudinal axis does not imply that it is required that the pin retainer surface and/or the member retainer surface extend solely in axial direction. The pin retainer surface and/or the member retainer surface may extend in axial direction and/or may extend under an angle relative to the axial direction.

In an embodiment of the threaded connection according to the invention, the pin retainer surface and the member retainer surface are at least partly facing each other at final make-up of the threaded connection.

In an embodiment of the threaded connection according to the invention, the pin retainer surface is directed towards the longitudinal axis and the member retainer surface is directed away from longitudinal axis.

In an embodiment of the threaded connection according to the invention, the pin retainer surface and the member retainer surface extend substantially in axial direction relative to the longitudinal axis.

In an embodiment of the threaded connection according to the invention, the pin retainer surface extends under a pin retainer angle $\alpha$ of between, and including, −12 and 12 degrees relative to the longitudinal axis, and the member retainer surface extends under a member retainer angle $\beta$ of between, and including, −12 and 12 degrees relative to the longitudinal axis.

In an embodiment of the threaded connection according to the invention, the member retainer part is provided at a free box end of the box, and the pin retainer part is provided at the outer pin surface.

In an embodiment of the threaded connection according to the invention, a second recess contact surface defines a second recess boundary of the second radial recess, the second anti-rotation member comprises a second member contact surface facing the second recess contact surface, and the second recess contact surface extends under a second recess contact surface angle $\gamma$ of between, and including, 0 and 45 degrees relative to a first fictive plane extending through the longitudinal axis and intersecting the second recess contact surface, the second member contact surface extends under a second member contact surface angle $\delta$ of between, and including, 0 and 45 degrees relative to a second fictive plane extending through the longitudinal axis and intersecting the second member contact surface, and the second recess contact surface and the second member contact surface are configured to contact each other when a predetermined break-out torque is applied to the pin and the box in the break-out rotation direction.

In an embodiment of the threaded connection according to the invention, the first fictive plane, the second fictive plane, the second recess contact surface, and the second member contact surface extend in axial direction.

In an embodiment of the threaded connection according to the invention, the second recess contact surface angle $\gamma$ is larger than 0 degrees and the second member contact surface angle $\delta$ is larger than 0 degrees.

In an embodiment of the threaded connection according to the invention, the second mounting part is configured to allow tangential movement in a tangential direction relative to the longitudinal axis of the second anti-rotation member in the second radial recess from a third tangential member position wherein the second member contact surface of the second anti-rotation member is in contact with the second recess contact surface into a fourth tangential member position wherein the second member contact surface of the second anti-rotation member is located at a second tangential member distance from the second recess contact surface, and vice versa.

In an embodiment of the threaded connection according to the invention, the first anti-rotation member is configured to push the second anti-rotation member into the fourth tangential member position when a predetermined make-up torque is applied to the pin and the box in the make-up rotation direction, and into the third tangential member position when a predetermined break-out torque is applied to the pin and the box in the break-out rotation direction.

In an embodiment of the threaded connection according to the invention, first ratchet teeth which engage second ratchet teeth push the second anti-rotation member into the fourth tangential member position when the predetermined make-up torque is applied, and into the third tangential member position when the predetermined break-out torque is applied.

In an embodiment of the threaded connection according to the invention, the first anti-rotation member is arranged in the first radial recess being provided in the inner box surface of the box, and the second anti-rotation member is provided at the outer pin surface of the pin.

In an embodiment of the threaded connection according to the invention, the second anti-rotation member is releasably mounted in a second radial recess being provided in the outer pin surface of the pin.

In an embodiment of the threaded connection according to the invention, the first radial recess comprises a first recess through hole in which the first ratchet part of the first anti-rotation member is located.

In an embodiment of the threaded connection according to the invention, the first anti-rotation member comprises at least one first mounting part to releasably mount the first anti-rotation member to the box.

In an embodiment of the threaded connection according to the invention, the box comprises an outer box surface and the at least one first mounting part is releasably mounted to the box at the outer box surface.

In an embodiment of the threaded connection according to the invention, the first anti-rotation member comprises two first mounting parts to releasably mount the first anti-rotation member to the box.

In an embodiment of the threaded connection according to the invention, the two first mounting parts are located at opposite sides of the first radial recess.

In an embodiment of the threaded connection according to the invention, the first anti-rotation member comprises two spring parts which together allows radial movement of the first ratchet part in radial direction relative to the longitudinal axis when first ratchet teeth slide along second ratchet teeth during relative rotation between the pin and the box in the make-up rotation direction.

In an embodiment of the threaded connection according to the invention, each spring part is located between the first ratchet part and a different one of the two first mounting parts.

In an embodiment of the threaded connection according to the invention, each spring part has a varying radial spring thickness, such as two radially narrowed sections. In particular, the radial spring thickness of the spring parts may be smaller than a radial first ratchet thickness of the first ratchet part and/or a radial first mounting thickness of the first mounting parts.

In an embodiment of the threaded connection according to the invention, the anti-rotation device is configured to be activated by relative rotation between the pin and the box in the make-up rotation direction until final make-up of the threaded connection is reached.

In an embodiment of the threaded connection according to the invention, the first ratchet teeth and the second ratchet teeth extend in opposite radial directions relative to the longitudinal axis when engaging each other at final make-up of the threaded connection.

In an embodiment of the threaded connection according to the invention, the first radial recess extends along part of a circumference of said one of the outer pin surface of the pin and the inner box surface of the box.

In an embodiment of the threaded connection according to the invention, the second radial recess extends along part of a circumference of said other of the outer pin surface of the pin and the inner box surface of the box.

In an embodiment of the threaded connection according to the invention, the radial movement relative to the longitudinal axis of the first ratchet part moves the first ratchet teeth radially relative to the second ratchet teeth.

It will be clear to the skilled person that the threaded connection according to the invention may comprise the features of any combination of the above described embodiments of the threaded connection according to the invention.

The invention further relates to a method of making up a threaded connection for exploration and production of a hydrocarbon well, comprising the step of activating the anti-rotation device of the threaded connection according to the invention by relative rotation between the pin and the box in the make-up rotation direction until final make-up of the threaded connection is reached.

The invention further relates to an anti-rotation device for a threaded connection for exploration and production of a hydrocarbon well, said threaded connection comprising a pin comprising an outer pin surface provided with an external thread, and a box comprising an inner box surface provided with an internal thread for mating with the external thread during rotational make-up of the threaded connection, which pin and the box extend along a longitudinal axis, and wherein:

- the anti-rotation device is configured to allow relative rotation between the pin and the box in a make-up rotation direction and prevent relative rotation between the pin and the box in an opposite break-out rotation direction,
- the anti-rotation device comprises a releasably mounted first anti-rotation member which is arranged in a first radial recess provided in one of the outer pin surface of the pin and the inner box surface of the box, and a second anti-rotation member provided at the other of the outer pin surface of the pin and the inner box surface of the box,
- the first anti-rotation member comprises a first ratchet part provided with radially extending first ratchet teeth,
- the second anti-rotation member comprises a second ratchet part provided with radially extending second ratchet teeth which engage the first ratchet teeth of the first anti-rotation member at final make-up of the threaded connection,
- the first anti-rotation member comprises a spring part which allows radial movement of the first ratchet part in radial direction relative to the longitudinal axis when first ratchet teeth slide along second ratchet teeth during relative rotation between the pin and the box in the make-up rotation direction, and
- the first ratchet part and the spring part of the first anti-rotation member are integrally formed.

The invention further relates to an anti-rotation device for a threaded connection for exploration and production of a hydrocarbon well, said threaded connection comprising a pin comprising an outer pin surface provided with an external thread, and a box comprising an inner box surface provided with an internal thread for mating with the external thread during rotational make-up of the threaded connection, which pin and the box extend along a longitudinal axis, and wherein:

- the anti-rotation device is configured to allow relative rotation between the pin and the box in a make-up rotation direction and prevent relative rotation between the pin and the box in an opposite break-out rotation direction,
- the anti-rotation device comprises a releasably mounted first anti-rotation member which is arranged in a first radial recess provided in one of the outer pin surface of the pin and the inner box surface of the box, and a second anti-rotation member provided at the other of the outer pin surface of the pin and the inner box surface of the box,
- the first anti-rotation member comprises a first ratchet part provided with radially extending first ratchet teeth,
- the second anti-rotation member comprises a second ratchet part provided with radially extending second ratchet teeth which engage the first ratchet teeth of the first anti-rotation member at final make-up of the threaded connection,
- the first anti-rotation member comprises a spring part which allows radial movement of the first ratchet part in radial direction relative to the longitudinal axis when first ratchet teeth slide along second ratchet teeth during relative rotation between the pin and the box in the make-up rotation direction,
- the first anti-rotation member is arranged in the first radial recess being provided in the outer pin surface of the pin, and the second anti-rotation member is provided at the inner box surface of the box,
- the pin comprises a pin retainer part,
- the second anti-rotation member comprises a member retainer part,
- the member retainer part is in radial direction located closer to the longitudinal axis than the pin retainer part, and
- the pin retainer part overlaps the member retainer part at least partly in axial direction relative to the longitudinal axis at final make-up of the threaded connection.

In an embodiment of the anti-rotation device according to the invention, the pin retainer part and the member retainer part are configured to block movement of the second anti-rotation member in radial direction away from the longitudinal axis at final make-up of the threaded connection.

It will be clear to the skilled person that the anti-rotation device according to the invention may comprise the features relating to the anti-rotation device of any combination of the above described embodiments of the threaded connection according to the invention.

BRIEF DESCRIPTION OF THE DRAWINGS

Embodiments of the threaded connection, the anti-rotation device, and the method according to the invention will be described by way of example only, with reference to the accompanying schematic drawings in which corresponding reference symbols indicate corresponding parts, and in which.

DETAILED DESCRIPTION OF THE DRAWINGS

Figure 1:
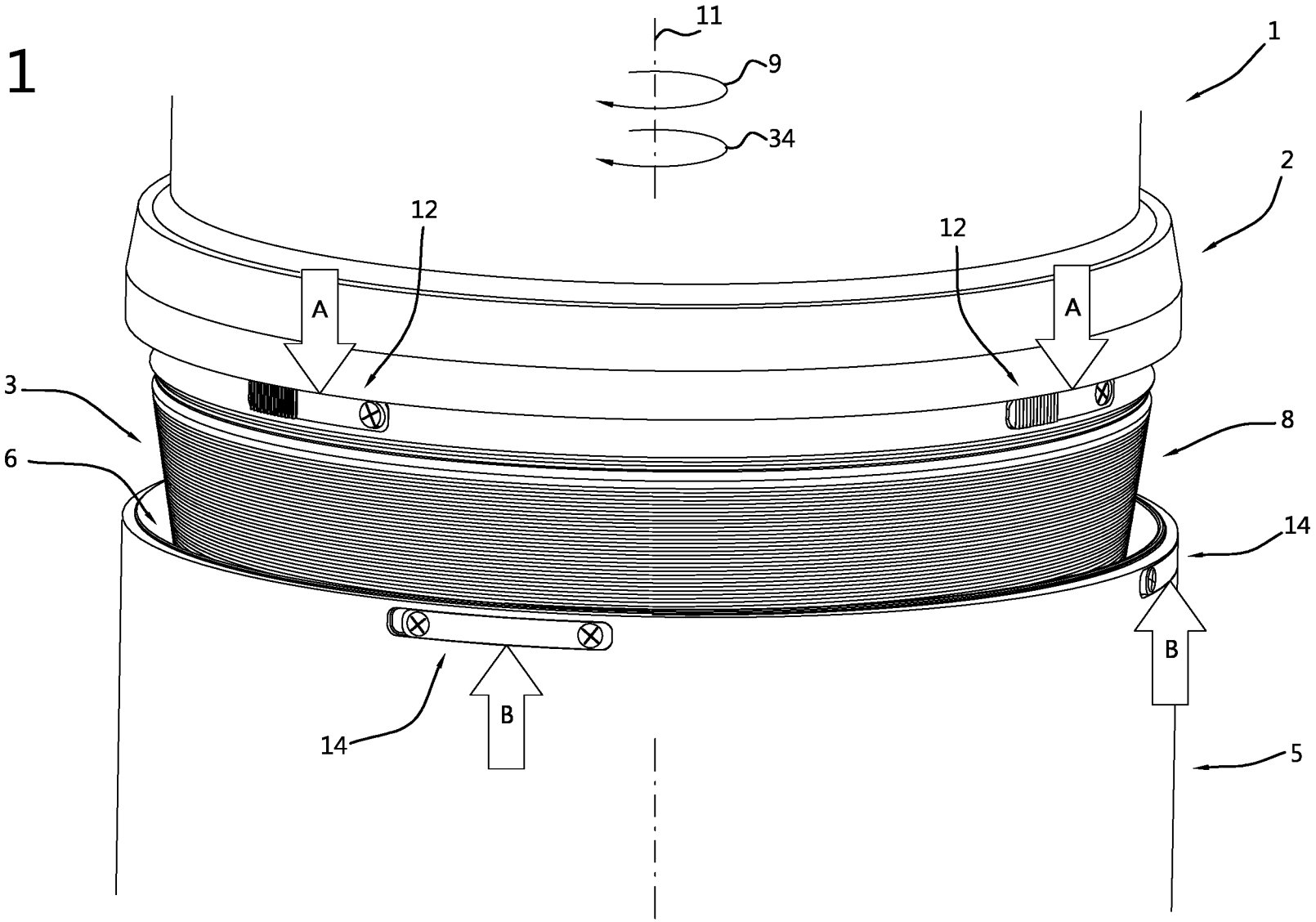
FIG. 1 schematically shows a view in perspective of an embodiment of the threaded connection according to the invention at the start of rotational make-up of the threaded connection, FIG. 2 schematically shows a view in perspective of the threaded connection of FIG. 1 at final make-up of the threaded connection, the FIGS. 3A and 3B schematically show views in perspective of the first anti-rotation member of the anti-rotation device of the threaded connection of FIG. 1, FIG. 3C schematically shows a top view of the first anti-rotation member of FIG. 3A, FIG. 3D schematically shows a side view of the first anti-rotation member of FIG. 3A, FIG. 3E schematically shows a bottom view of the first anti-rotation member of FIG. 3A, the FIGS. 4A and 4B schematically show views in perspective of the second anti-rotation member of the anti-rotation device of the threaded connection of FIG. 1, FIG. 4C schematically shows a top view of the second anti-rotation member of FIG. 4A, FIG. 4D schematically shows a side view of the second anti-rotation member of FIG. 4A, FIG. 4E schematically shows a bottom view of the second anti-rotation member of FIG. 4A, FIG. 5 schematically shows an exploded view in perspective of the first anti-rotation member and the first radial recess provided in the pin of the threaded connection of FIG. 1, FIG. 6A schematically shows a view in perspective of the first anti-rotation member arranged in the first radial recess provided in the pin of the threaded connection of FIG. 1, FIG. 6B schematically shows a top view of FIG. 6A, FIG. 6C schematically shows a side view of FIG. 6A, FIG. 7 schematically shows an exploded view in perspective of the second anti-rotation member and the second radial recess provided in the box of the threaded connection of FIG. 1, FIG. 8 schematically shows a view in perspective of the second anti-rotation member arranged in the second radial recess provided in the box of the threaded connection of FIG. 1, FIG. 9A schematically shows another view in perspective of the second anti-rotation member arranged in the second radial recess provided in the box of the threaded connection of FIG. 1, FIG. 9B schematically shows a top view of FIG. 9A, FIG. 9C schematically shows a side view of FIG. 9A, FIG. 10 schematically shows a view in perspective of the first anti-rotation member arranged in the first radial recess provided in the pin and the second anti-rotation member arranged in the second radial recess provided in the box of the threaded connection of FIG. 1, the FIGS. 11A-11G schematically show views in cross section of part of the threaded connection of FIG. 1 wherein the anti-rotation device is activated by rotational make-up of the threaded connection until final make-up is reached, FIG. 12 schematically shows a view in cross section of part of threaded connection of FIG. 1 at final make-up and indicating a finite element analysis in the situation that a break-out torque is applied to the pin and the box in the break-out rotation direction, the FIGS. 13A-D schematically show views of the first anti-rotation member of an alternative embodiment of the threaded connection according to the invention, the FIGS. 14A-B schematically show views of the first radial recess provided in the box of the alternative embodiment of the threaded connection of FIG. 13A-D, the FIGS. 15A-B schematically show views of the first anti-rotation member of the FIGS. 13A-D arranged in the first radial recess of the FIGS. 14A-B, FIG. 16 schematically shows a view of the second anti-rotation member of the alternative embodiment of the threaded connection of FIG. 13A-D, FIG. 17 schematically shows a view of the second radial recess provided in the pin of the alternative embodiment of the threaded connection of FIG. 13A-D, FIG. 18 schematically shows a view of the second anti-rotation member of the FIG. 16 arranged in the second radial recess of the FIG. 17, FIG. 19 schematically shows a view in perspective of a further embodiment of the threaded connection according to the invention at the start of rotational make-up of the threaded connection, FIG. 20 schematically shows a view in perspective of the threaded connection of FIG. 19 at final make-up of the threaded connection, the FIGS. 21A, 21B, 22A, 22B schematically show views in perspective of the first anti-rotation member and the second anti-rotation member of the anti-rotation device of the threaded connection of FIG. 19, FIGS. 23A and 23B schematically show side views of the second anti-rotation member of the FIGS. 21A, 21B, 22A, 22B, FIG. 24 schematically shows an exploded view in perspective of the second anti-rotation member and the second radial recess provided in the box of the threaded connection of FIG. 19, FIG. 25 schematically shows a view in perspective of the second anti-rotation member arranged in the second radial recess provided in the box of the threaded connection of FIG. 19, FIG. 26A schematically shows another view in perspective of the second anti-rotation member arranged in the second radial recess provided in the box of the threaded connection of FIG. 19, FIG. 26B schematically shows a top view of FIG. 26A, FIG. 26C schematically shows a side view of FIG. 26A, the FIGS. 26D and 26E schematically show enlarged views of the part XXVI of FIG. 26C, FIG. 27 schematically shows a view in perspective of the first anti-rotation member arranged in the first radial recess provided in the pin and the second anti-rotation member arranged in the second radial recess provided in the box of the threaded connection of FIG. 19, FIG. 28A schematically shows a view in cross section along the longitudinal axis of the threaded connection of FIG. 19 at final make-up, FIG. 28B schematically shows an enlarged view of the first anti-rotation member and the second anti-rotation member of FIG. 28A, and FIG. 28C schematically shows an enlarged view of part XXVIII of FIG. 28B.
Figure 2:
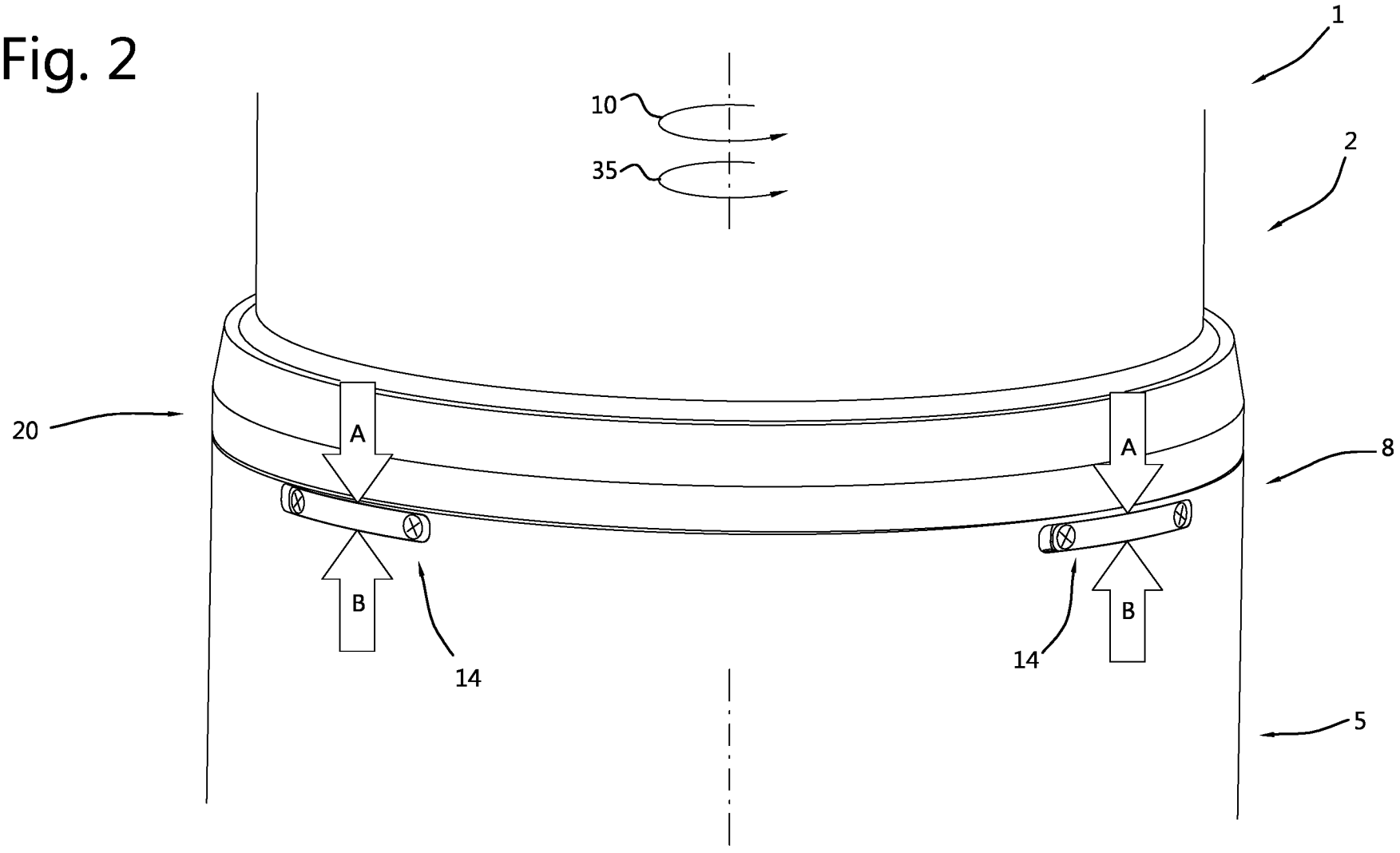
Figure 3A:
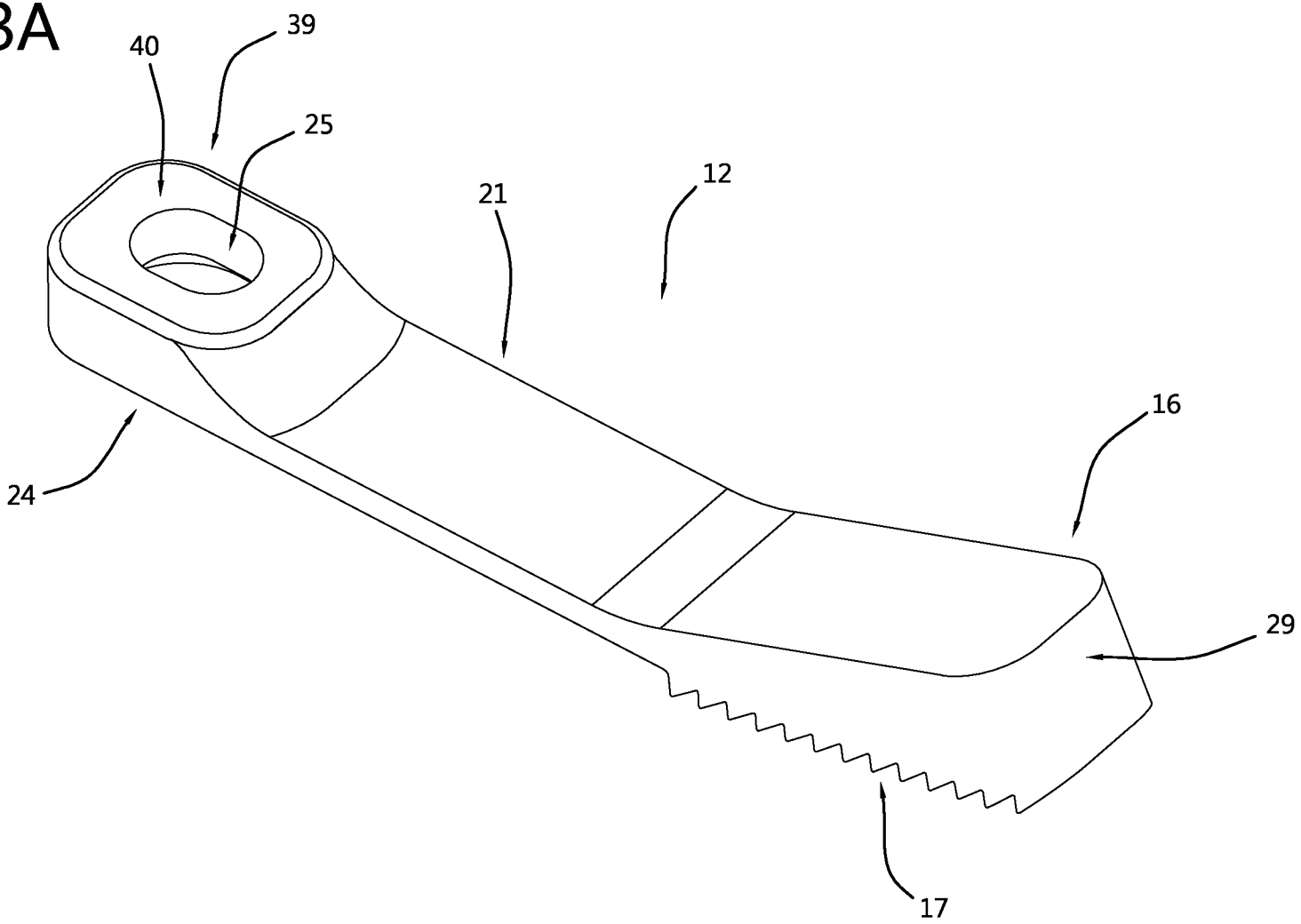
Figure 3B:
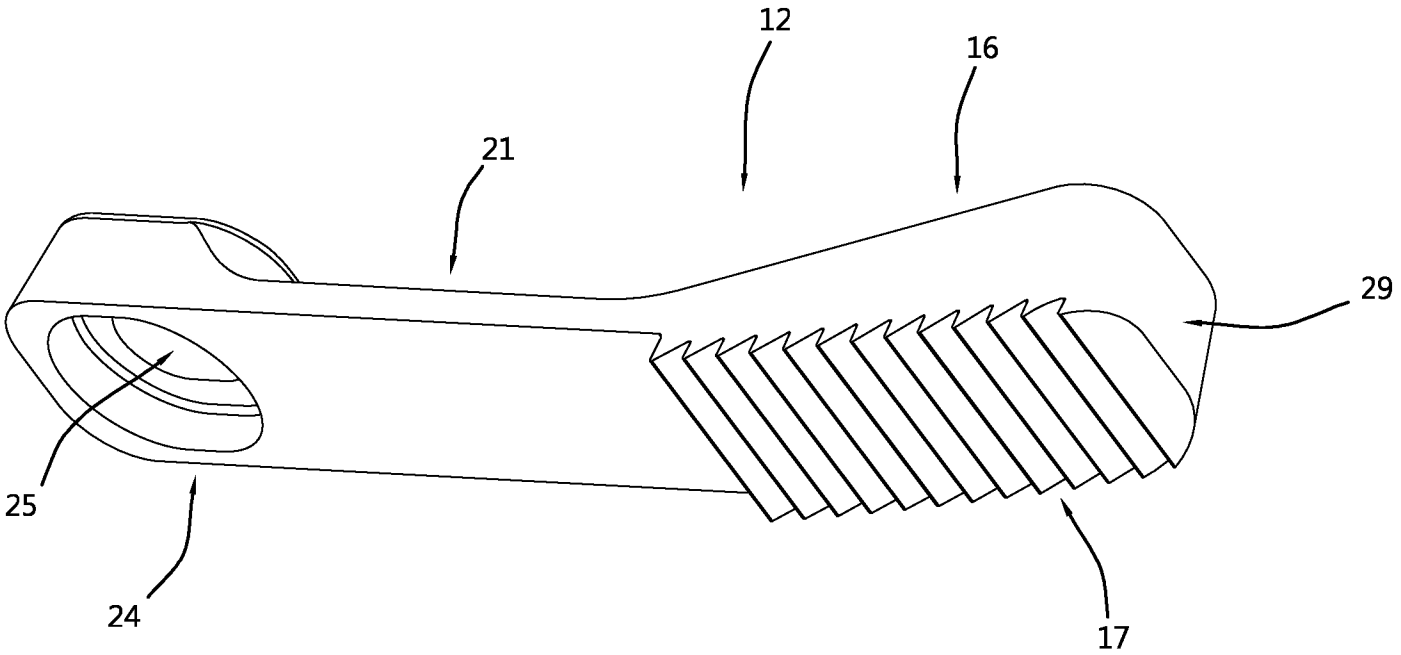
Figure 3C:
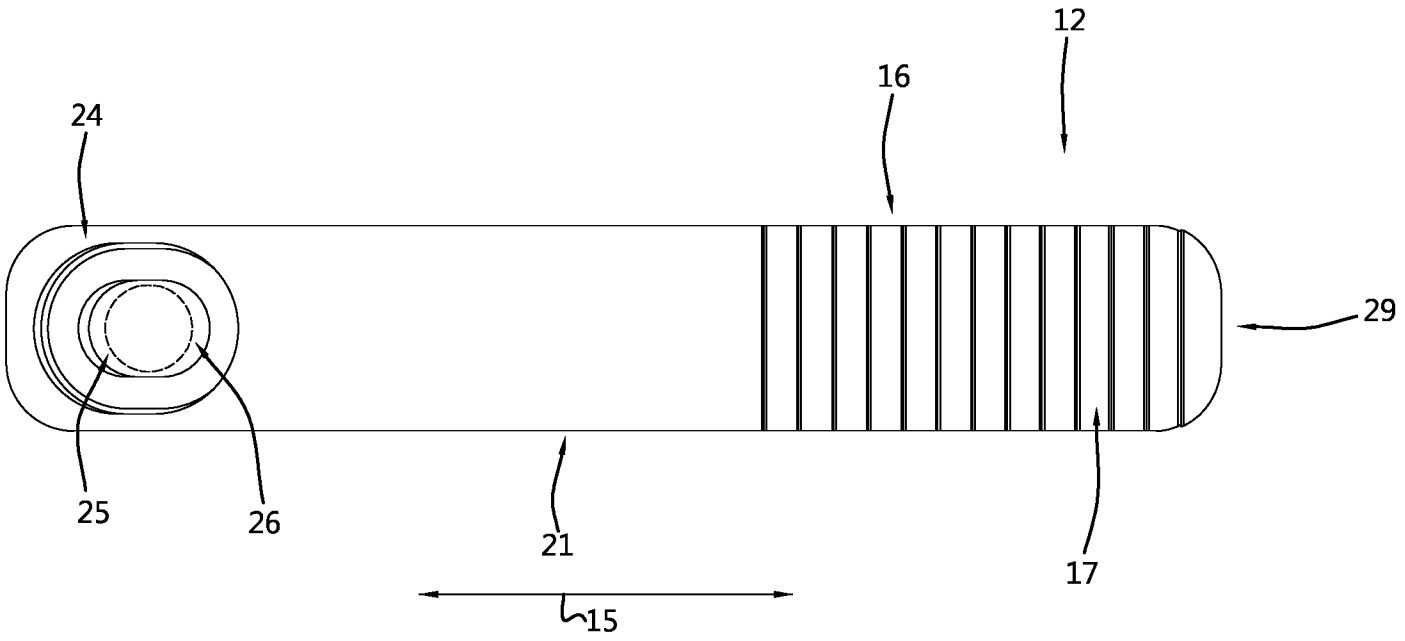
Figure 3D:
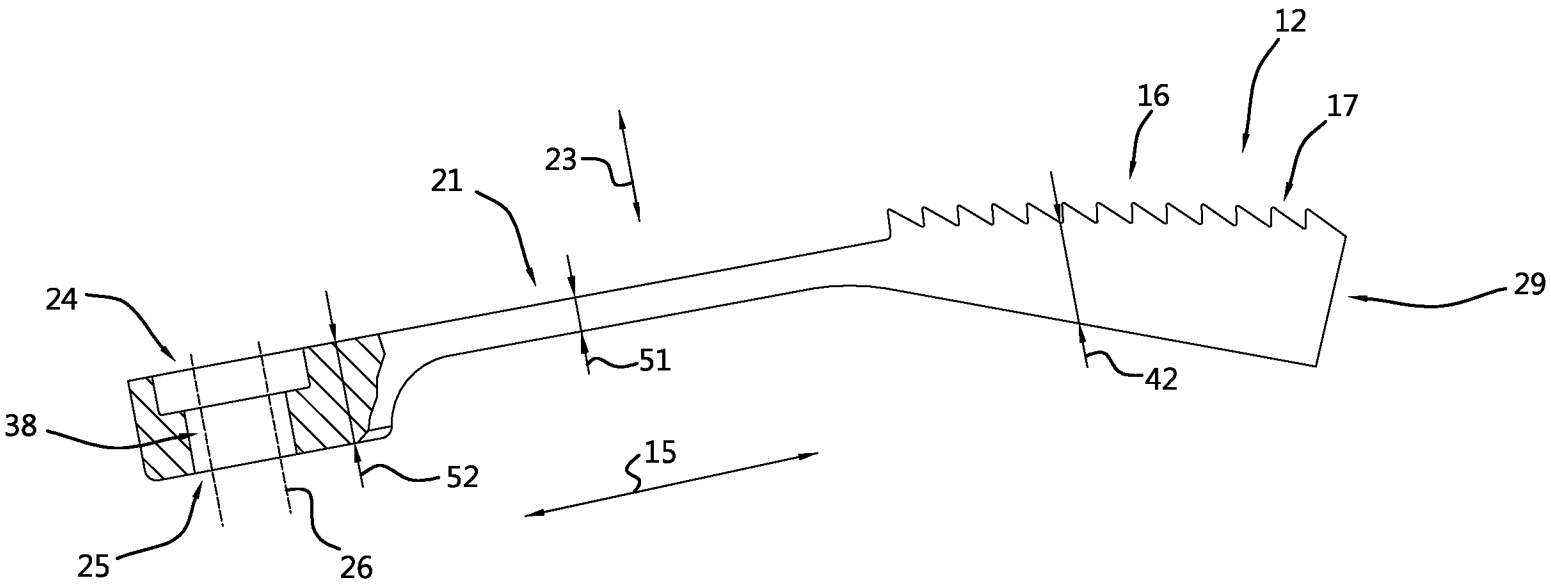
Figure 3E:
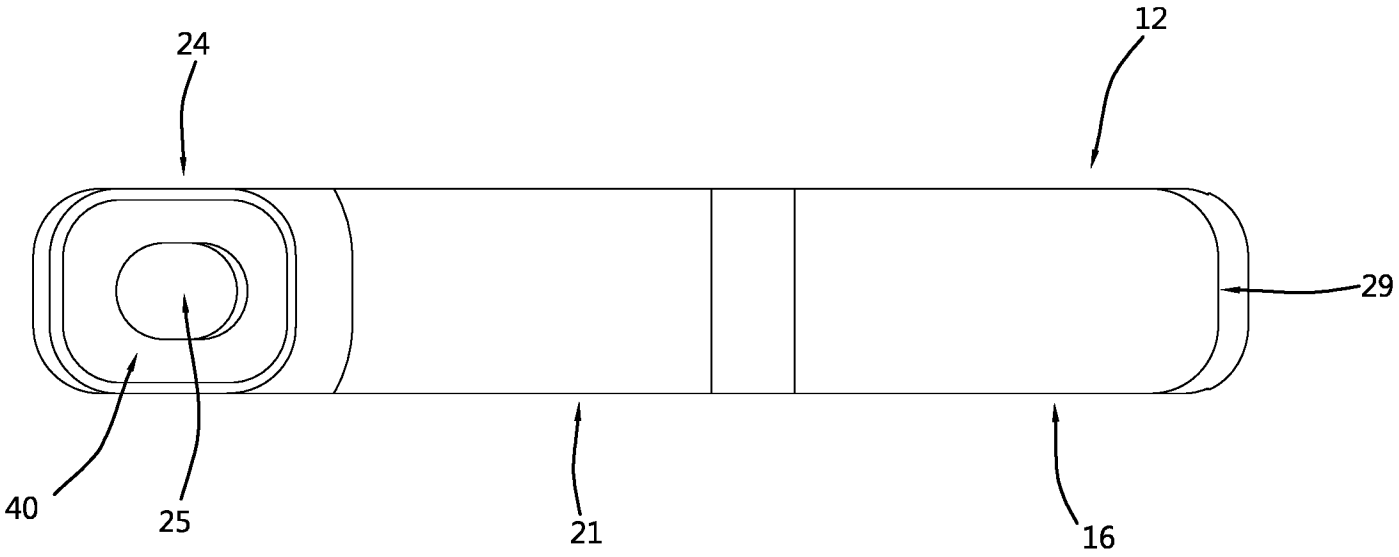
Figure 4A:
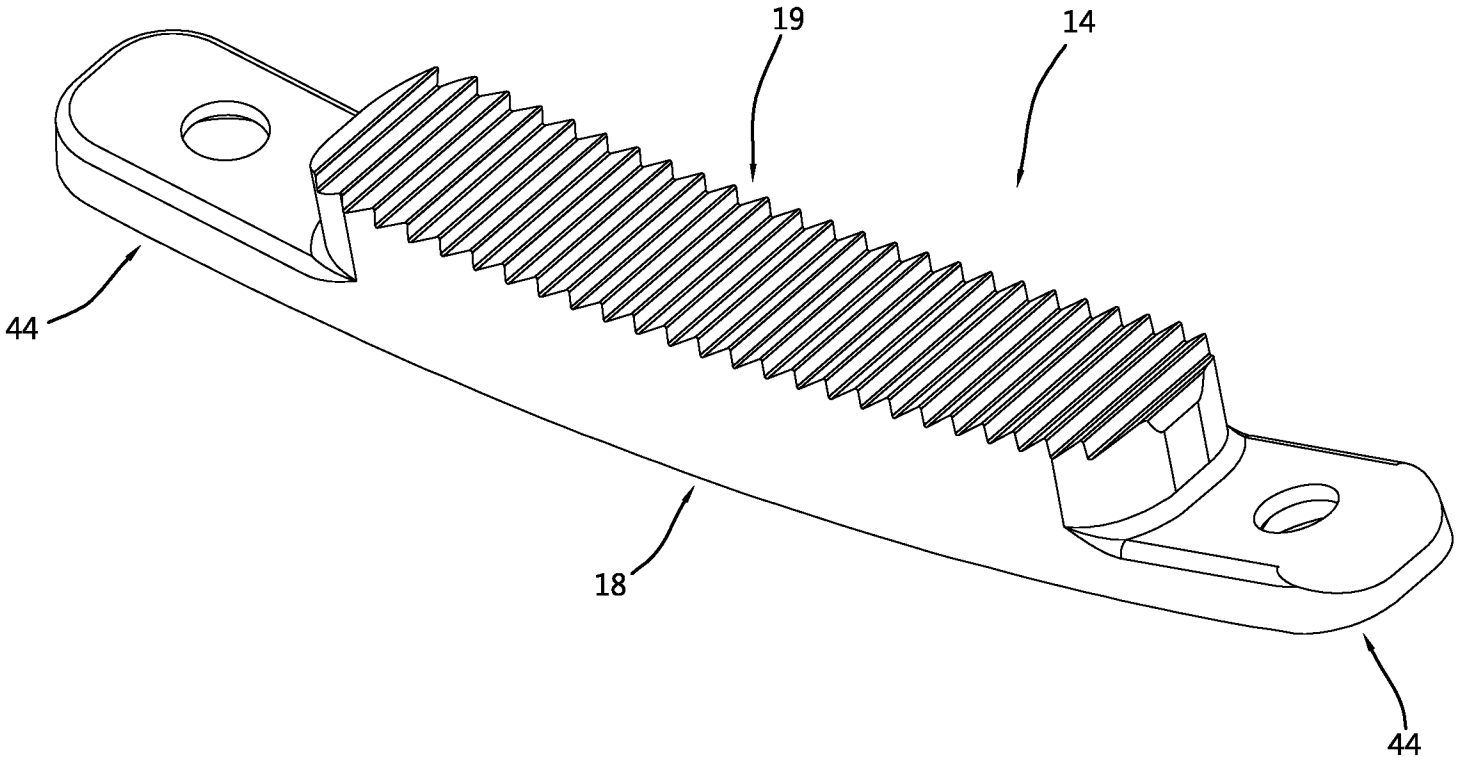
Figure 4B:
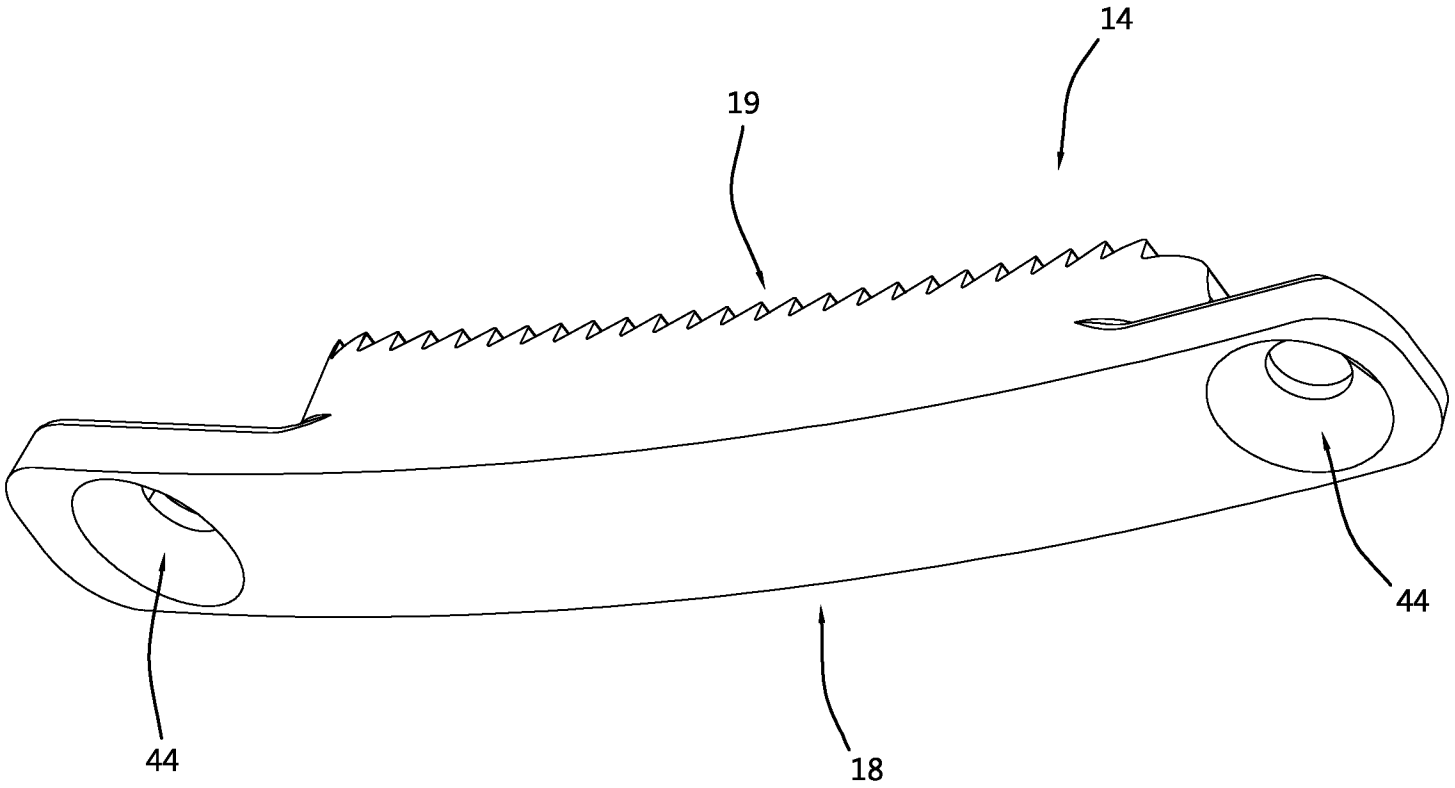
Figure 4C:
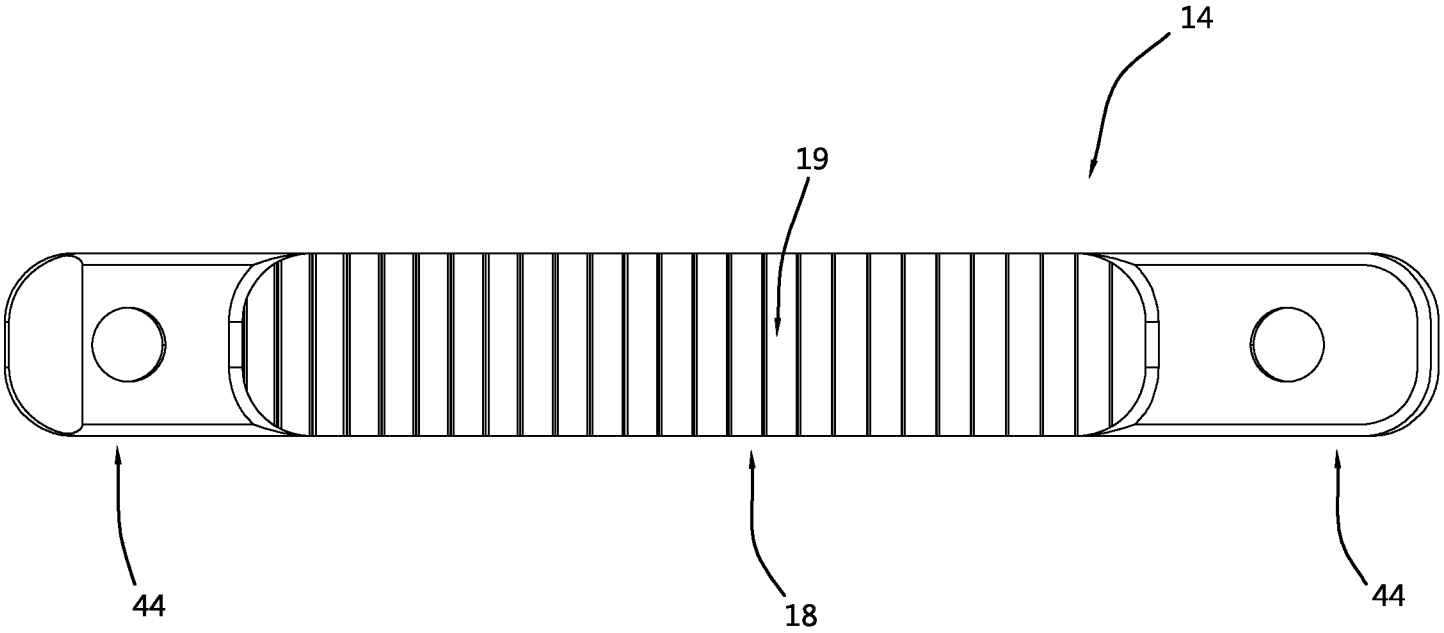
Figure 4D:
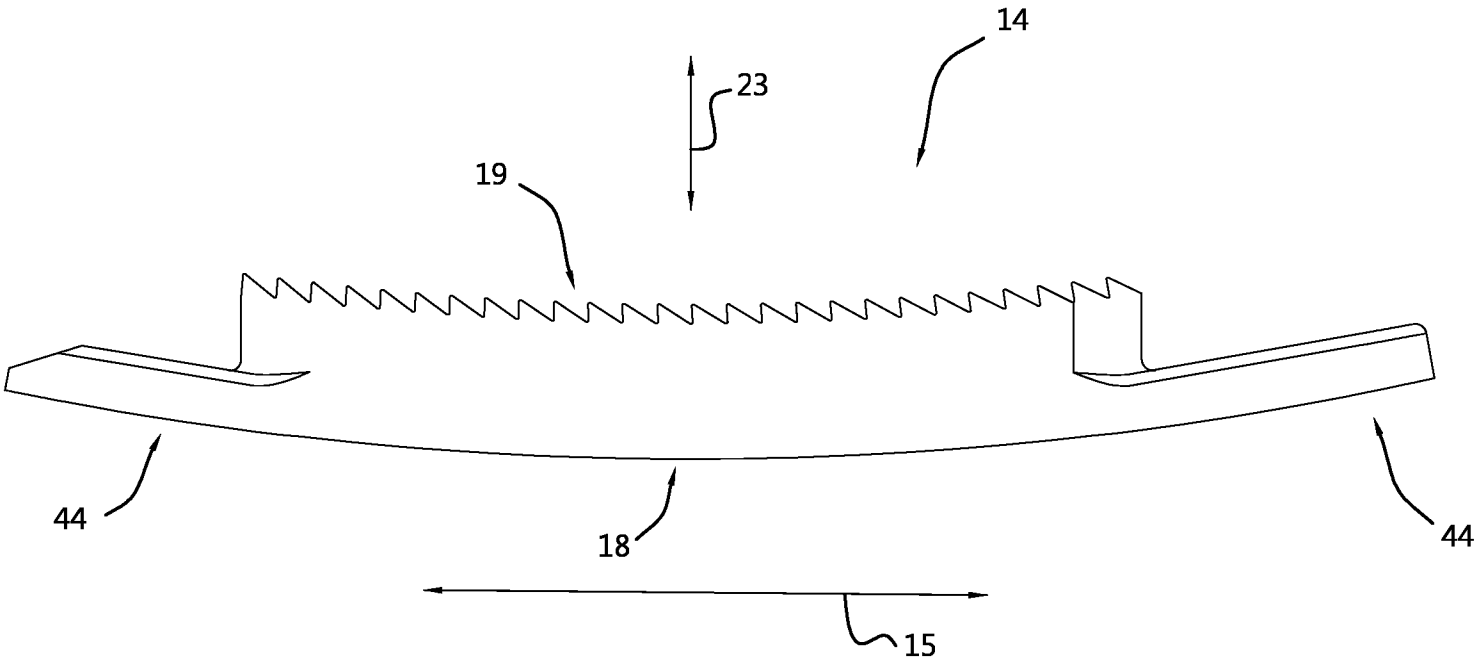
Figure 4E:
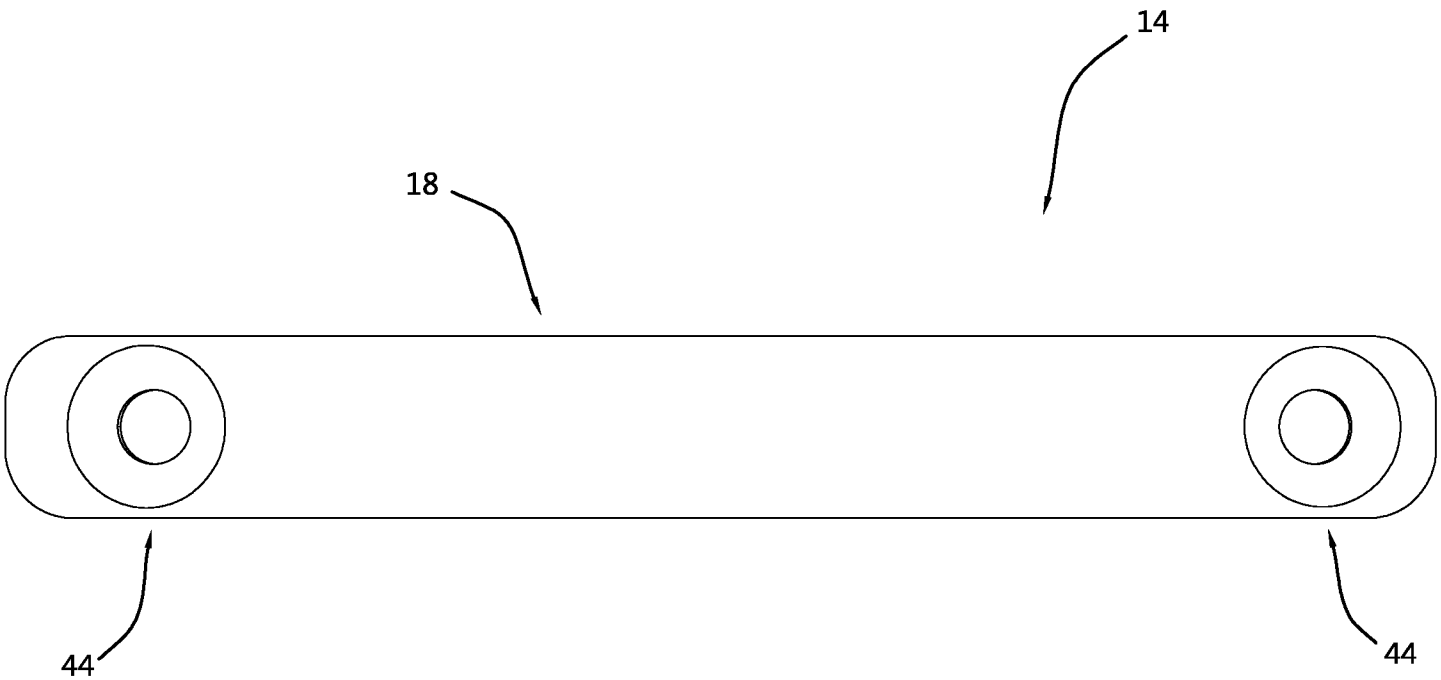

FIG. 1 shows a view in perspective of an embodiment of the threaded connection 1 according to the invention at the start of rotational make-up of the threaded connection 1. FIG. 2 shows the threaded connection 1 of FIG. 1 at final make-up 20 of the threaded connection 1.

The threaded connection 1 is configured for exploration and production of a hydrocarbon well. The threaded connection 1 comprises a pin 2 comprising an outer pin surface 3 provided with an external thread 4, a box 5 comprising an inner box surface 6 provided with an internal thread 7 for mating with the external thread 4 during rotational make-up of the threaded connection 1. The pin 2 and the box 5 extend along a longitudinal axis 11. Said longitudinal axis 11 is aligned with the axially extending central axis of the tubular members that comprise the box 5 and the pin 2.

An anti-rotation device 8 is provided to allow relative rotation between the pin 2 and the box 5 in a make-up rotation direction 9 and prevent relative rotation between the pin 2 and the box 5 in an opposite break-out rotation direction 10. The relative rotation between the pin 2 and the box 5 in the make-up rotation direction 9 is induced by applying a make-up torque 34 to the pin 2 and the box 5 in the make-up rotation direction 9. The relative rotation between the pin 2 and the box 5 in the break-out rotation direction 10 (which is prevented by the anti-rotation device 8) is induced by applying a break-out torque 35 to the pin 2 and the box 5 in the break-out rotation direction 10.

FIG. 1 shows the situation in which the box 5 is static and the pin 2 is rotated in the make-up rotation direction 9 as a result of a make-up torque 34 applied to the pin 2. FIG. 2 shows the situation in which the box 5 is static and a break-out torque 35 is applied to the pin 2. Rotation of the pin 2 in the break-out rotation direction 10 is prevented by the anti-rotation device 8.

Figure 12:
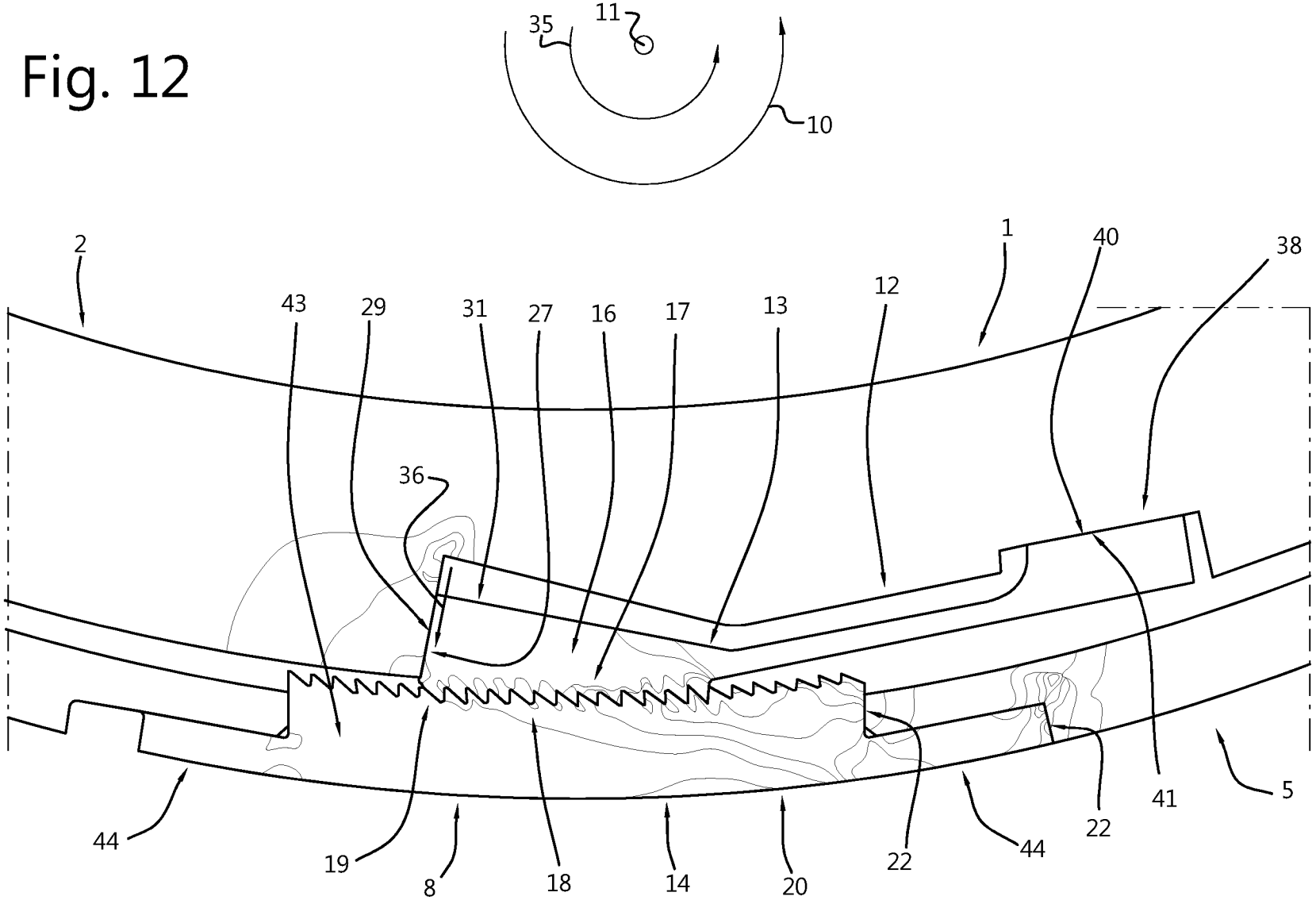
Figure 13A:
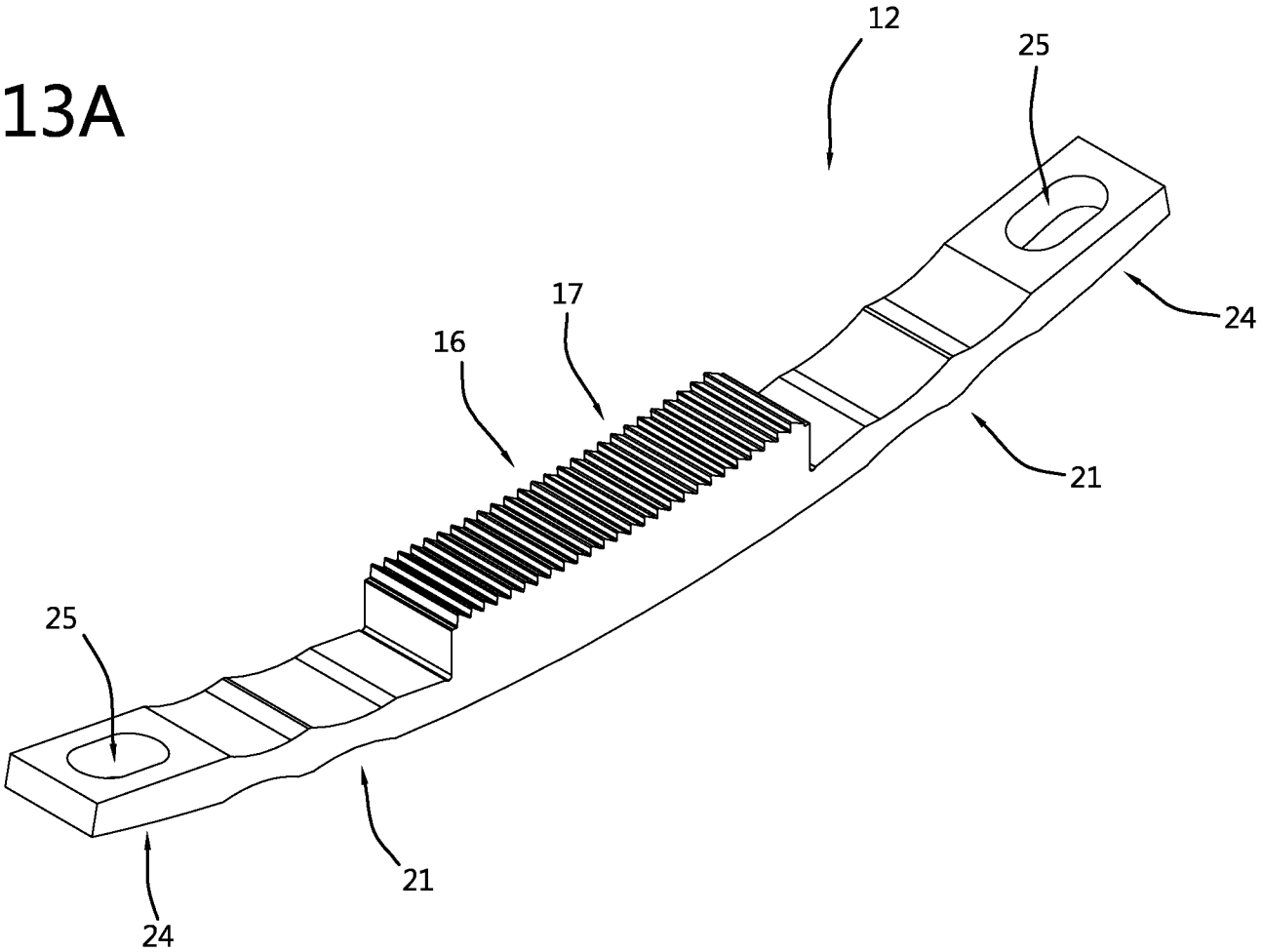
Figure 13B:
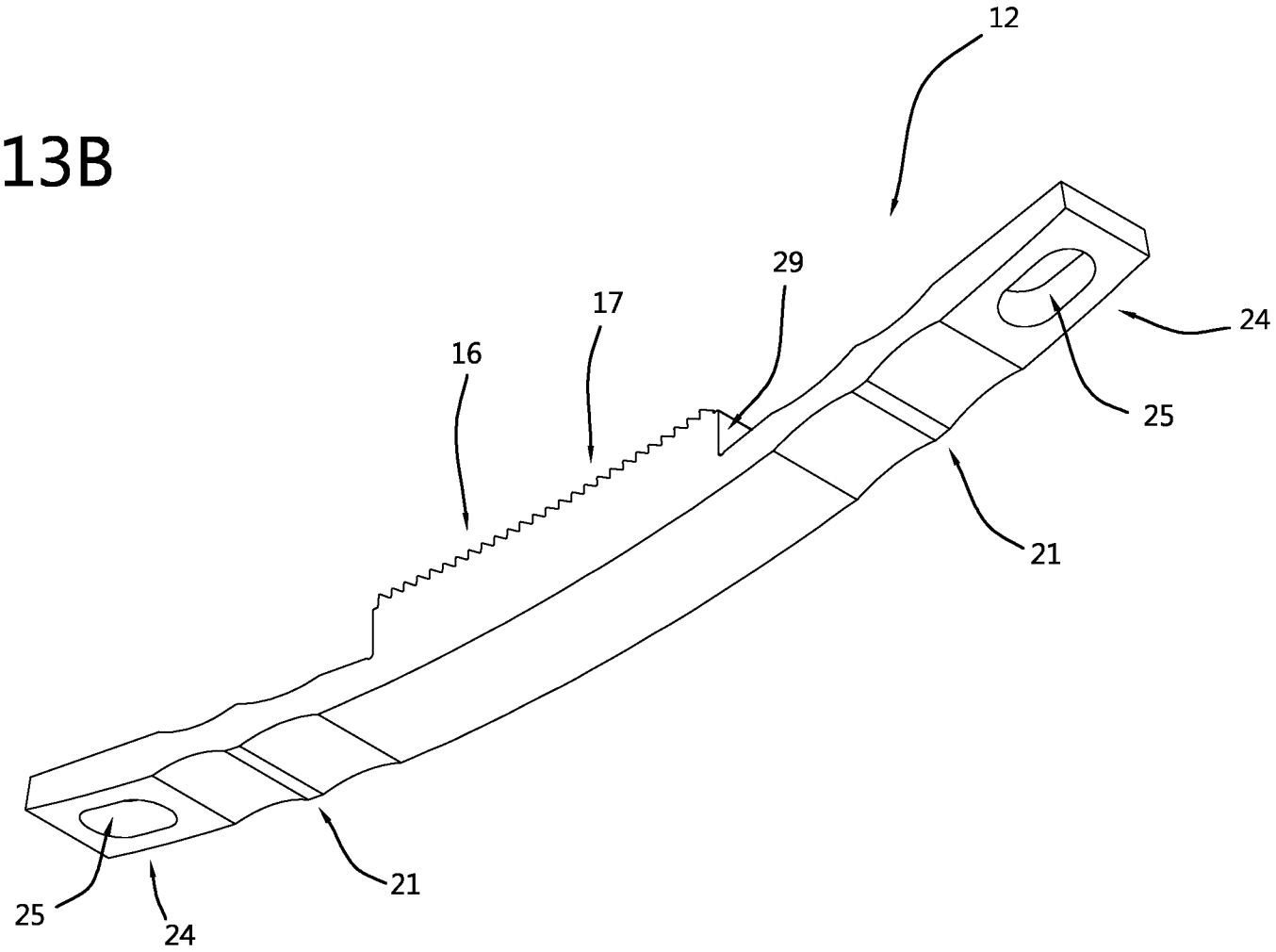
Figure 13C:
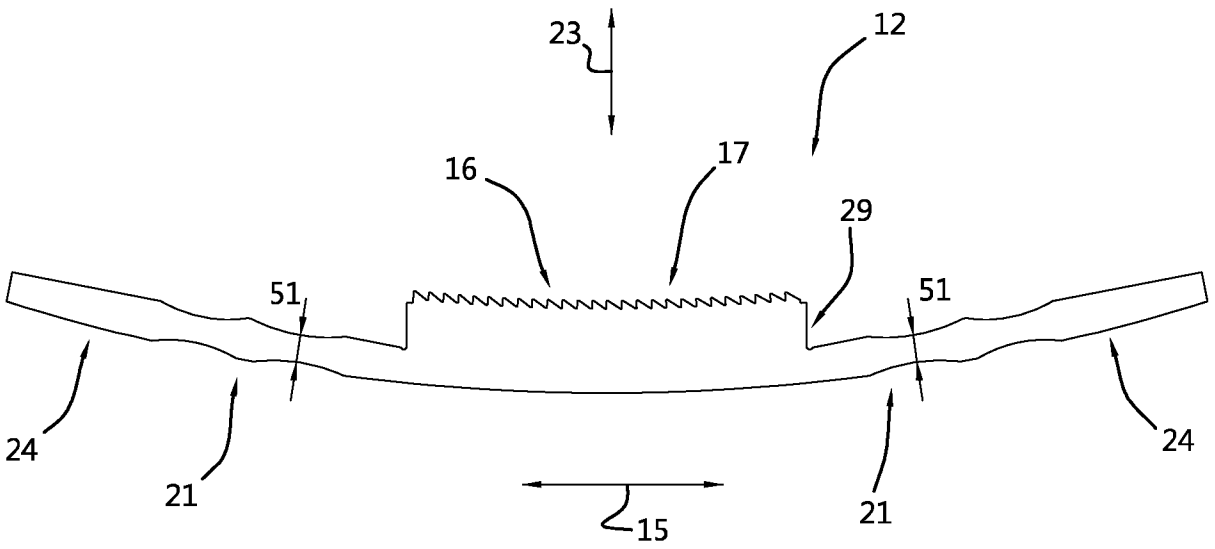
Figure 13D:
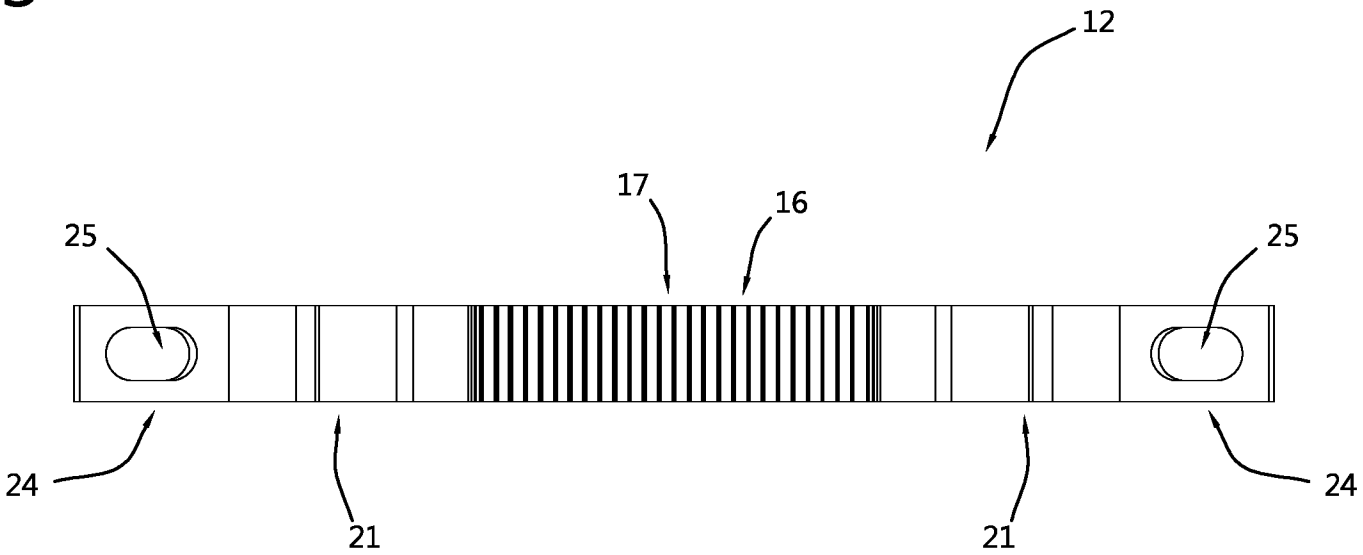

The FIGS. 11A-11G show views in cross section of part of the threaded connection 1 of FIG. 1 wherein the anti-rotation device 8 is activated by rotational make-up of the threaded connection 1 until final make-up 20 is reached. FIG. 12 shows a view in cross section of part of threaded connection 1 of FIG. 1 at final make-up 20 and indicating a finite element analysis in the situation that a break-out torque 35 is applied to the pin 2 and the box 5 in the break-out rotation direction 10. The first ratchet teeth 17 and the second ratchet teeth 19 extend in opposite radial directions 23 relative to the longitudinal axis 11 when engaging each other at final make-up 20 of the threaded. Relative rotation between the pin 2 and the box 5 in the break-out rotation direction 10 is in FIG. 12 prevented by the anti-rotation device 8.

The anti-rotation device 8 comprises a releasably mounted first anti-rotation member 12 which is arranged in a first radial recess 13 provided in the outer pin surface 3 of the pin 2, and a second anti-rotation member 14 provided at the inner box surface 6 of the box 5. In another embodiment of threaded connection 1 according to the invention, the first anti-rotation member 12 is arranged in a first radial recess 13 provided in the inner box surface 6 of the box 5, and the second anti-rotation member 14 is provided at the outer pin surface 3 of the pin 2.

The anti-rotation device 8 comprises multiple first anti-rotation members 12 and multiple second anti-rotation members 14. The location of the first anti-rotation members 12 and the second anti-rotation members 14 are in the FIGS. 1 and 2 indicated by the arrows A and B, respectively.

The first anti-rotation member 12 comprises a first ratchet part 16 provided with radially extending first ratchet teeth 17. The second anti-rotation member 14 comprises a second ratchet part 18 provided with radially extending second ratchet teeth 19 which engage the first ratchet teeth 17 of the first anti-rotation member 12 at final make-up 20 of the threaded connection 1. In particular, the first ratchet teeth 17 and the second ratchet teeth 19 are of the saw-tooth type, wherein the first ratchet teeth 17 and the second ratchet teeth 19 are arranged to allow rotation of the pin 2 with respect to the box 5 in the make-up rotation direction 9 and limit rotation of the pin 2 with respect to the box 5 in the break-up rotation direction 10. Even more in particular, the saw-teeth of the first and second ratchet teeth 17, 19 are (slightly) negatively inclined. The first anti-rotation member 12 comprises a spring part 21 which allows radial movement of the first ratchet part 16 in radial direction 23 relative to the longitudinal axis 11 when first ratchet teeth 17 slide along second ratchet teeth 19 during relative rotation between the pin 2 and the box 5 in the make-up rotation direction 9. The radial movement relative to the longitudinal axis 11 of the first ratchet part 16 moves the first ratchet teeth 17 radially relative to the second ratchet teeth 19.

The first ratchet part 16 and the spring part 21 of the first anti-rotation member 12 are integrally formed. By providing a threaded connection 1 for exploration and production of a hydrocarbon well, wherein said first ratchet part 16 and said spring part 21 of said first anti-rotation member 12 are integrally formed, a relatively robust anti-rotation device 8 may be provided. As said first ratchet part 16 and said spring part 21 are formed from a single piece of material, a homogeneous anti-rotation member is provided. Such homogeneous anti-rotation member may provide a strong material connection between said first ratchet part 16 and said spring part 21. Accordingly, said device may be less susceptible to damage, and thus a relatively robust anti-rotation device 8 can be provided.

The second ratchet part 18 is longer than the first ratchet part 16. The teeth 19 of the second ratchet part 18 extend over a longer length than the teeth 17 of the first ratchet part 16. In particular, the second ratchet part 18 has more teeth 19 than the first ratchet part 16.

As the first ratchet part 16 and the spring part 21 are formed from a single piece of material, the first anti-rotation member 12 may be free from connection components, e.g. a screw, connecting the first ratchet part 16 with the spring part 21. The invention is amongst others based on the obtained insight that such connection components may be particularly susceptible to material deformations caused by shear stresses, in particular when the first anti-rotation member 12 is subjected to a relatively large break-out torque 35 in the break-out direction. By omitting the presence of such connection components, damage to these connection components may be prevented.

The FIGS. 3A-3E show views of the first anti-rotation member 12 of the anti-rotation device 8 of the threaded connection 1 of FIG. 1. The first anti-rotation member 12 comprises a first mounting part 24 to releasably mount the first anti-rotation member 12 in the first radial recess 13. The first anti-rotation member further comprises the first ratchet part 16, and the spring part 21. The first mounting part 24, the first ratchet part 16, and the spring part 21 of the first anti-rotation member 12 are integrally formed. The first radial recess 13 extends along part of a pin circumference 47 of the outer pin surface 3 of the pin 2.

The first ratchet part 16 is wedge shaped. In particular, the first ratchet part 16 has a substantially wedge shaped cross section. Said wedge shape has a relatively broad base that forms the first member contact surface 29 and converges towards the spring part 21 of the first anti-rotation member 12. At an outer surface of the first ratchet part 16 the first ratchet teeth 17 are provided. Said first ratchet teeth 17 extend between the first member contact surface 29 and the spring part 21. The first ratchet teeth 17 have a saw-tooth profile.

The first member contact surface 29 is provided adjacent the first ratchet teeth 17. Said first member surface 29 extends under an angle of between 45-80 degrees with respect to a plane defined by said first ratchet teeth 17.

The spring part 21 is located between the first ratchet part 16 and the first mounting part 24. Said spring 21 part is formed as an elongated plate. Said spring part 21 has a relatively small thickness in comparison with the first ratchet part 16 and the first mounting part 24. Accordingly, said spring part 21 has a lower stiffness than the first ratchet part 16 and the first mounting part 24.

The first mounting part 24 is located further away from the first ratchet part 16 than the spring part 21. Said first mounting part 24 comprises an elongated first mounting through hole 25 and has a radial first mounting thickness 52 that is greater than a radial first spring thickness 51 of the spring part 21. As such, said first mounting part 24 has a relatively high stiffness in comparison with the spring part 21.

Figure 5:
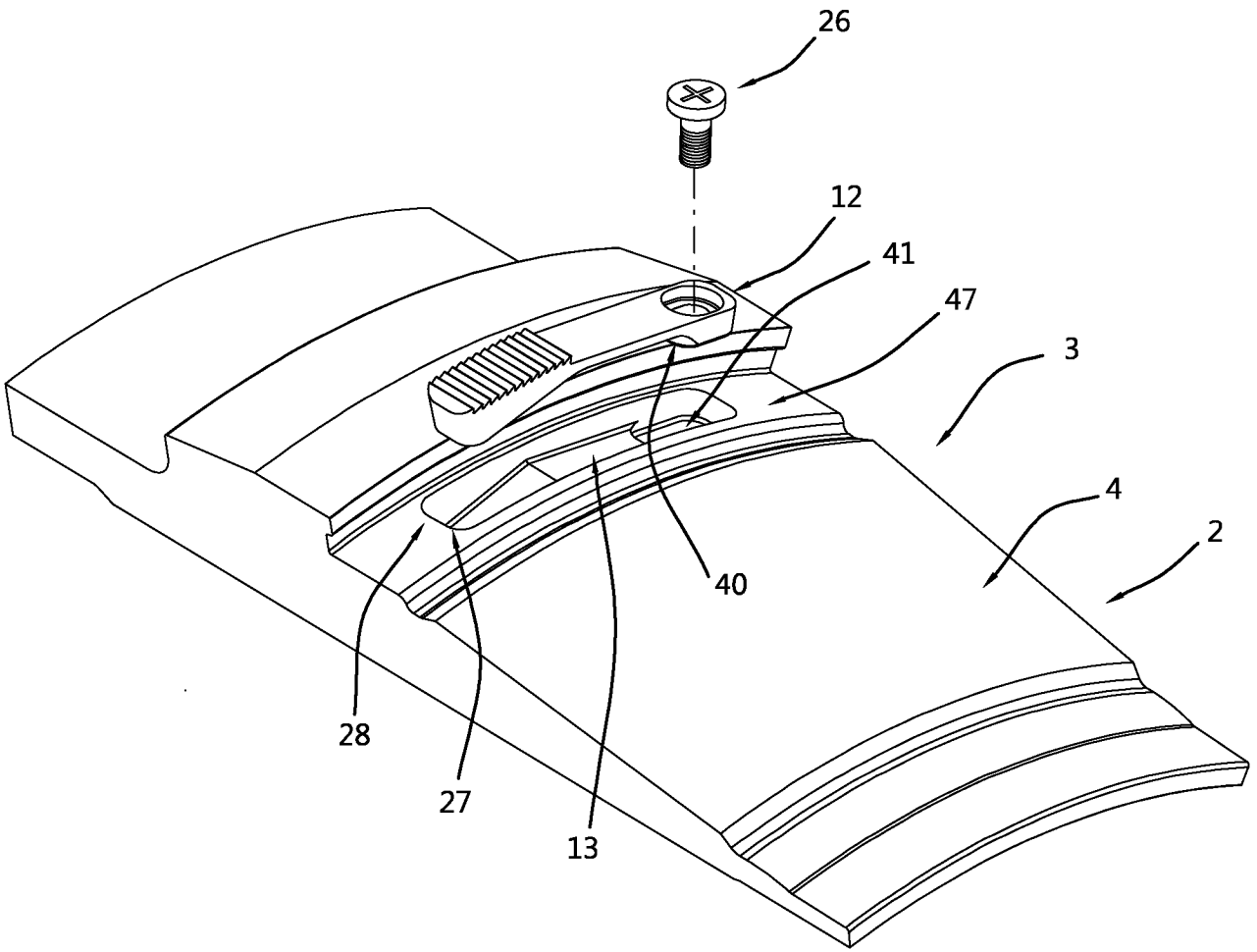
Figure 6A:
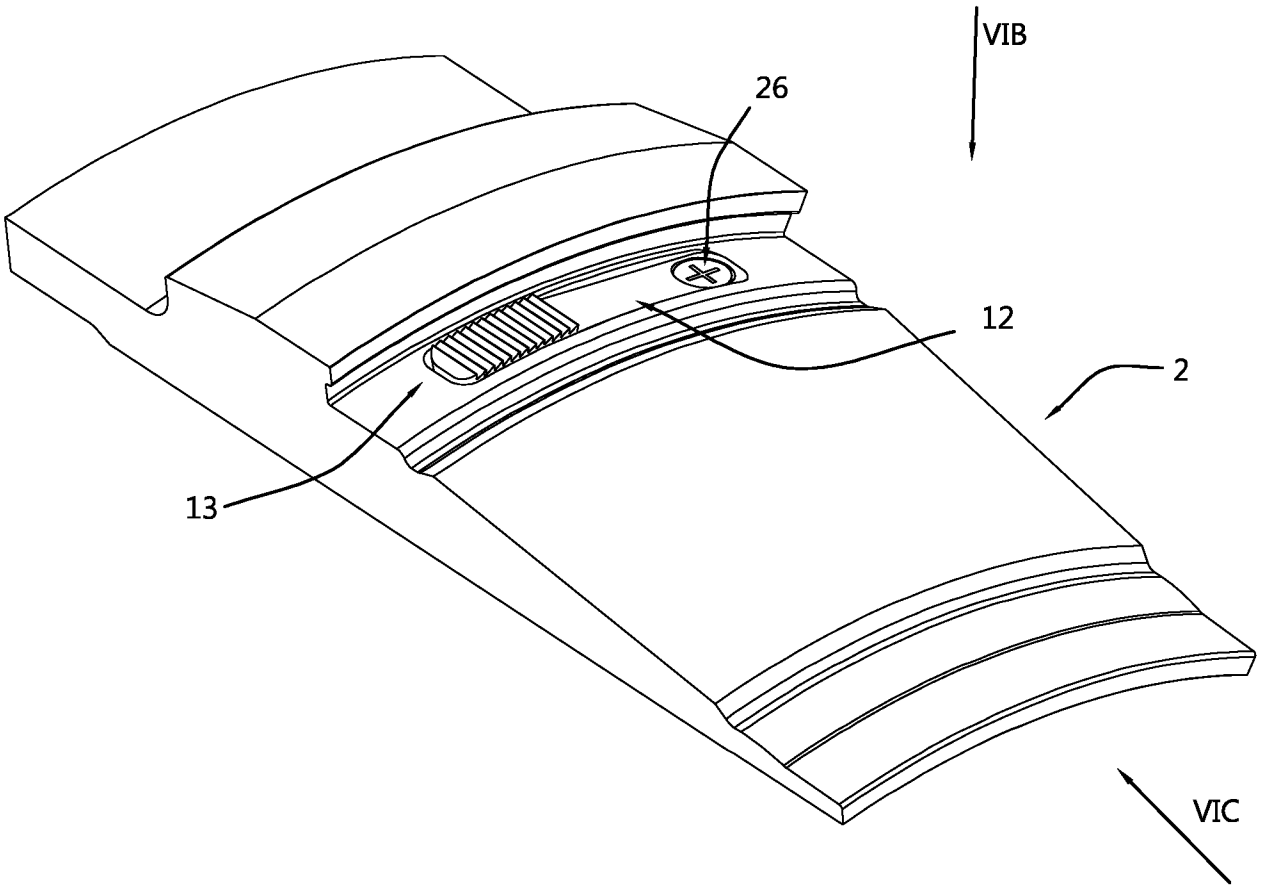
Figure 6B:
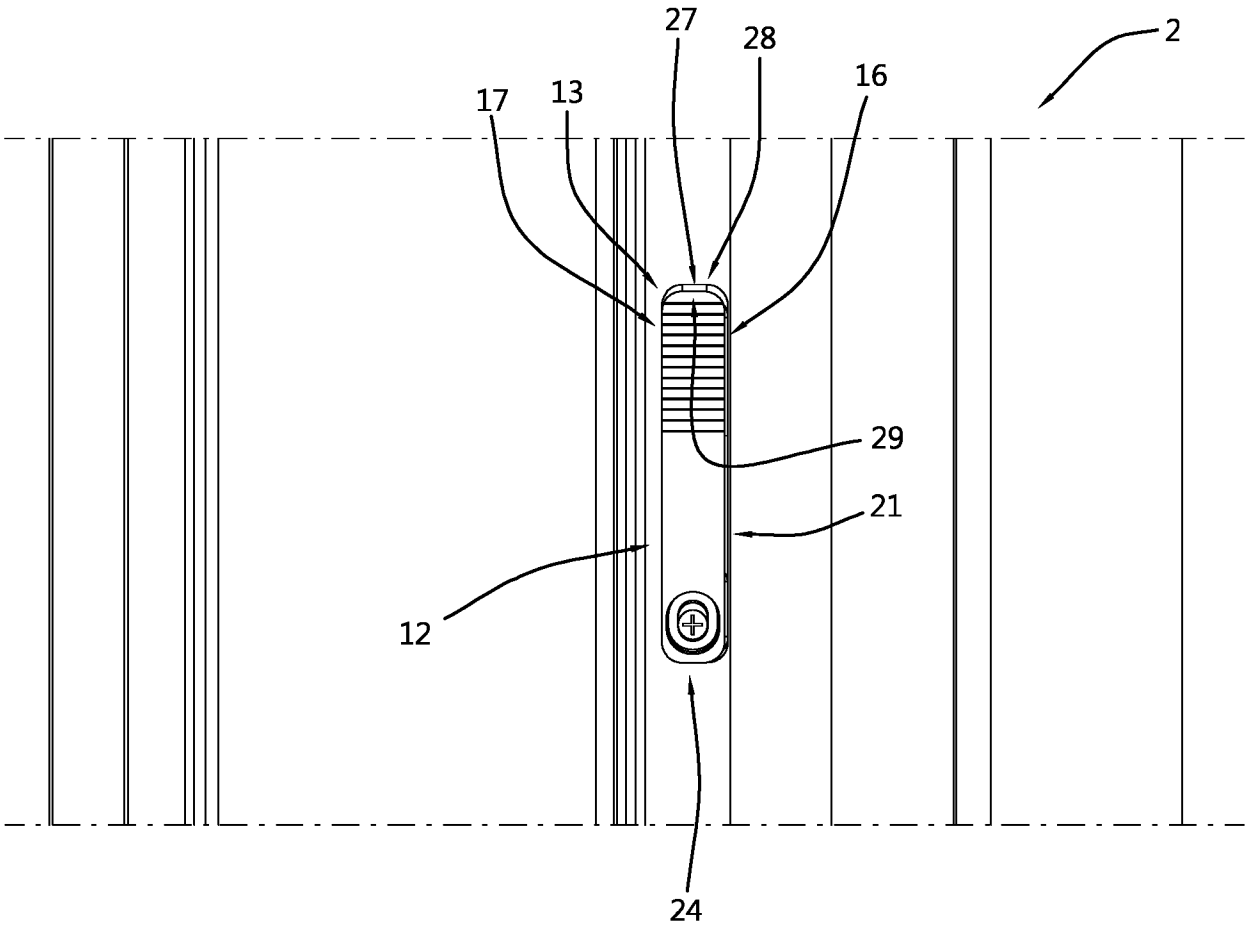
Figure 6C:
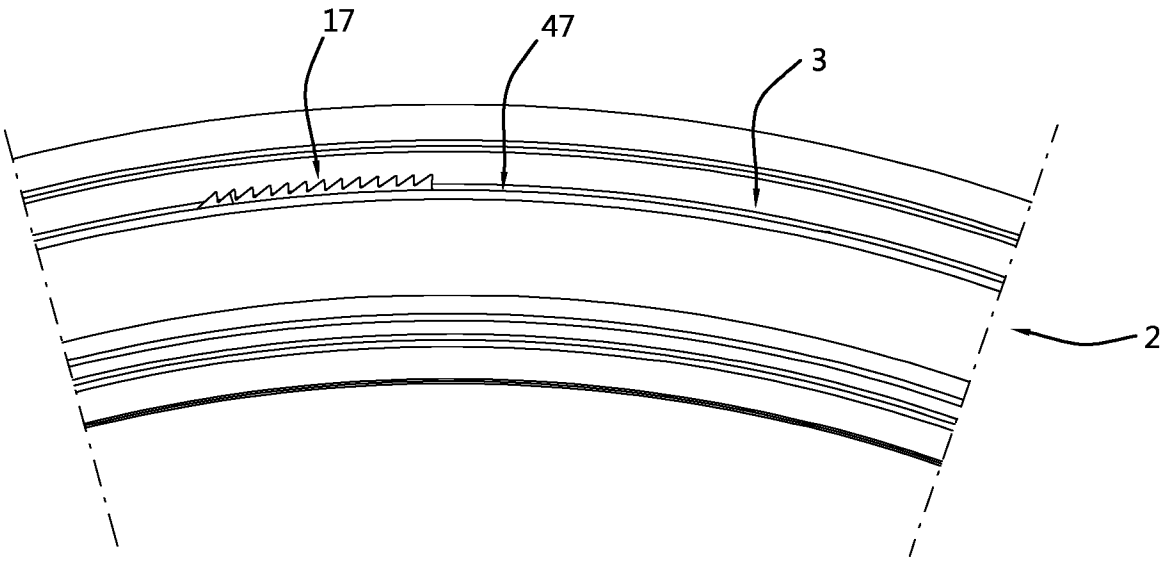
Figure 7:
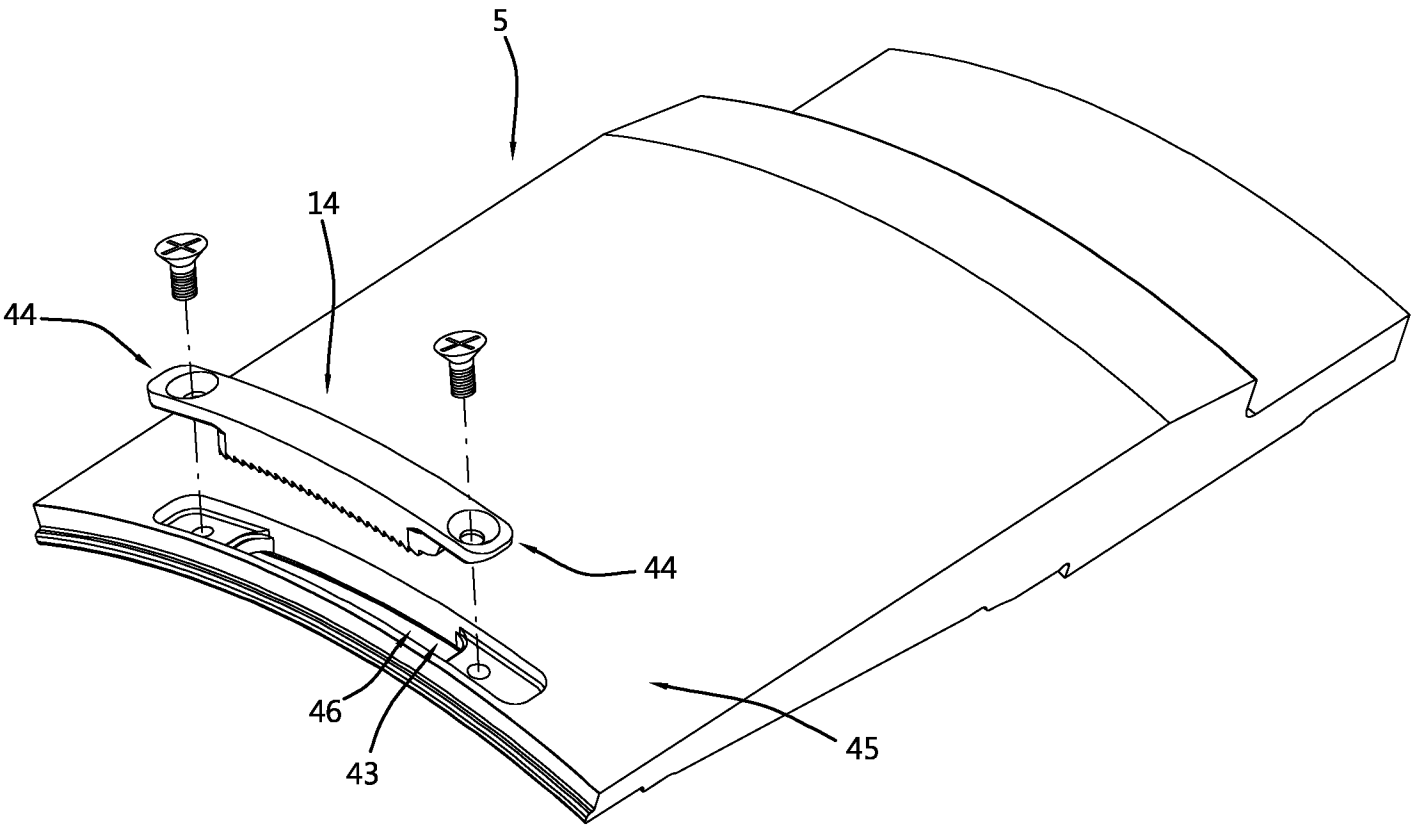
Figure 8:
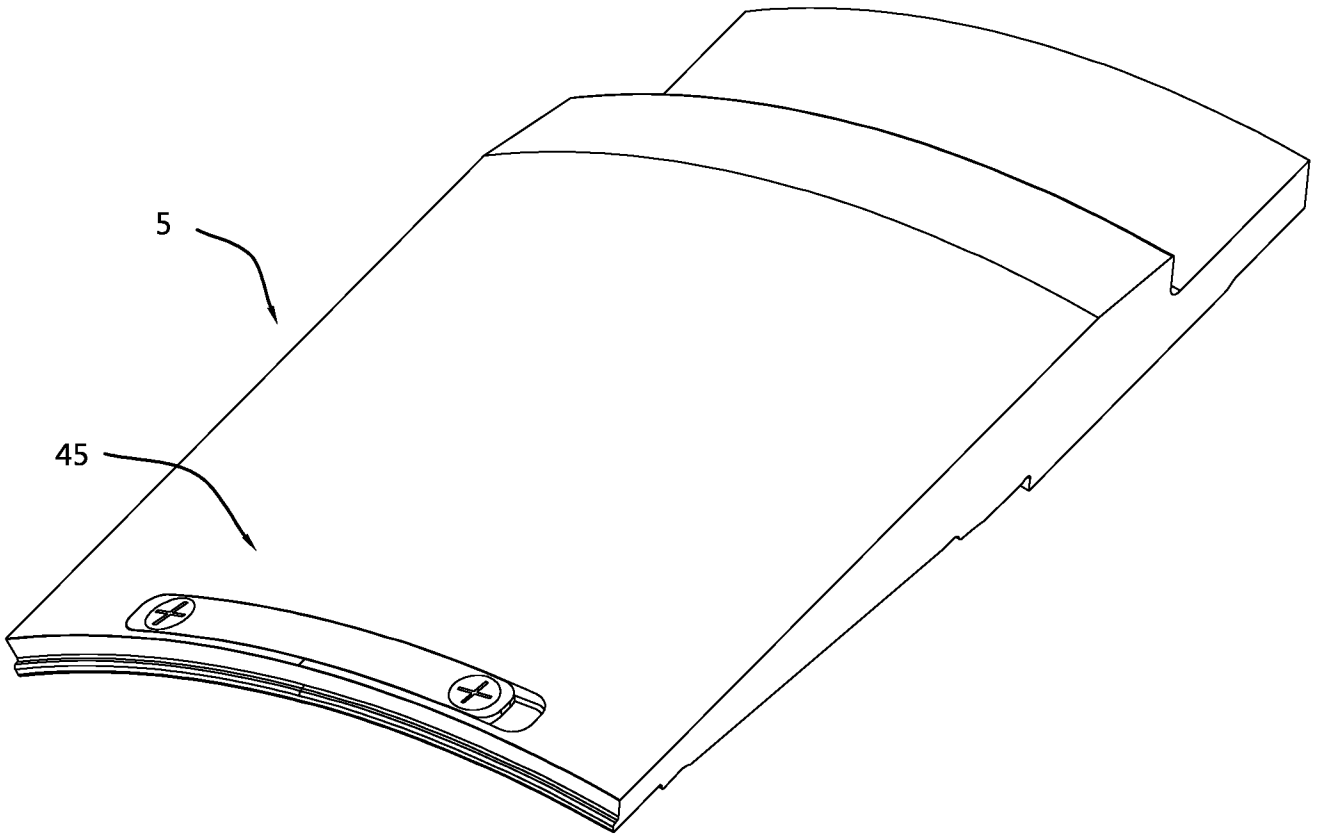

FIG. 5 shows an exploded view of the first anti-rotation member 12 and the first radial recess 13 provided in the pin 2 of the threaded connection 1 of FIG. 1 and the FIGS. 6A-C show views of the first anti-rotation member 12 arranged in the first radial recess 13. The first mounting part 24 comprises a first mounting through hole 25 to receive a first mounting member 26, such as a first screw, which releasably mounts the first anti-rotation member 12 to the pin 2.

A first recess contact surface 27 of the pin 2 defines a first recess boundary 28 of the first radial recess 13. The first anti-rotation member 12 comprises a first member contact surface 29 facing the first recess contact surface 27. The first mounting part 24 is configured to allow tangential movement in a tangential direction 15 relative to the longitudinal axis 11 of the first anti-rotation member 12 in the first radial recess 13 from a first tangential member position 31 wherein the first member contact surface 29 of the first anti-rotation member 12 is in contact with the first recess contact surface 27 into a second tangential member position 32 wherein the first member contact surface 29 of the first anti-rotation member 12 is located at a first tangential member distance 33 from the first recess contact surface 27, and vice versa. This is also shown in the FIGS. 11A-G and 12.

This has the advantage that the anti-rotation device 8 may be even less susceptible to damage. As the first mounting part 24 is configured to allow tangential movement (e.g. to allow sliding movement) of the first anti-rotation member 12 from said first tangential member position 31 to said second tangential member position 32, and said first recess contact surface 27 and said first member contact surface 29 direct forces as a result of a break-out torque 35 applied to the pin 2 and the box 5 in the break-out rotation direction 10 mainly through the teeth of the first ratchet part 16 and the second ratchet part 18, stresses in the material may be directed away from said first mounting part 24 (and a first mounting member 26, e.g. a screw, provided in said first mounting part 24) wherein there are relatively few stresses present at said first mounting part 24. As such, said first mounting part 24 may be substantially free from (shear) stresses. In particular, said anti-rotation device 8 may be configured to allow said first recess contact surface 27 and said first member contact surface 29 to abut while said teeth limit rotation of the pin 2 with respect to the box 5 in the break-out direction. As such, relatively few connection parts (e.g. said first mounting part 24) may be subjected to stresses under the influence of a break-out torque 35.

The tangential movement in tangential direction 15 does not need to be restricted to movement only in tangential direction 15 relative to the longitudinal axis 11. It may have a certain degree of movement in other directions relative to the longitudinal axis 11, for example to create a movement partly around the longitudinal axis 11.

The first recess contact surface 27 and the first member contact surface 29 are configured to distribute forces as a result of a break-out torque 35 applied to the pin 2 and the box 5 in the break-out rotation direction 10 mainly through the teeth of the first ratchet part 16 and the second ratchet part 18.

The second anti-rotation member 14 is configured to push the first anti-rotation member 12 into the second tangential member position 32 when a predetermined make-up torque 34 is applied to the pin 2 and the box 5 in the make-up rotation direction 9, and into the first tangential member position 31 when a predetermined break-out torque 35 is applied to the pin 2 and the box 5 in the break-out rotation direction 10. Second ratchet teeth 19 which engage first ratchet teeth 17 push the first anti-rotation member 12 into the second tangential member position 32 when the predetermined make-up torque 34 is applied, and into the first tangential member position 31 when the predetermined break-out torque 35 is applied.

The first recess contact surface 27 and the first member contact surface 29 are configured to create a radial counter force 36 acting against radial movement of the first ratchet part 16 in radial direction 23 relative to the longitudinal axis 11 when the first anti-rotation member 12 is located in the first tangential member position 31 and a break-out torque 35 is applied to the pin 2 and the box 5 in the break-out rotation direction 10. The radial counter force 36 is formed by a friction force between the first recess contact surface 27 and the first member contact surface 29 when the break-out torque 35 is applied to the pin 2 and the box 5 in the break-out rotation direction 10. See amongst others FIG. 12.

The first mounting through hole 25 is in tangential direction relative to the longitudinal axis 11 larger than a first mounting portion 38 of the first mounting member 26 being surrounded by the first mounting through hole 25 to allow movement of the first anti-rotation member 12 in tangential direction and relative to the first mounting member 26. The first mounting through hole 25 has an elongate form 39 in tangential direction relative to the longitudinal axis 11. In another embodiment of the threaded connection 1 according to the invention the first mounting through hole 25 has a circular form.

The first recess contact surface 27 and the first member contact surface 29 are configured to block tangential movement of the first anti-rotation member 12 beyond the first tangential member position 31 when a break-out torque 35 is applied to the pin 2 and the box 5 in the break-out rotation.

The first mounting through hole 25 is dimensioned to avoid forces in tangential direction working on the first mounting member 26 by the first anti-rotation member 12 being located in the first tangential member position 31 when a break-out torque 35 is applied to the pin 2 and the box 5 in the break-out rotation. This is amongst others shown in FIG. 12.

The first tangential member distance 33 allows radial movement of the first ratchet part 16 in radial direction 23 relative to the longitudinal axis 11 when first ratchet teeth 17 slide along second ratchet teeth 19 during relative rotation between the pin 2 and the box 5 in the make-up rotation direction 9.

The first mounting part 24 comprises a first mounting slide surface 40 surrounding the first mounting through hole 25 and being in contact with a corresponding first recess slide surface 41 provided at the first radial recess 13 to facilitate the tangential movement of the first anti-rotation member 12 from the first tangential member position 31 into the second tangential member position, and vice versa. In particular, the first recess slide surface 41 is larger, in tangential direction 15, than the first mounting slide surface 40.

The spring part 21 of the first anti-rotation member 12 is in tangential direction relative to the longitudinal axis 11 located between the first ratchet part 16 and the first mounting part 24. The first member contact surface 29 of the first anti-rotation member 12 is located at the first ratchet part 16 and the first ratchet teeth 17 are in tangential direction relative to the longitudinal axis 11 located between the first member contact surface 29 and the spring part 21.

A radial first ratchet thickness 42 of the first ratchet part 16 increases in tangential direction relative to the longitudinal axis 11 from the spring part 21 to the first member contact surface 29. This way, the first member contact surface 29 is increased to reduce the pressure (and therefore reduce the stresses) at the first member contact surface 29.

The first anti-rotation member 12 is only mounted to said one of the pin 2 and the box 5 in which the first radial recess 13 is provided via the first mounting part 24. The first anti-rotation member 12 comprises one, and only one, first mounting part 24. The first anti-rotation member 12 comprises one, and only one, spring part 21.

As shown in FIG. 6C, the first ratchet teeth 17 of the first anti-rotation member 12 extend in radial direction 23 beyond the pin outer surface 3.

The FIGS. 4A-4E show the second anti-rotation member 14 of the anti-rotation device 8 of the threaded connection 1 of FIG. 1. The FIGS. 7, 8, and 9A-9C shows of the second anti-rotation member 14 and the second radial recess 43 provided in the box 5 of the threaded connection 1 of FIG. 1. The second anti-rotation member 14 is releasably mounted in the second radial recess 43 being provided in the inner box surface 6 of the box 5. In another embodiment of the threaded connection 1 according to the invention, the second anti-rotation member 14 is releasably mounted in the second radial recess 43 being provided in the outer pin surface 3 of the pin 2.

The second radial recess 43 extends along part of a box 5 circumference 48 of the inner box surface 6 of the box 5.

The second ratchet part 18 of the second anti-rotation member 14 is fixed in radial direction 23 relative to the longitudinal axis 11. The second ratchet part 18 of the second anti-rotation member 14 may have some flexibility in radial direction 23 relative to the longitudinal axis 11, but should be more rigid than the first ratchet part 16. In another embodiment of the threaded connection 1 according to the invention, the second ratchet part 18 of the second anti-rotation member 14 may be more flexible in radial direction 23 relative to the longitudinal axis 11 and as rigid as (or even less rigid than) the first ratchet part 16.

The second radial recess 43 comprises a second recess through hole 46 in which the second ratchet part 18 of the second anti-rotation member 14 is located. The second anti-rotation member 14 comprises two second mounting parts 44 to releasably mount the second anti-rotation member 14 to the box 5. The two second mounting parts 44 are located at opposite sides of the second radial recess 43. The box 5 comprises an outer box surface 45 and the two second mounting parts 44 are releasably mounted to the box 5 at the outer box surface 45. In another embodiment of the threaded connection 1 according to the invention, the second anti-rotation member 14 comprises one, and only one, second mounting part 44 to releasably mount the second anti-rotation member 14 to the box 5.

Figure 10:
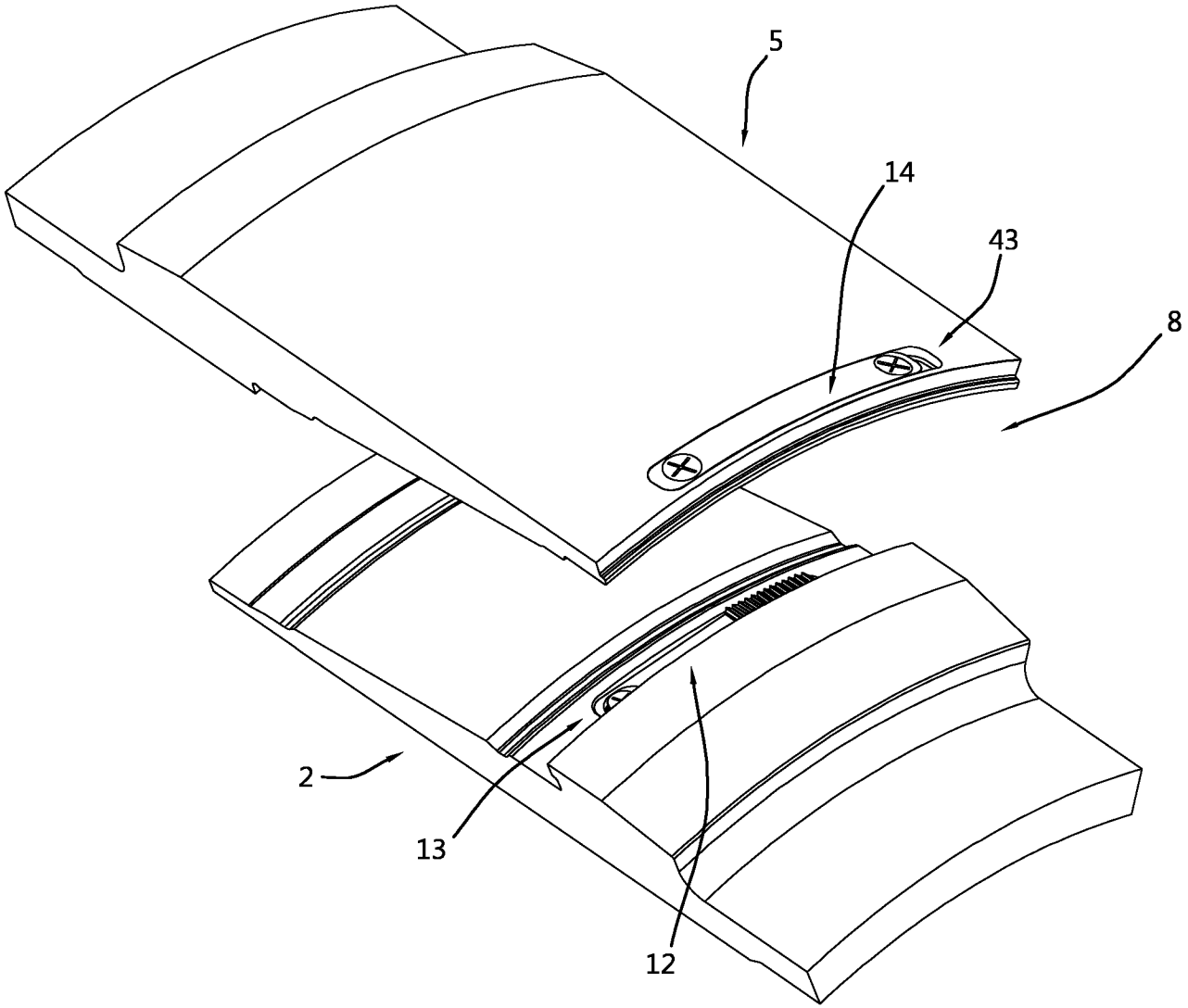
Figure 11A:
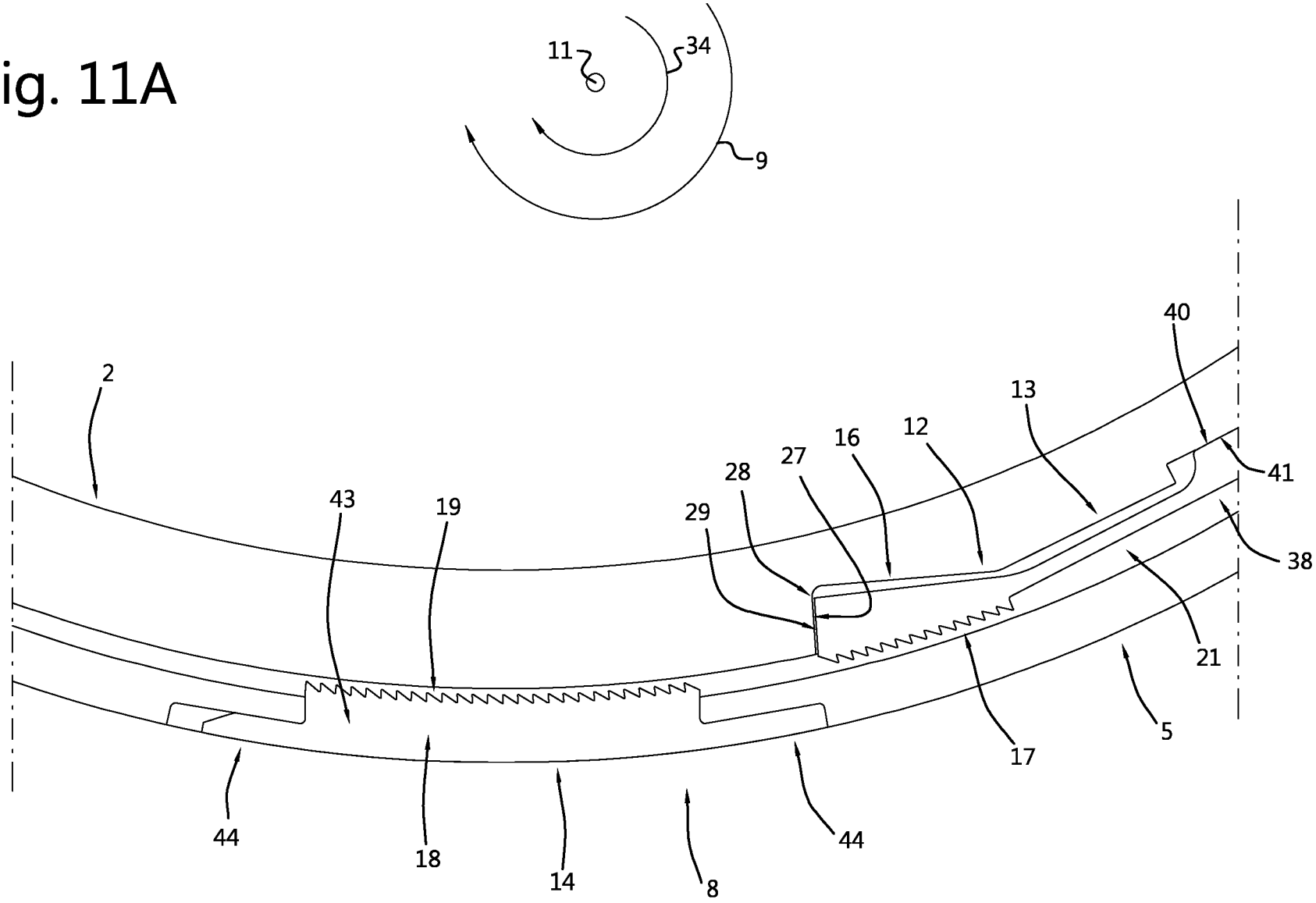
Figure 11B:
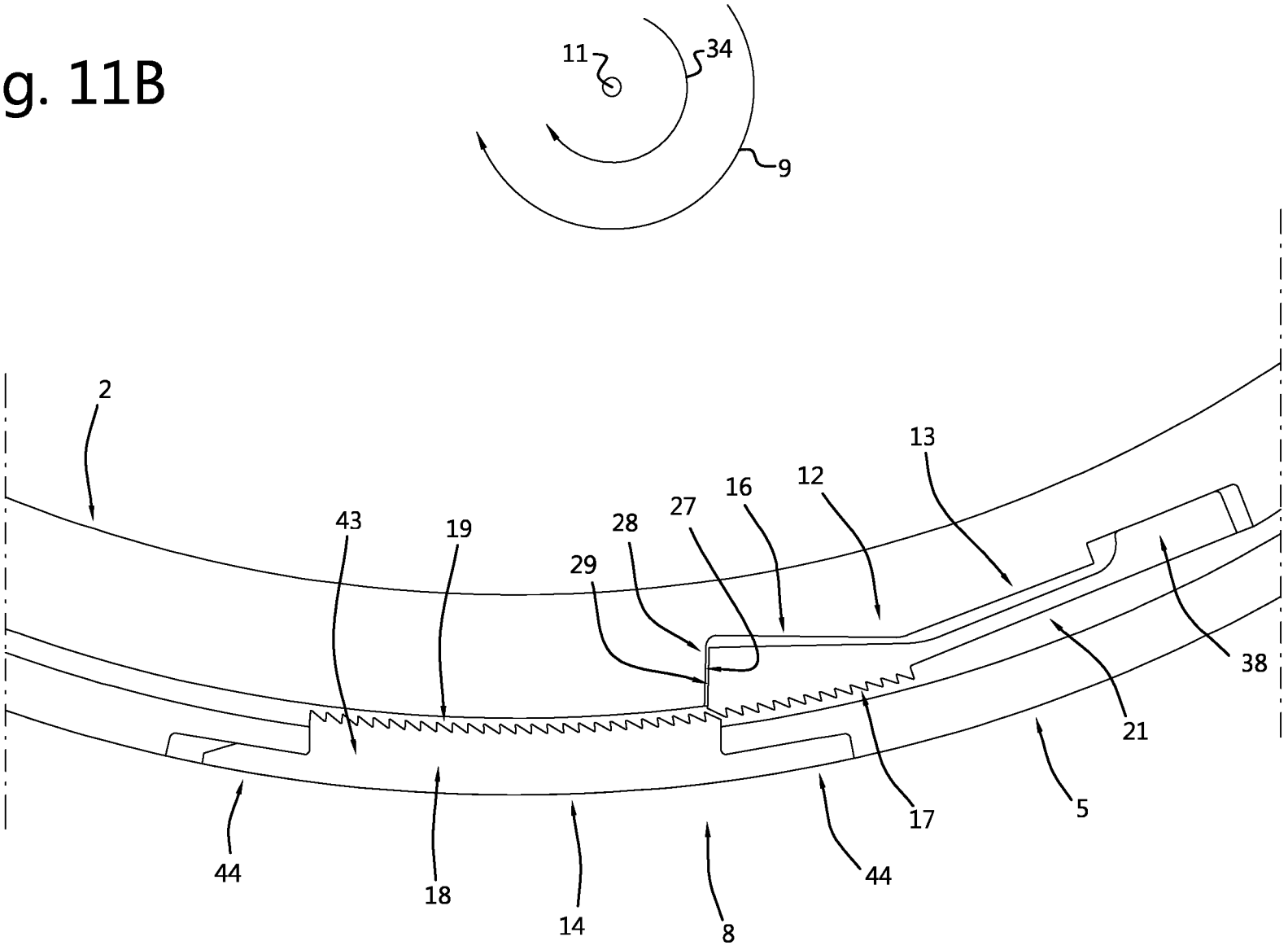
Figure 11C:
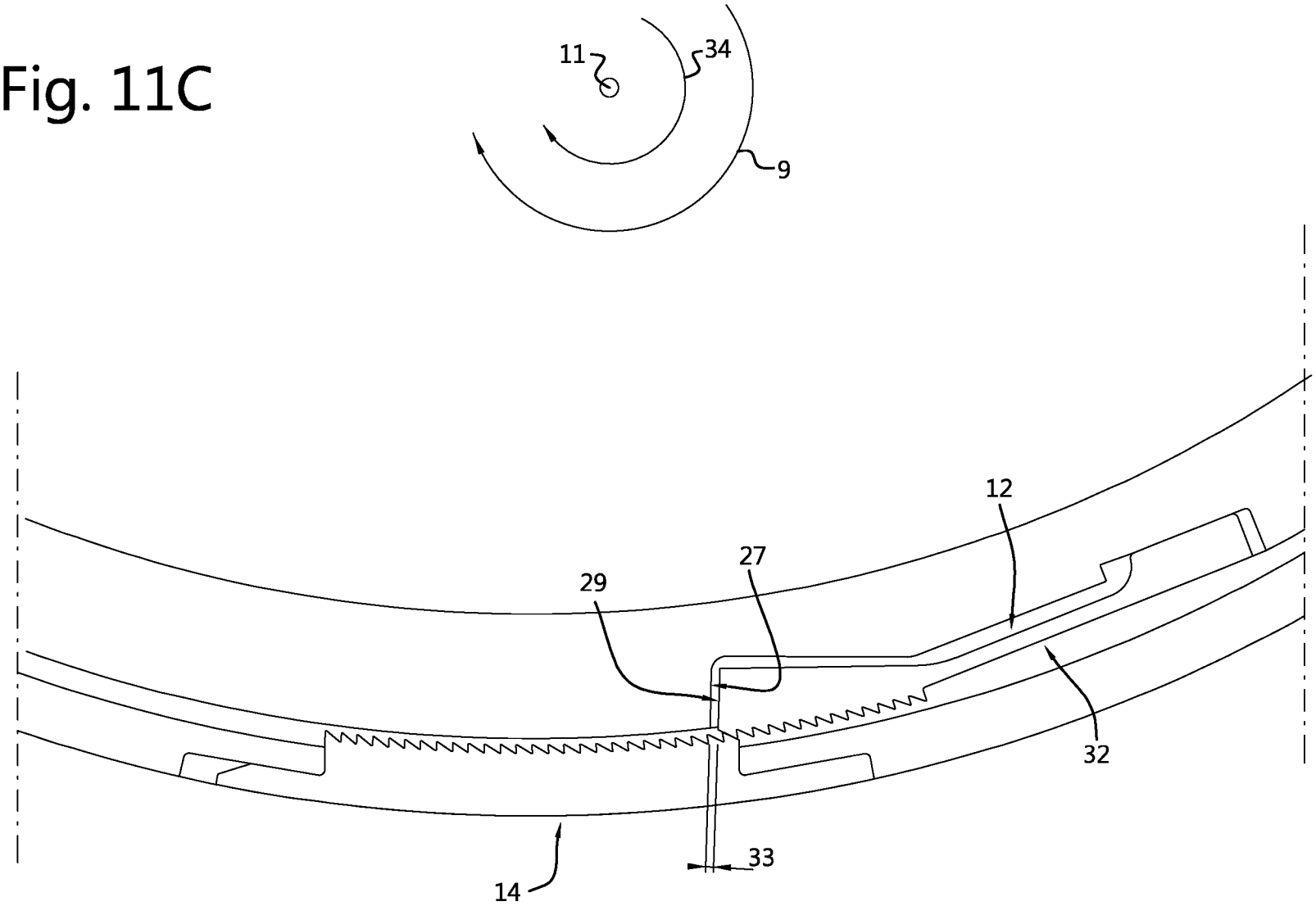
Figure 11D:
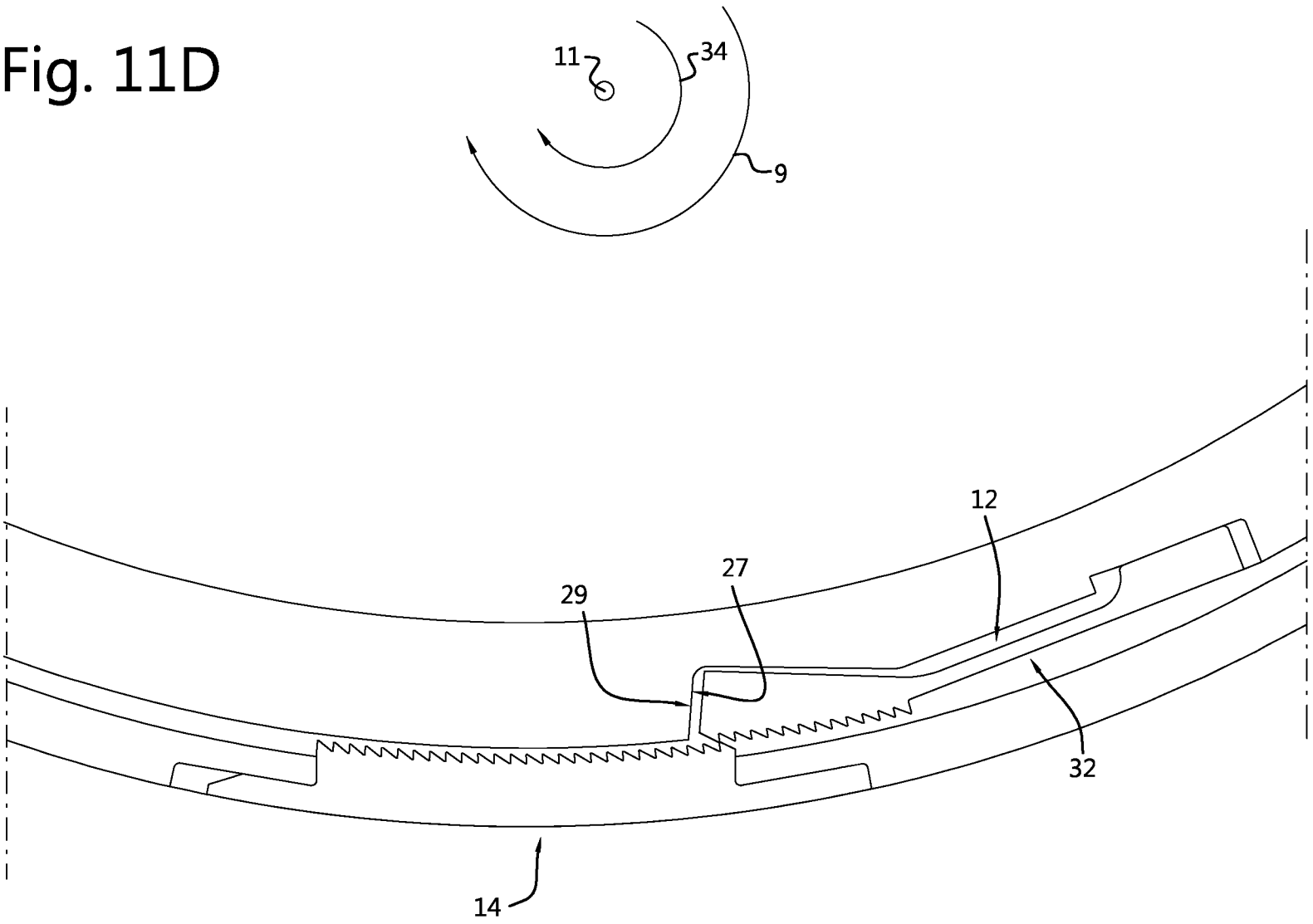
Figure 11E:
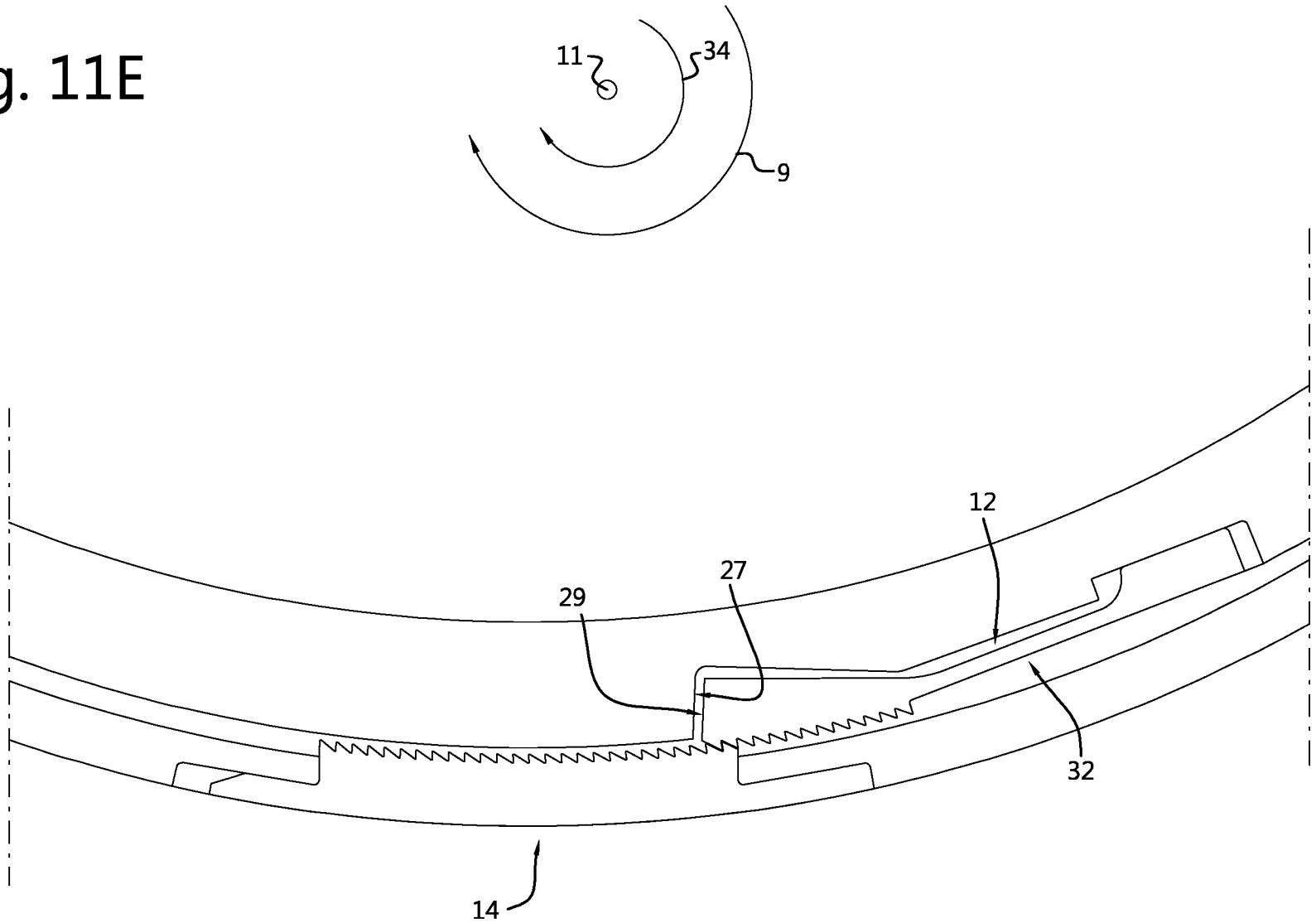
Figure 11F:
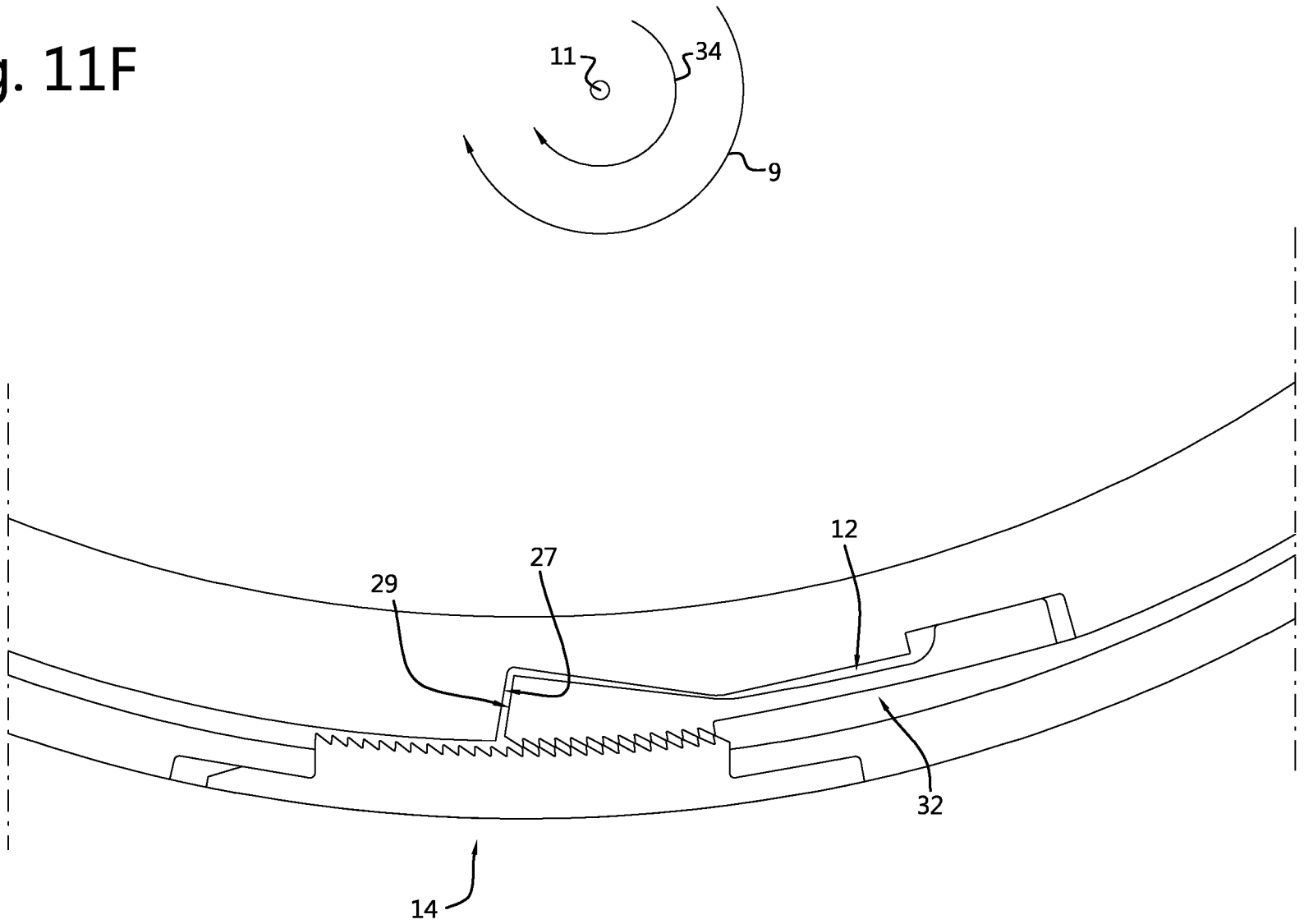
Figure 11G:
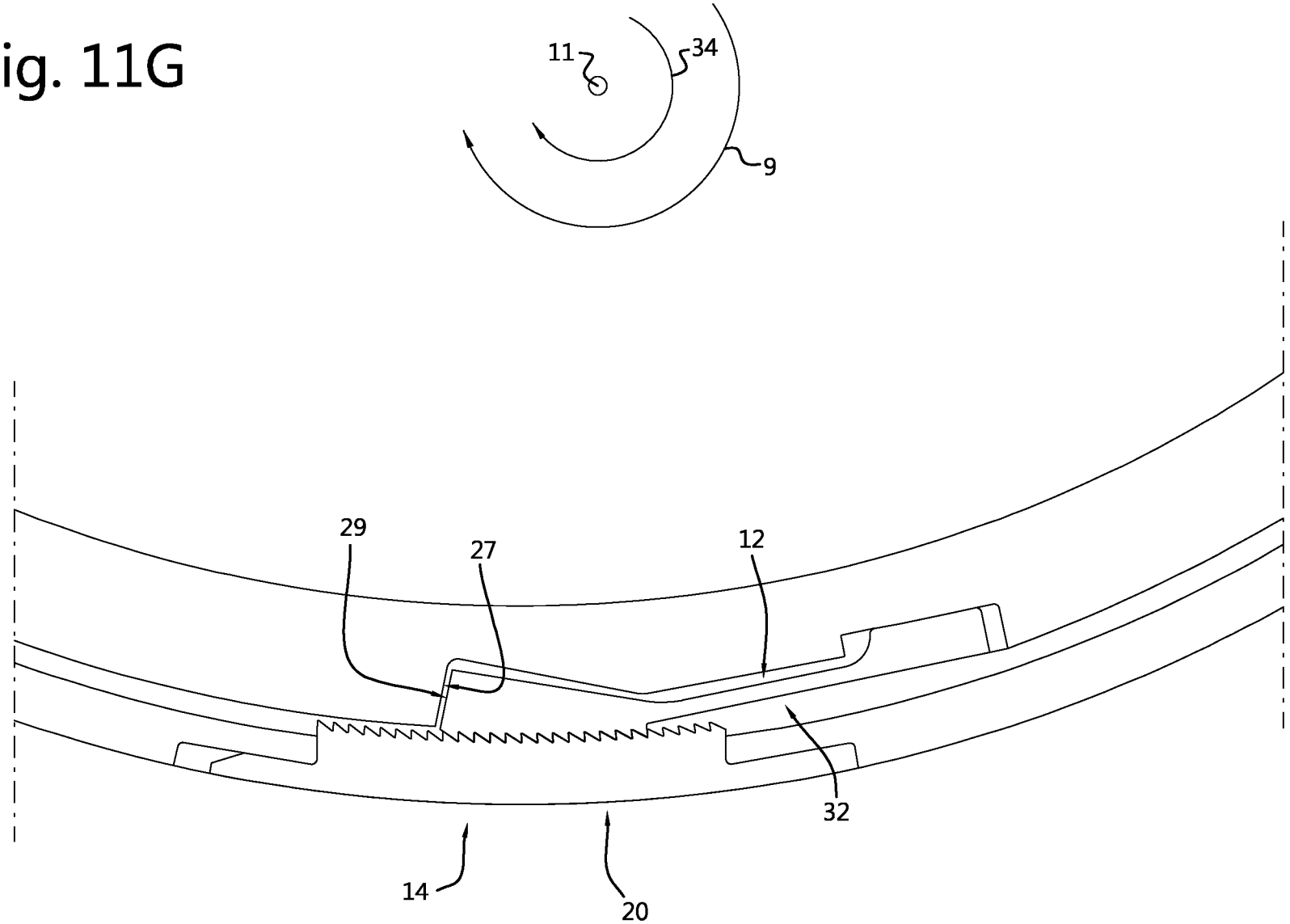

FIG. 10 shows a view in perspective of the first anti-rotation member 12 arranged in the first radial recess 13 provided in the pin 2 and the second anti-rotation member 14 arranged in the second radial recess 43 provided in the box 5 of the threaded connection 1 of FIG. 1.

This has the advantage that a relatively robust threaded connection 1 may be provided while the outer diameter thereof is kept relatively small. Said outer diameter of said threaded connection 1 may be defined by the outer dimensions of said box 5 in radial direction 23 with respect to said longitudinal axis 11 of said box 5. The first anti-rotation member 12 generally requires more space than the second anti-rotation member 14, in particular when said anti-rotation member is movable in tangential direction. By providing said first anti-rotation member 12 in said pin 2 and said second anti-rotation member 14 in said box 5, a relatively robust anti-rotation device 8 may be formed that is suitable to withstand operational torques while still maintaining a relatively small outer diameter. In addition, the insight was obtained that with said first anti-rotation member 12 being accommodated in said pin 2, the movable components (e.g. said spring part 21) are generally less exposed to environmental influences (e.g. to the dirty environment at a bore well).

In another embodiment of the threaded connection 1 according to the invention, the first anti-rotation member 12 arranged in the first radial recess 13 provided in the box 5 and the second anti-rotation member 14 arranged in the second radial recess 43 provided in the pin 2.

Figure 9A:
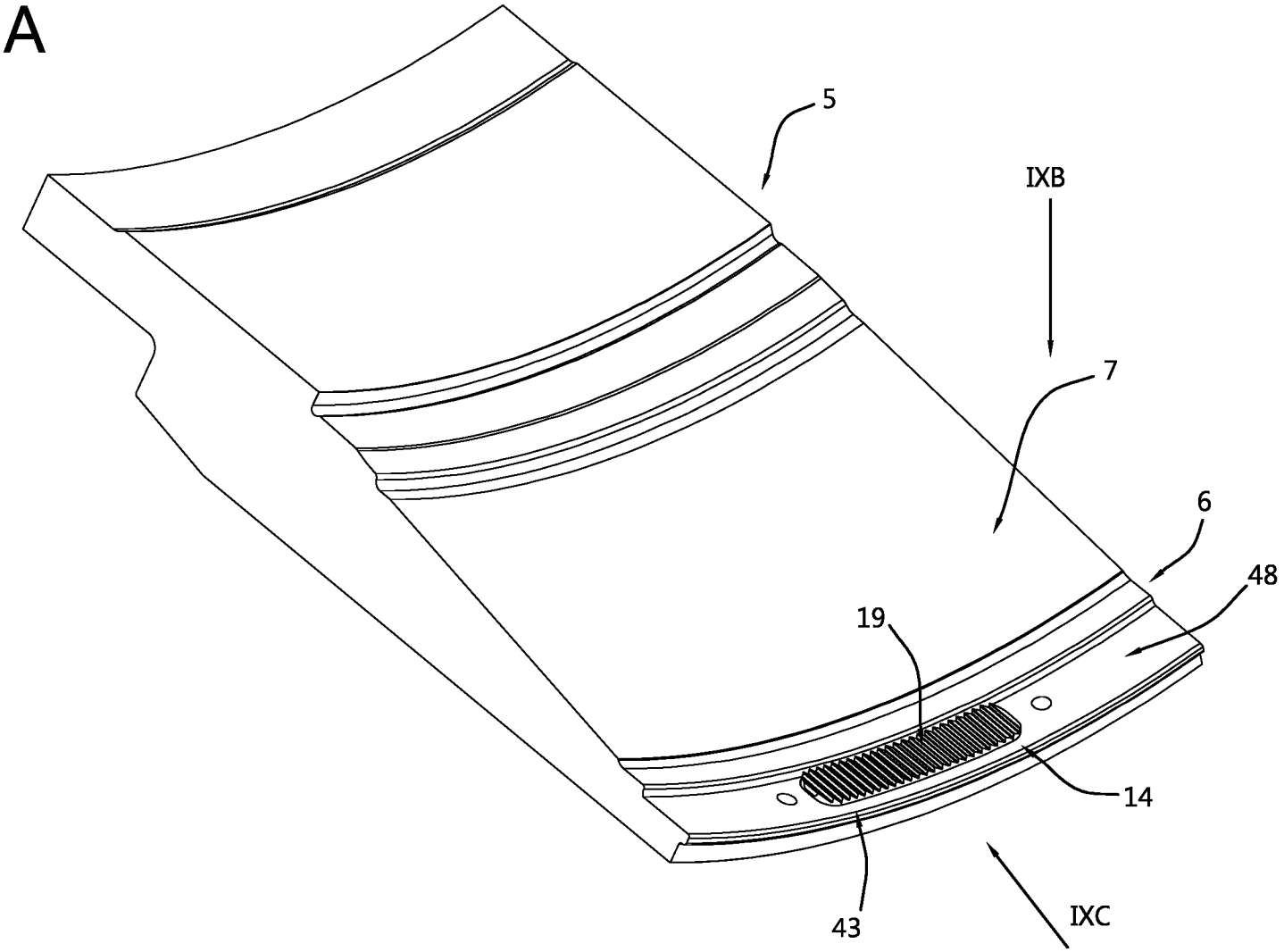
Figure 9B:
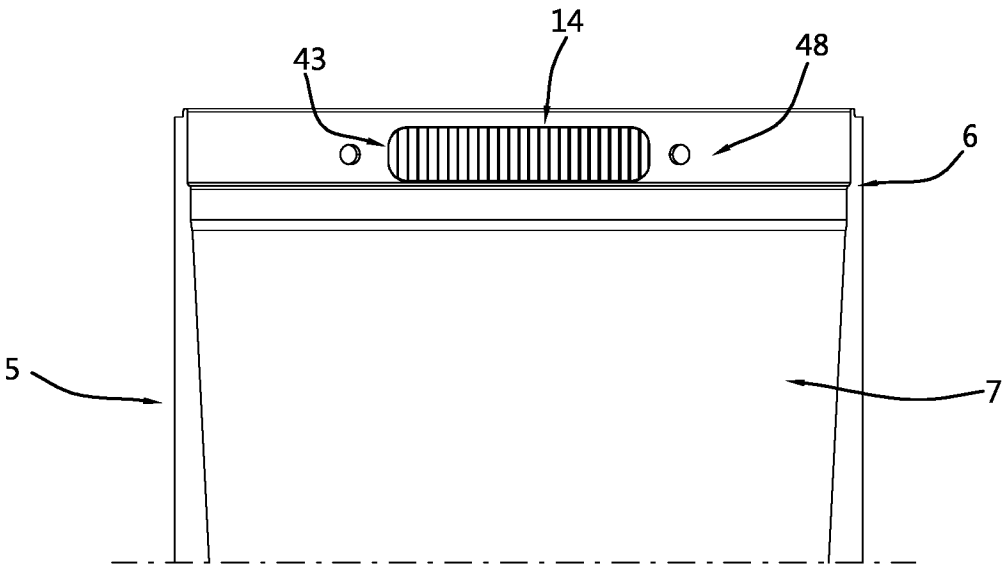
Figure 9C:
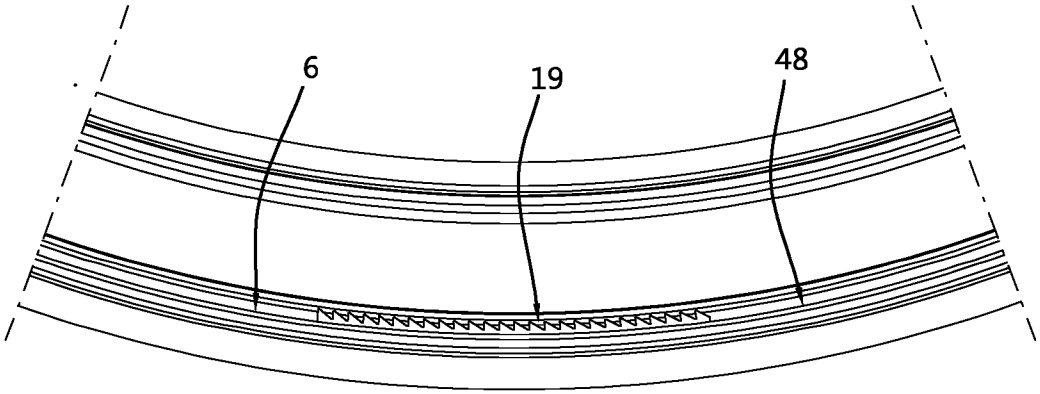

As shown in FIG. 9C, the second ratchet teeth 17 of the second anti-rotation member 14 extend in radial direction 23 beyond the box inner surface 6.

The FIGS. 11A-11G show the method of making up the threaded connection 1 of FIG. 1. Said method comprises the step of activating the anti-rotation device 8 of the threaded connection 1 by relative rotation between the pin 2 and the box 5 in the make-up rotation direction 9 until final make-up 20 of the threaded connection 1 is reached.

The first recess contact surface 27 and the first member contact surface 29 are configured to direct forces from the first ratchet teeth 17 of the first ratchet part 16 towards the second ratchet teeth 19 of the second ratchet part 18 and/or from the second ratchet teeth 19 of the second ratchet part 18 towards the first ratchet teeth 17 of the first ratchet part 16. Said recess contact surface is faced towards the first ratchet part and the second ratchet part.

FIG. 12 shows a finite element analysis of the situation that the anti-rotation device 8 of the threaded connection 1 of FIG. 1 has been activated and a break-out torque 35 is applied to the pin 2 and the box 5 in the break-out rotation direction 10. FIG. 12 indicates amongst others that the forces are distributed homogeneously through the first anti-rotation member 12, due to which a relatively robust anti-rotation device 8 is provided.

In particular, forces as a result of break-out torque 35 are mainly directed via the first recess contact surface 27 of the pin 2, the first member contact surface 29 of the first ratchet part 16, the first ratchet teeth 17 of the first ratchet part 16, the second ratchet teeth 19 of the second ratchet part 18, the second anti-rotation member 14, and second member support surfaces 22 of the box 5.

An alternative embodiment of the threaded connection according to the invention is shown in the FIGS. 13-18. In said alternative embodiment, the first anti-rotation member 12 is arranged in the first radial recess 13 being provided in the inner box surface 6 of the box 5, and the second anti-rotation member 14 is provided at the outer pin surface 3 of the pin 2.

Figure 14A:
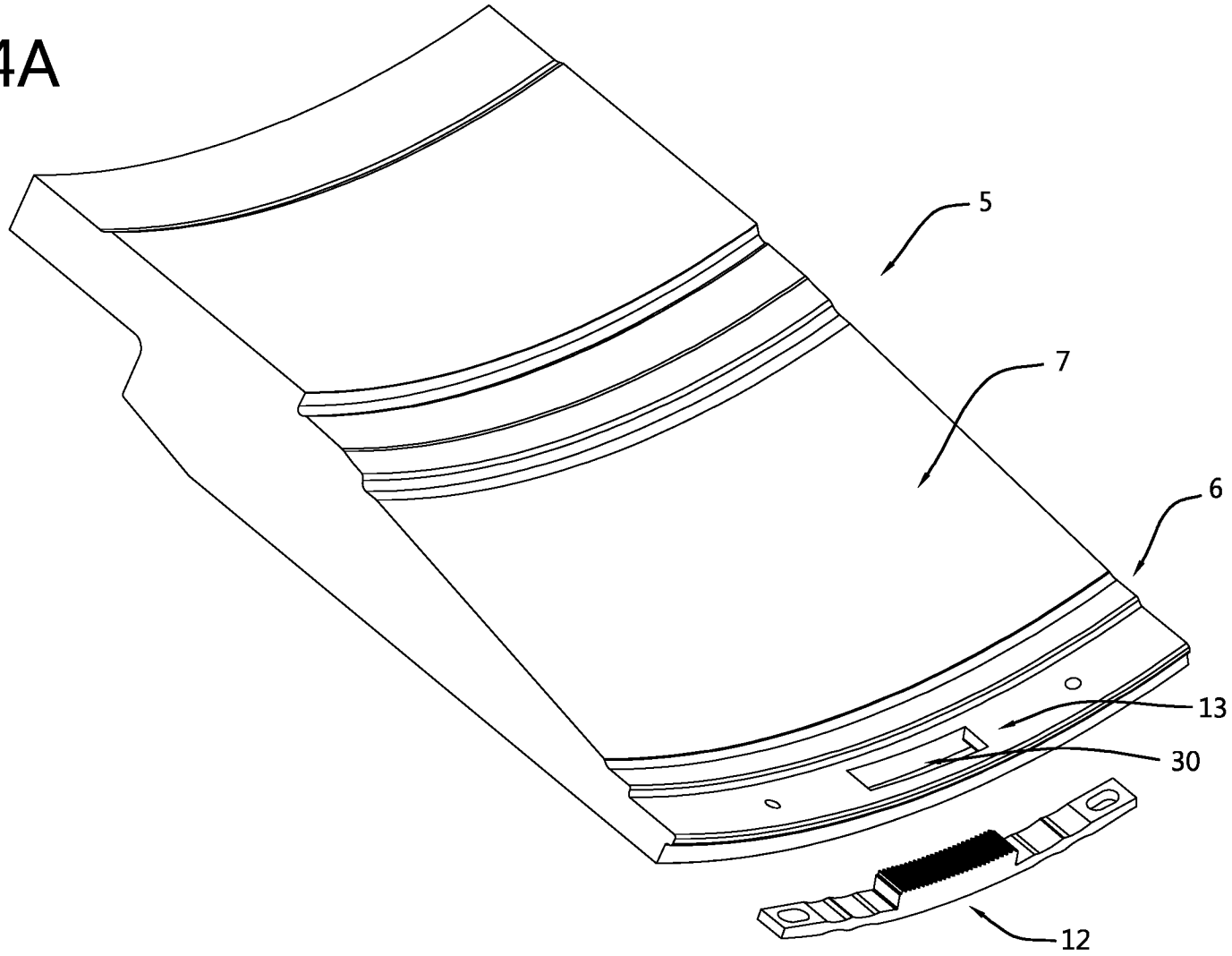
Figure 14B:
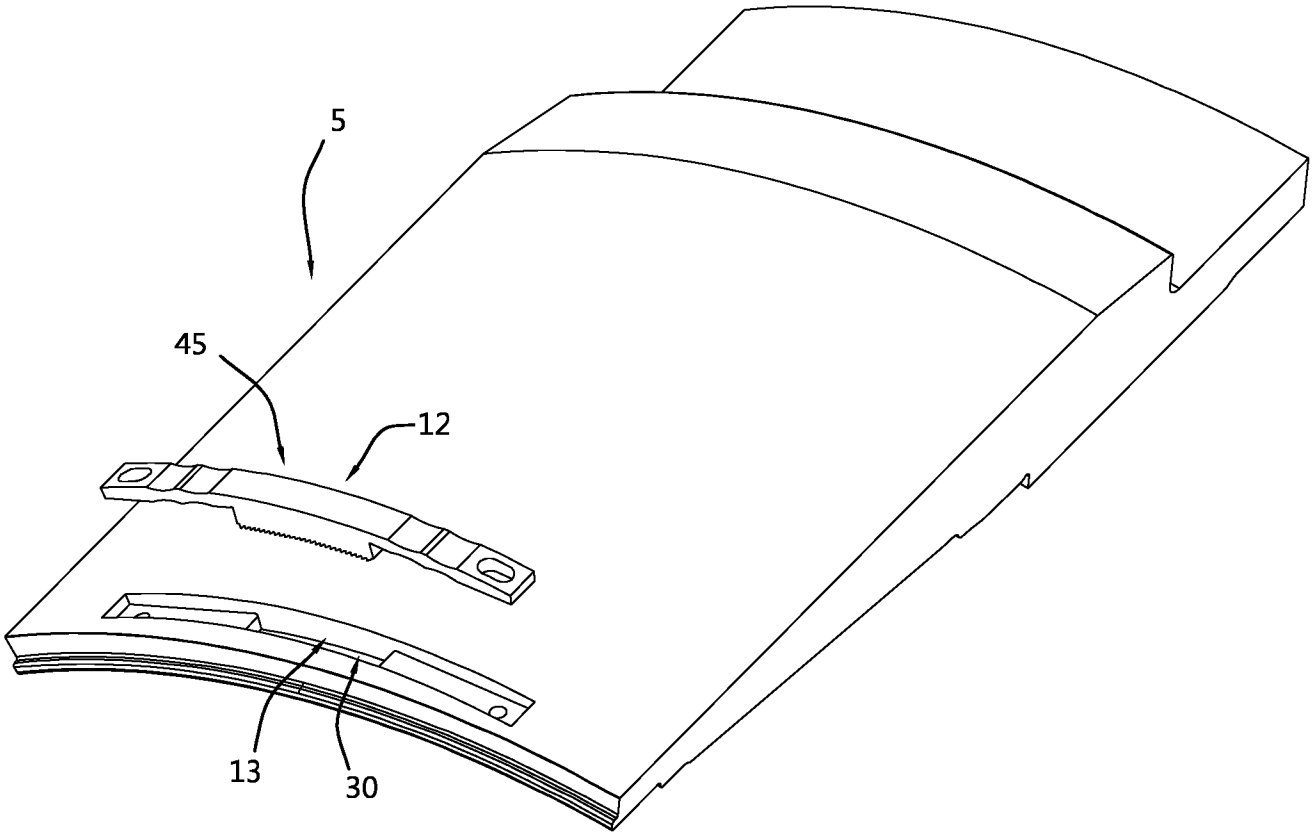
Figure 15A:
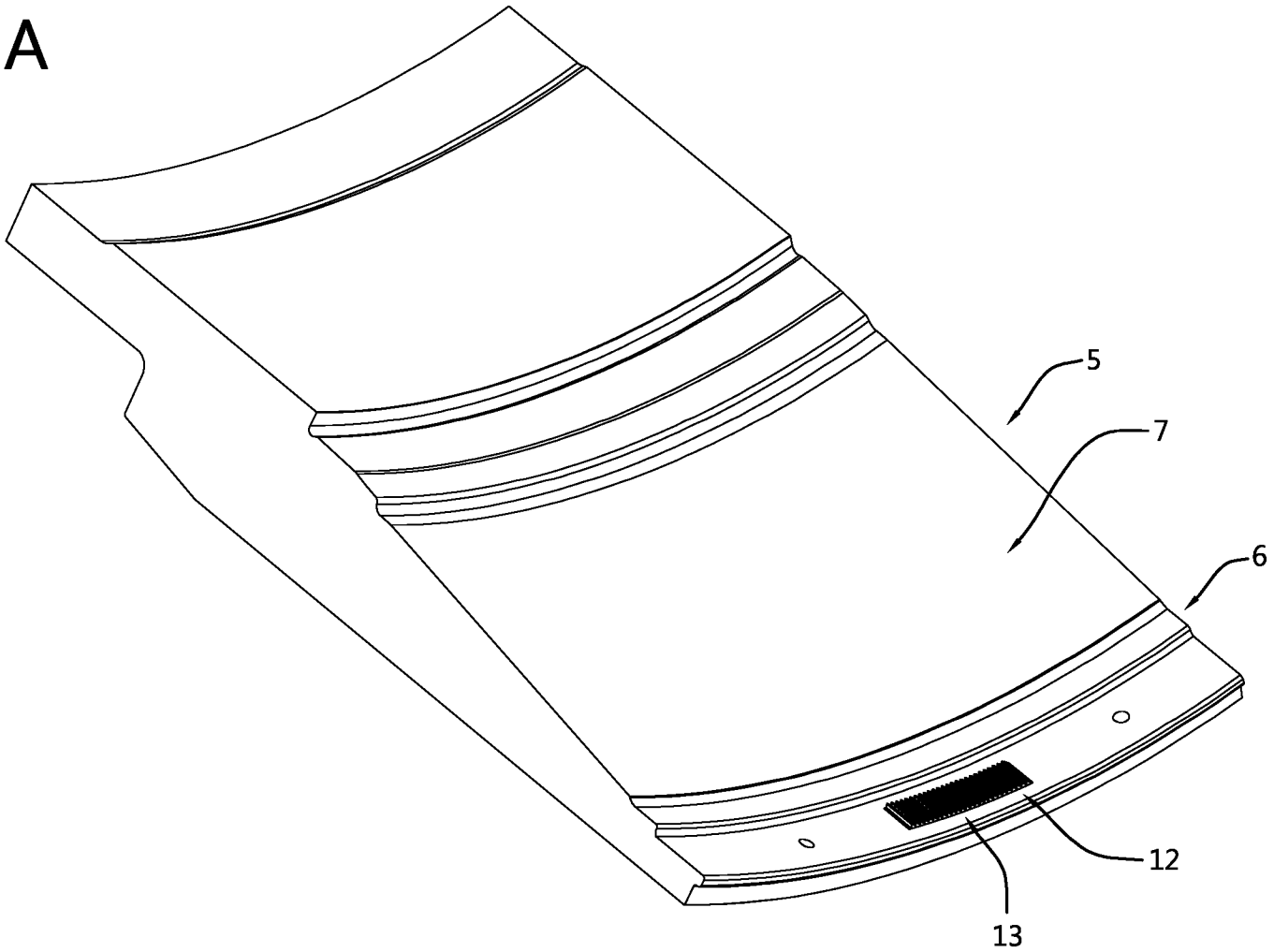
Figure 15B:
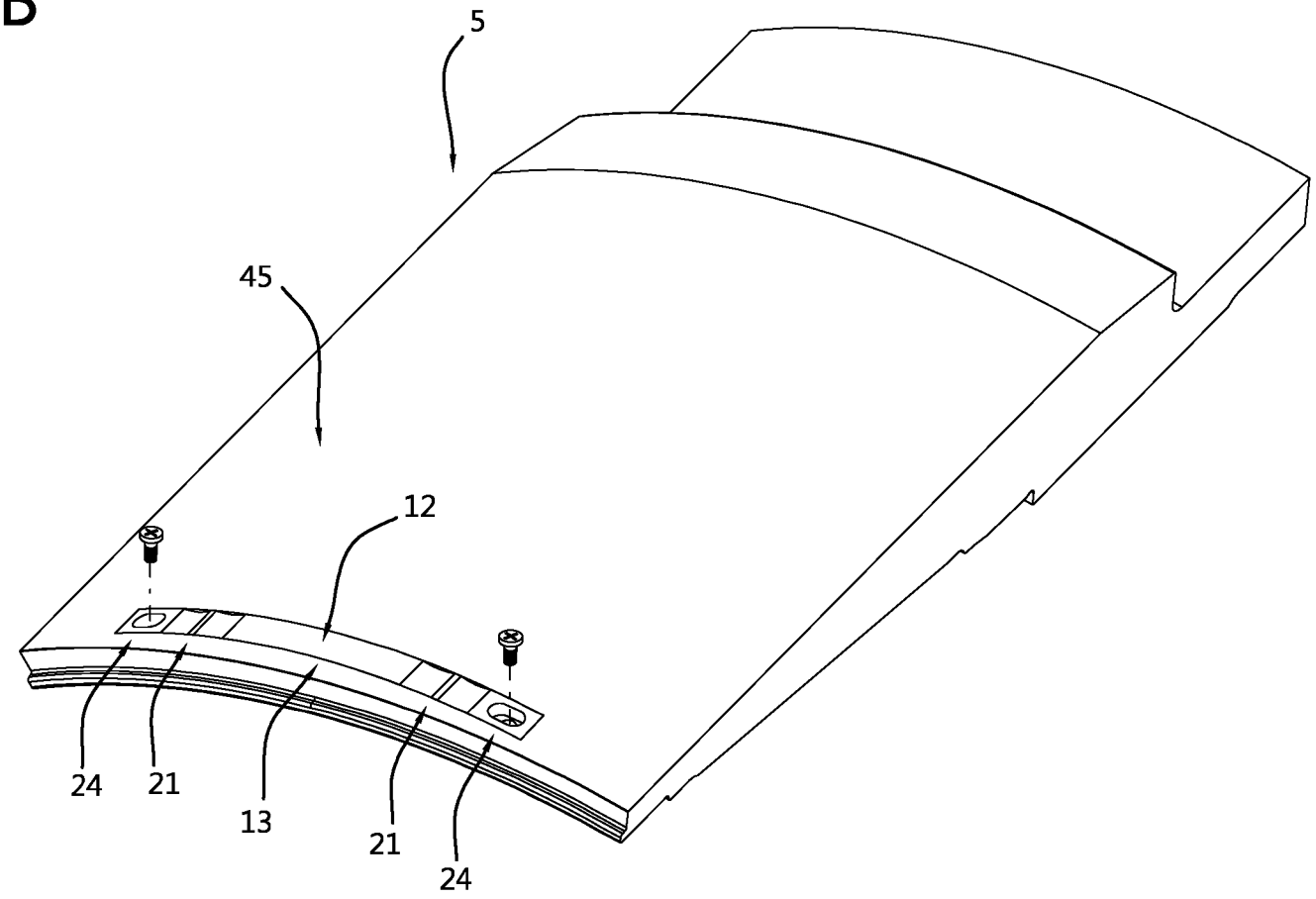

The FIGS. 13A-D show the first anti-rotation member 12 having two spring parts 21 located at opposite sides of the first ratchet part 16. The FIGS. 14A-B show the first radial recess 13 provided in the box 5. The FIGS. 15A-B shown the first anti-rotation member 13 being arranged in the first radial recess 13.

The first radial recess 13 comprises a first recess through hole 30 in which the first ratchet part 16 of the first anti-rotation member 12 is located. The first anti-rotation member 12 comprises two first mounting parts 24 to releasably mount the first anti-rotation member 12 to the box 5. The two first mounting parts 24 are releasably mounted to the box 5 at the outer box surface 45. The two first mounting parts 24 are located at opposite sides of the first radial recess 13.

The first anti-rotation member 12 comprises two spring parts 21 which together allows radial movement of the first ratchet part 16 in radial direction 23 relative to the longitudinal axis 11 when first ratchet teeth 17 slide along second ratchet teeth 19 during relative rotation between the pin 2 and the box 5 in the make-up rotation direction 9. Each spring part 21 is located between the first ratchet part 16 and a different one of the two first mounting parts 24. The spring parts 21 have a varying radial spring thickness 51. In particular, each of the spring parts 21 has two radially narrowed sections.

The first ratchet part 16, the two spring parts 21 and the two first mounting parts 24 of the first anti-rotation member 12 are integrally formed.

Figure 16:
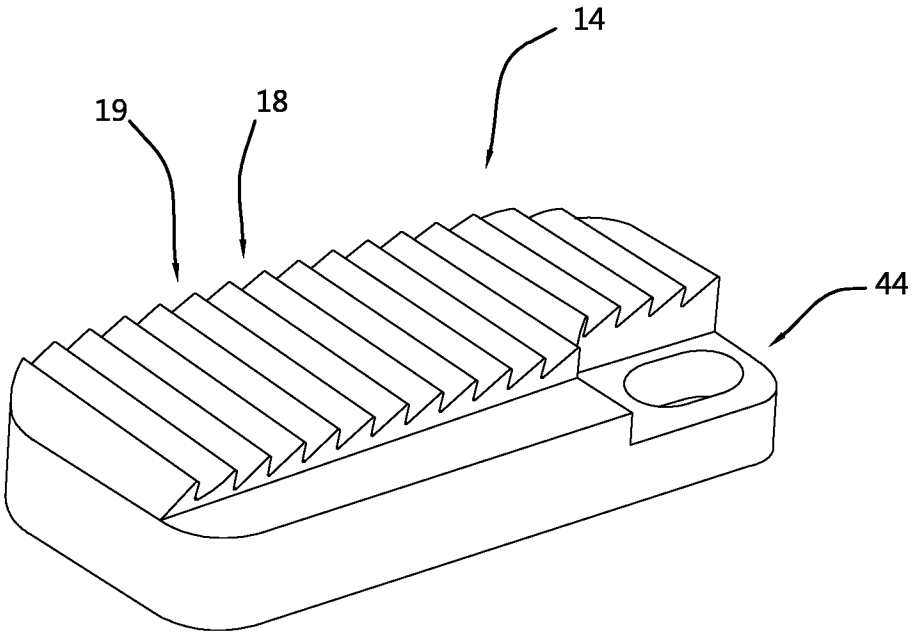
Figure 17:
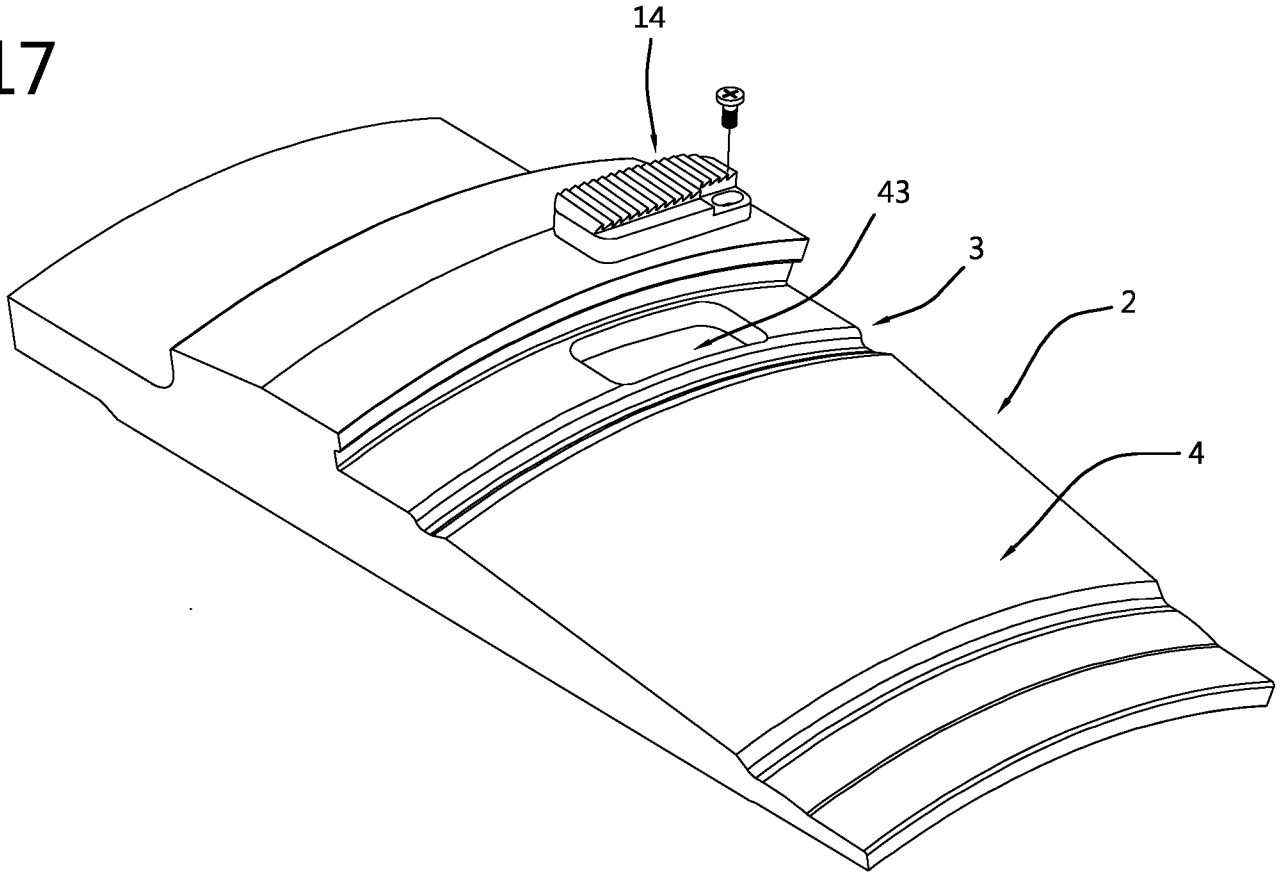
Figure 18:
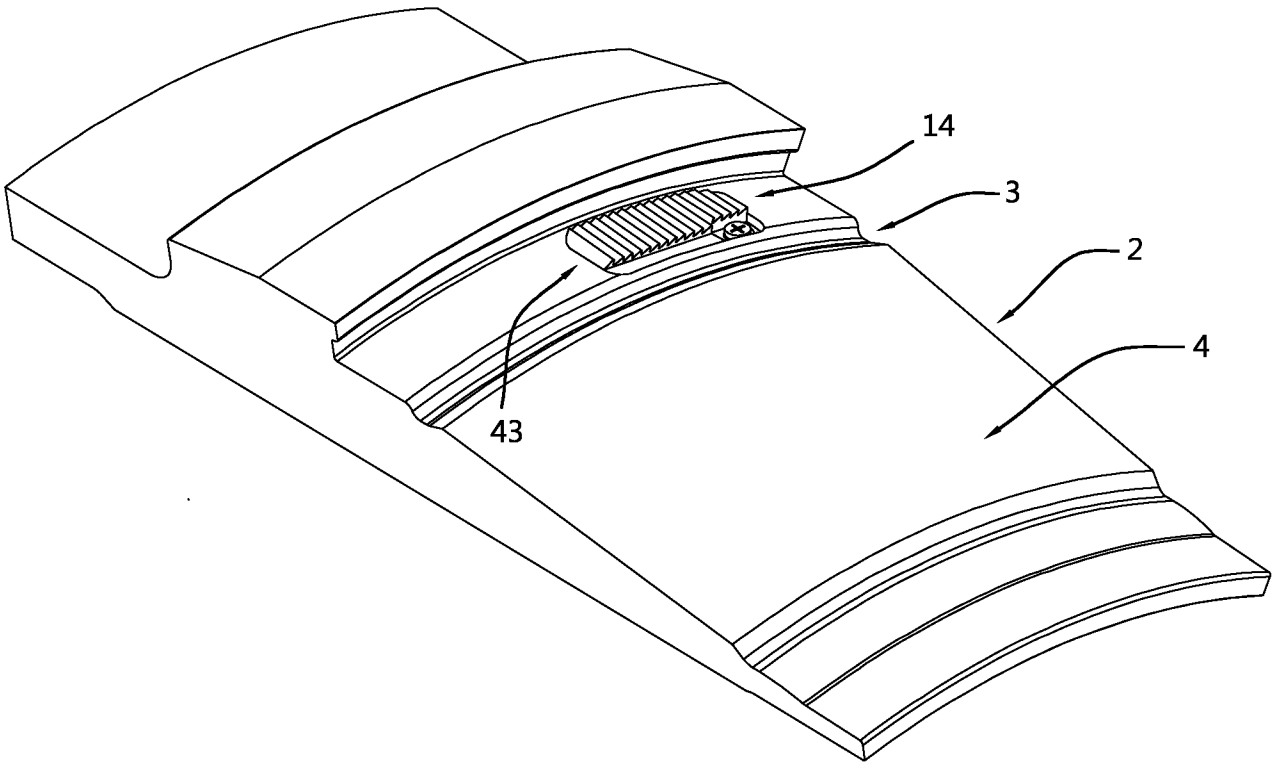

FIG. 16 shows the second anti-rotation member 14 and FIG. 17 shows the second radial recess 43 provided in the pin 2. FIG. 18 shows the second anti-rotation member 14 being arranged in the second radial recess 43. The second anti-rotation member 14 is releasably mounted in a second radial recess 43 being provided in the outer pin surface 3 of the pin 2.

Figure 19:
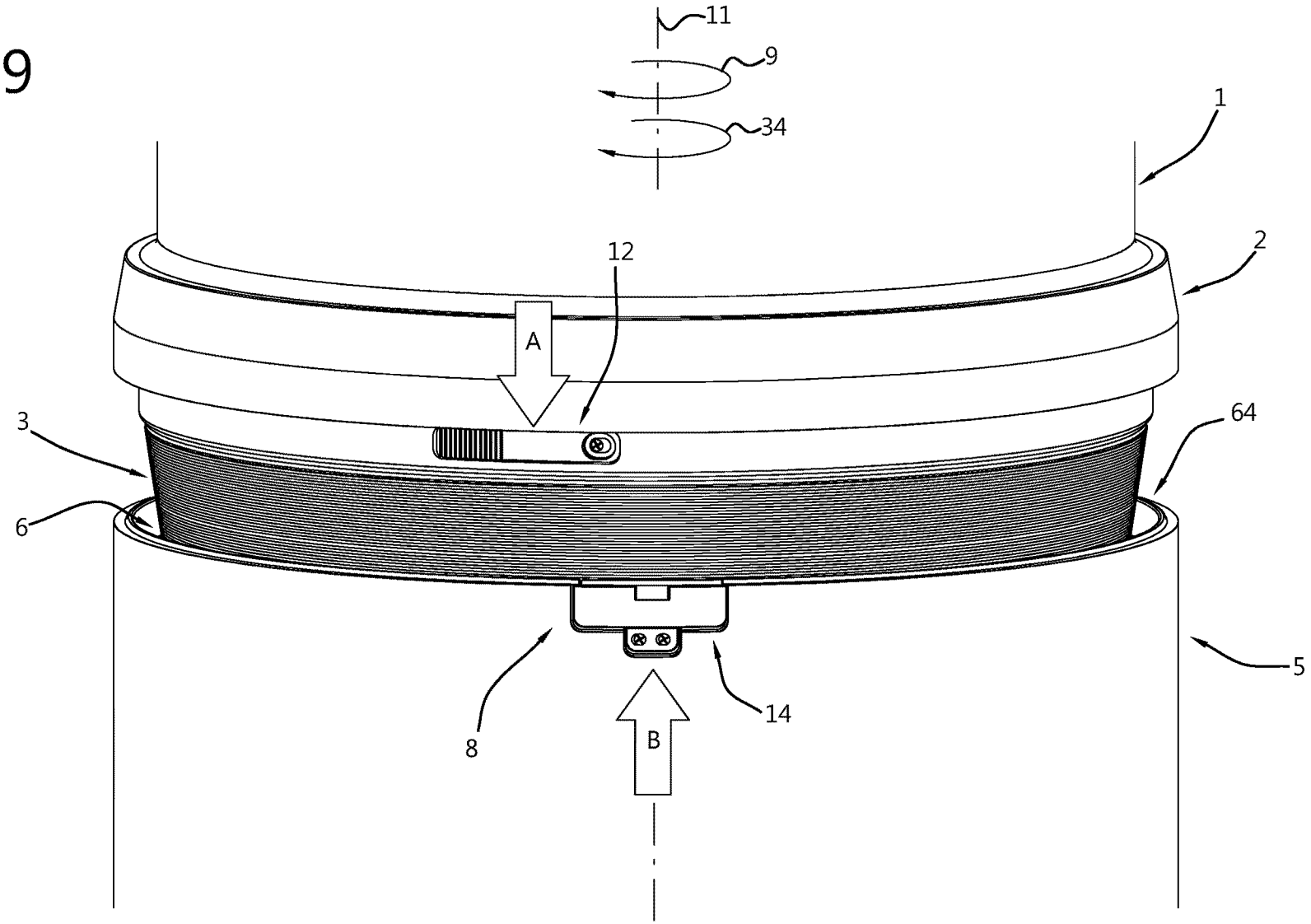
Figure 20:
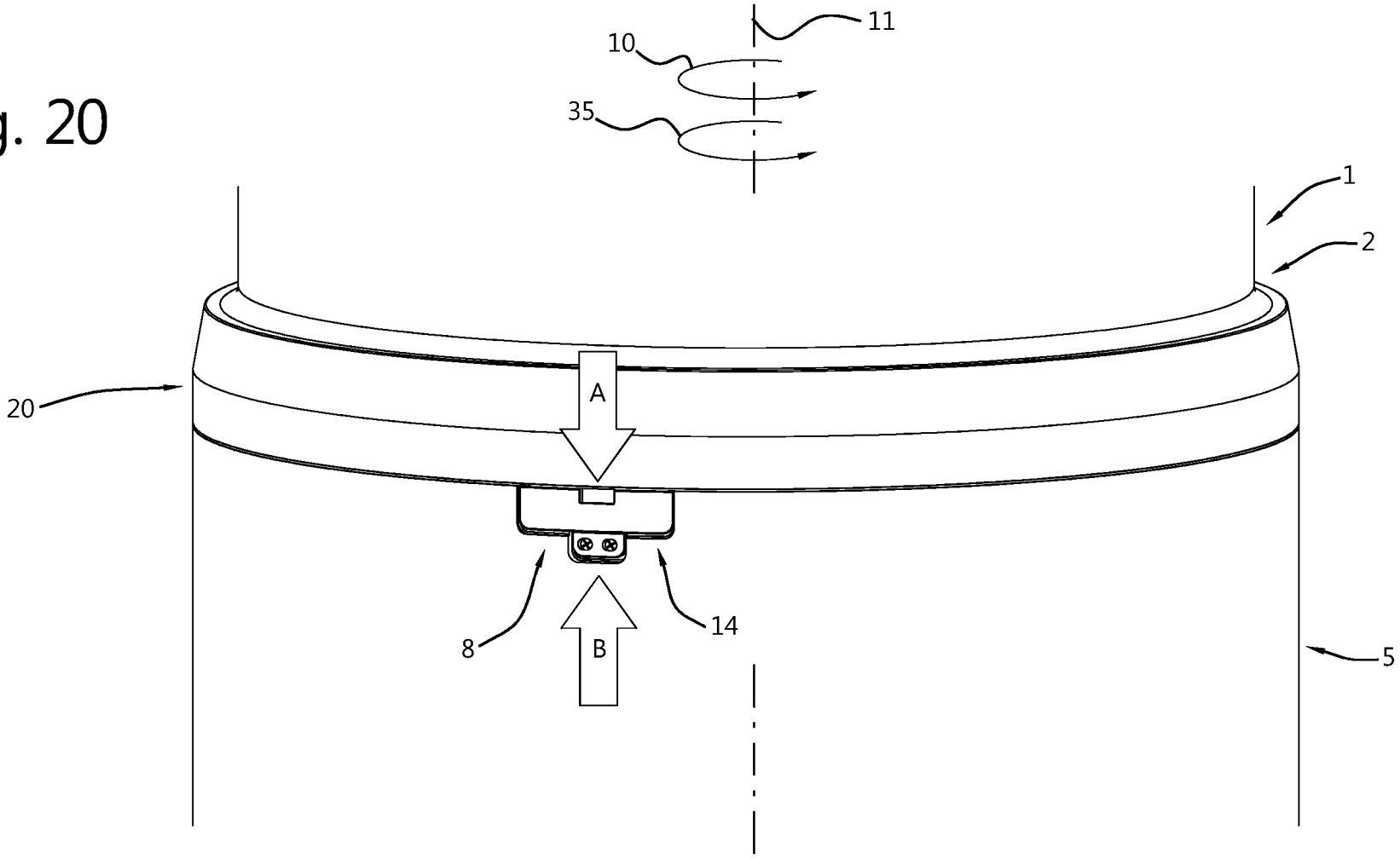
Figure 21A:
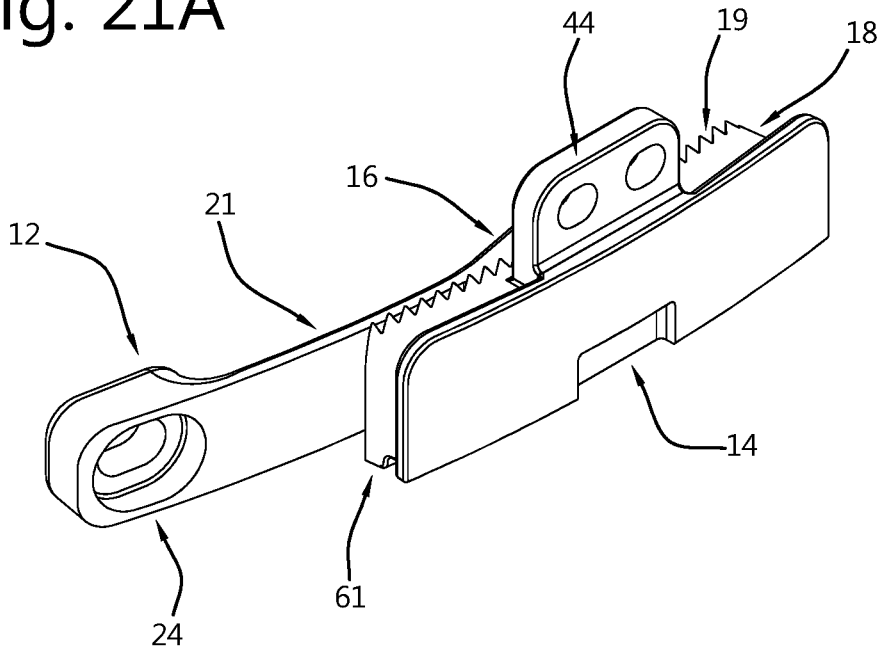
Figure 21B:
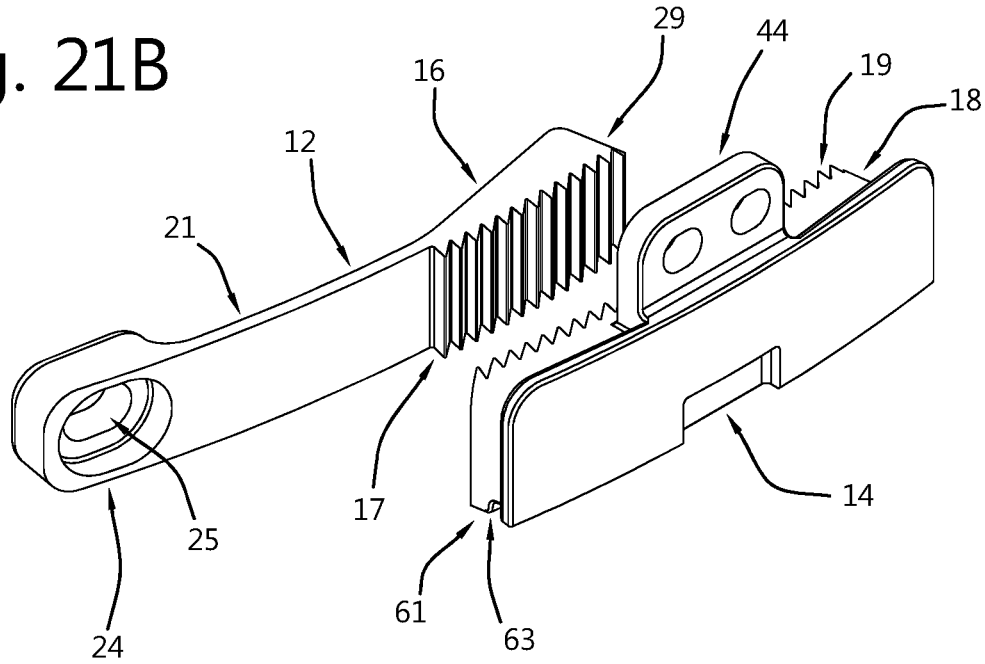
Figure 22A:
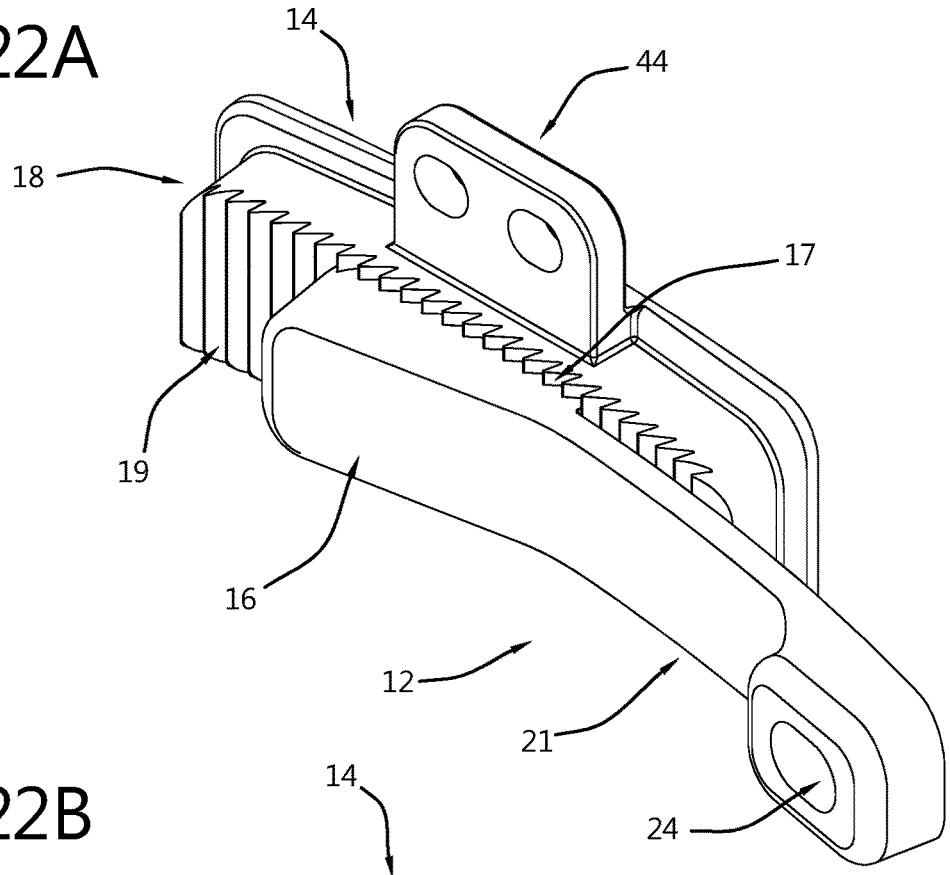
Figure 22B:
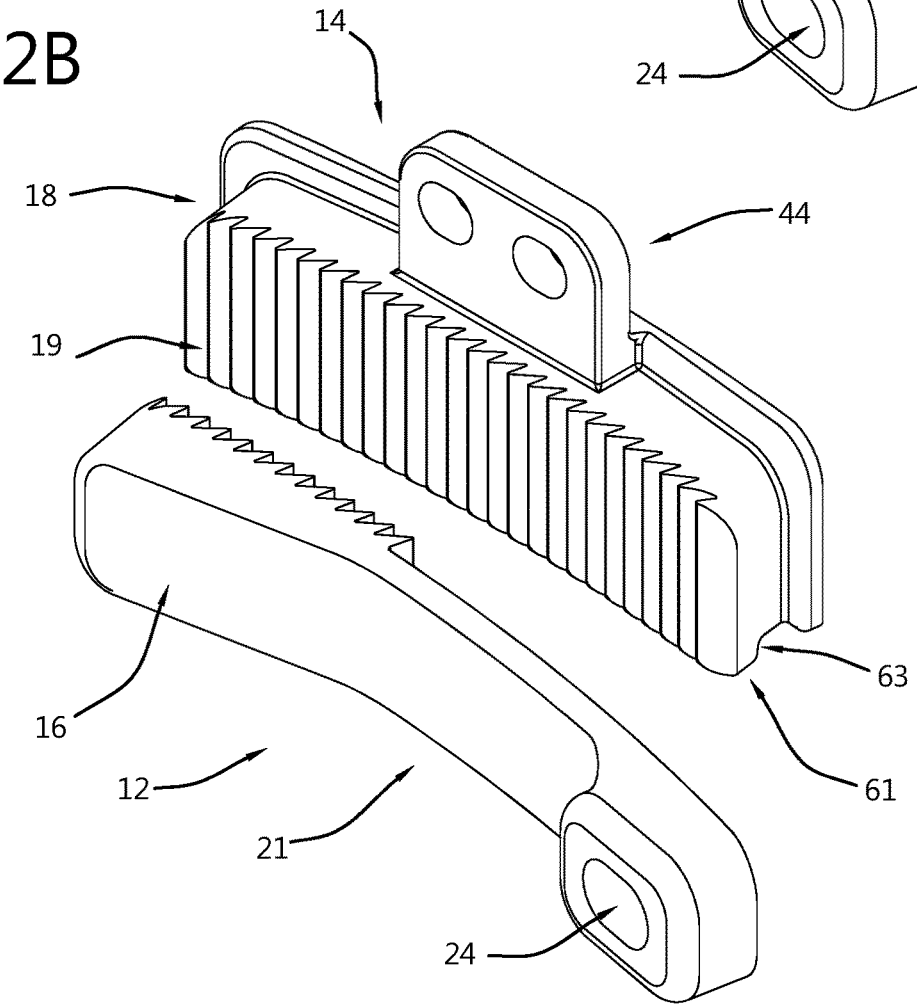

FIG. 19 shows a further embodiment of the threaded connection 1 according to the invention at the start of rotational make-up of the threaded connection 1. FIG. 20 shows the threaded connection 1 of FIG. 19 at final make-up 20 of the threaded connection 1.

The pin 2 and first anti-rotation member 12 of the further embodiment of the threaded connection 1 of FIG. 19 are identical to the embodiment of the threaded connection 1 of FIG. 1. The box 5 and the second anti-rotation member 14 of the further embodiment of the threaded connection 1 of FIG. 19 differ from the embodiment of the threaded connection 1 of FIG. 1.

The first anti-rotation member 12 is arranged in the first radial recess 13 being provided in the outer pin surface 3 of the pin 2, and the second anti-rotation member 14 is provided at the inner box surface 6 of the box 5.

The second anti-rotation member 14 is releasably mounted in a second radial recess 43 being provided in the inner box surface 6 of the box 5. In other examples of the threaded connection 1 according to the invention, the box 5 and the second anti-rotation member 14 are integrally formed.

The second radial recess 43 comprises a second recess through hole 46 in which the second ratchet part 18 of the second anti-rotation member 14 is located.

The second anti-rotation member 14 comprises at least one second mounting part 44 to releasably mount the second anti-rotation member 14 to the box 5. The box 5 comprises an outer box surface 45 and the at least one second mounting part 44 is releasably mounted to the box 5 at the outer box surface 45.

Figure 23B:
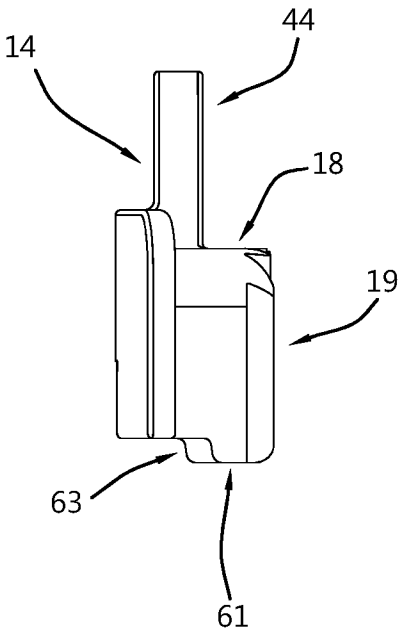
Figure 23A:
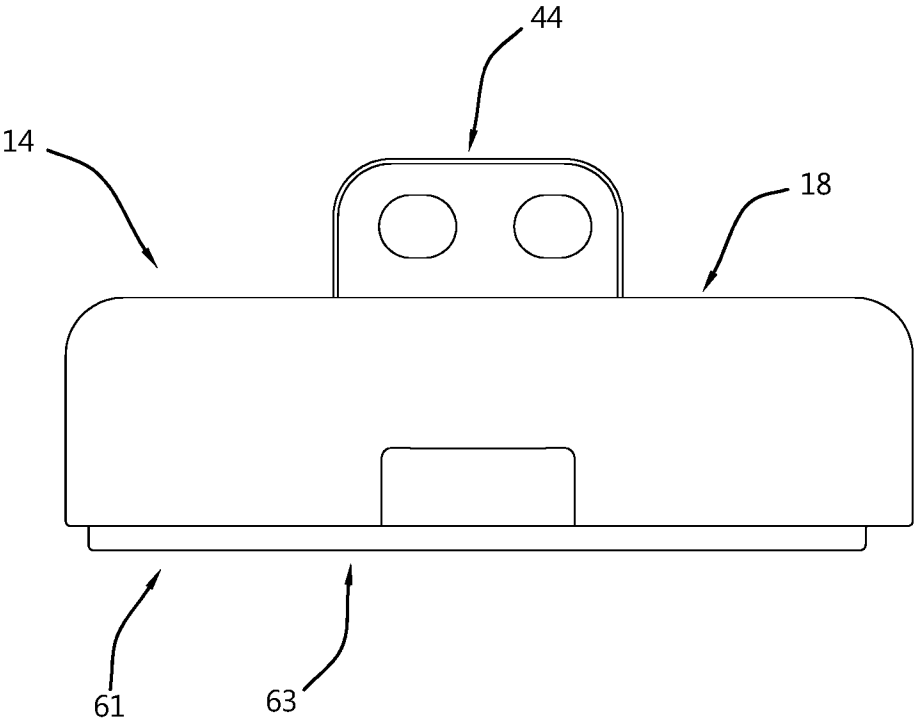

The FIGS. 21A, 21B, 22A, 22B show views in perspective of the first anti-rotation member 12 and the second anti-rotation member 14 of the anti-rotation device 8 of the threaded connection 1 of FIG. 19. Side views of the second anti-rotation member 14 are shown in de FIGS. 23A and 23B.

Figure 24:
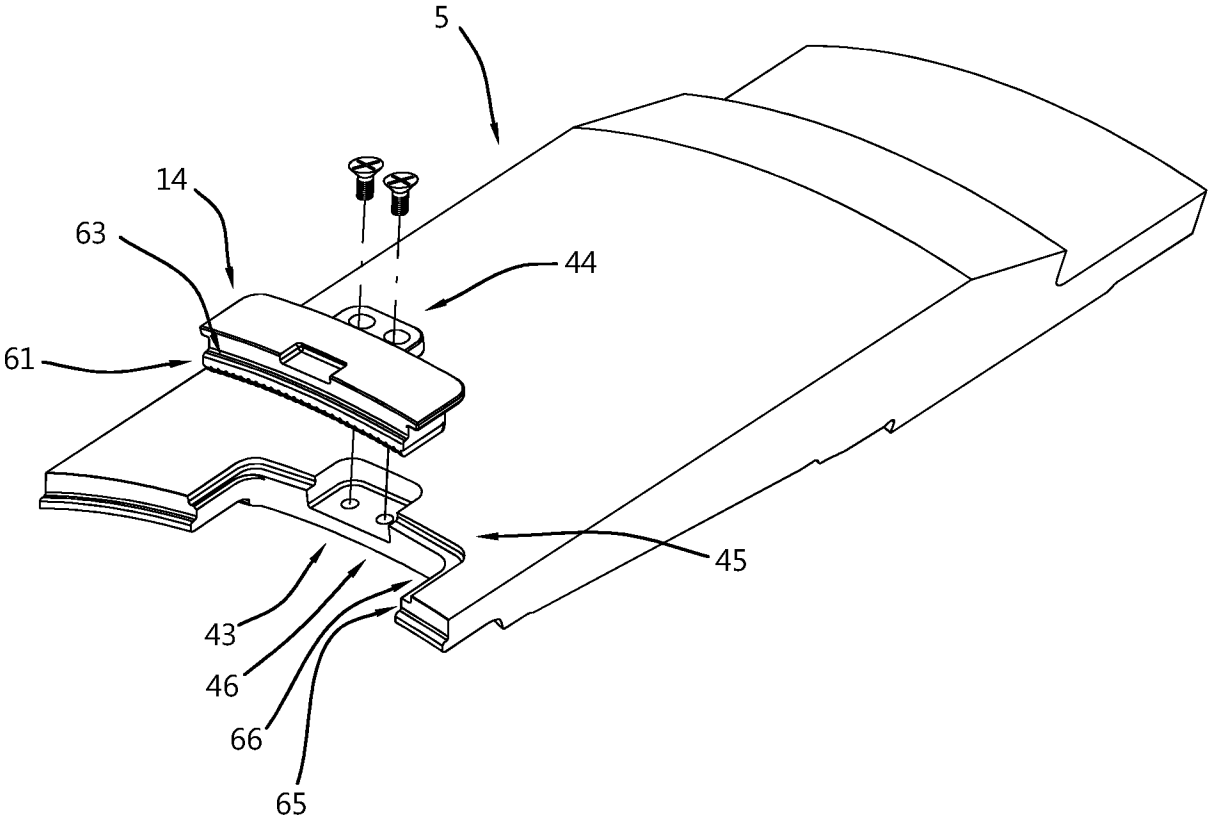
Figure 25:
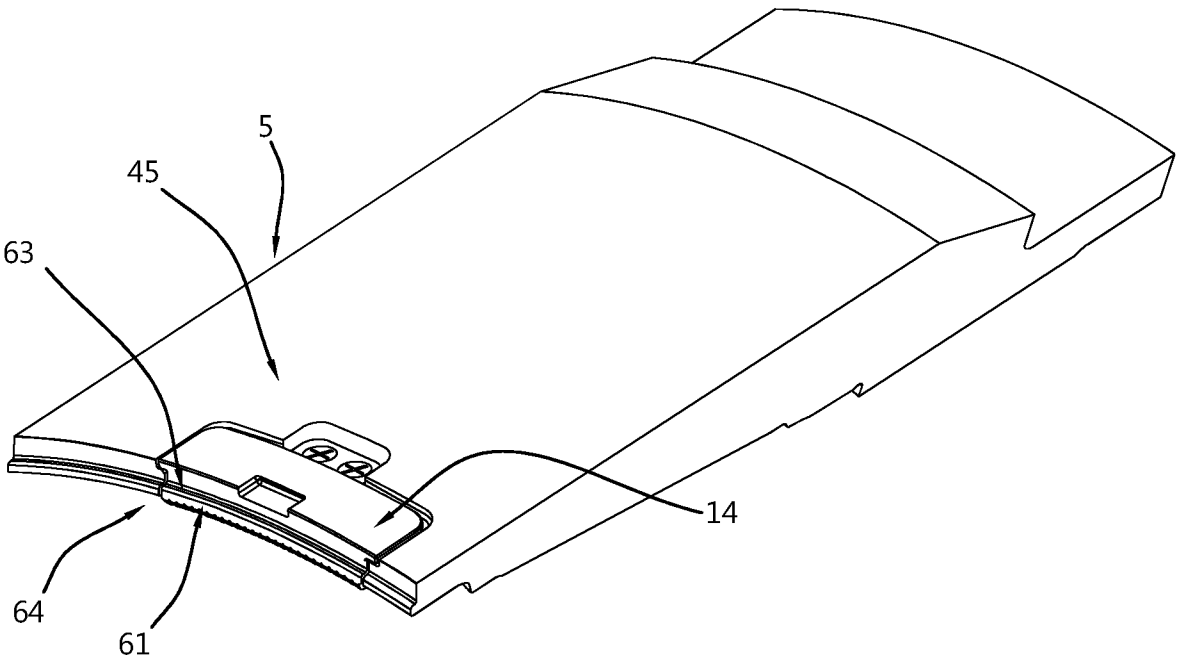

FIG. 24 shows an exploded view of the second anti-rotation member 14 and the second radial recess 43 provided in the box 5 of the threaded connection 1 of FIG. 19. FIG. 25 shows a view in perspective of the second anti-rotation member 14 arranged in the second radial recess 43 provided in the box 5 of the threaded connection 1 of FIG. 19.

Figure 26A:
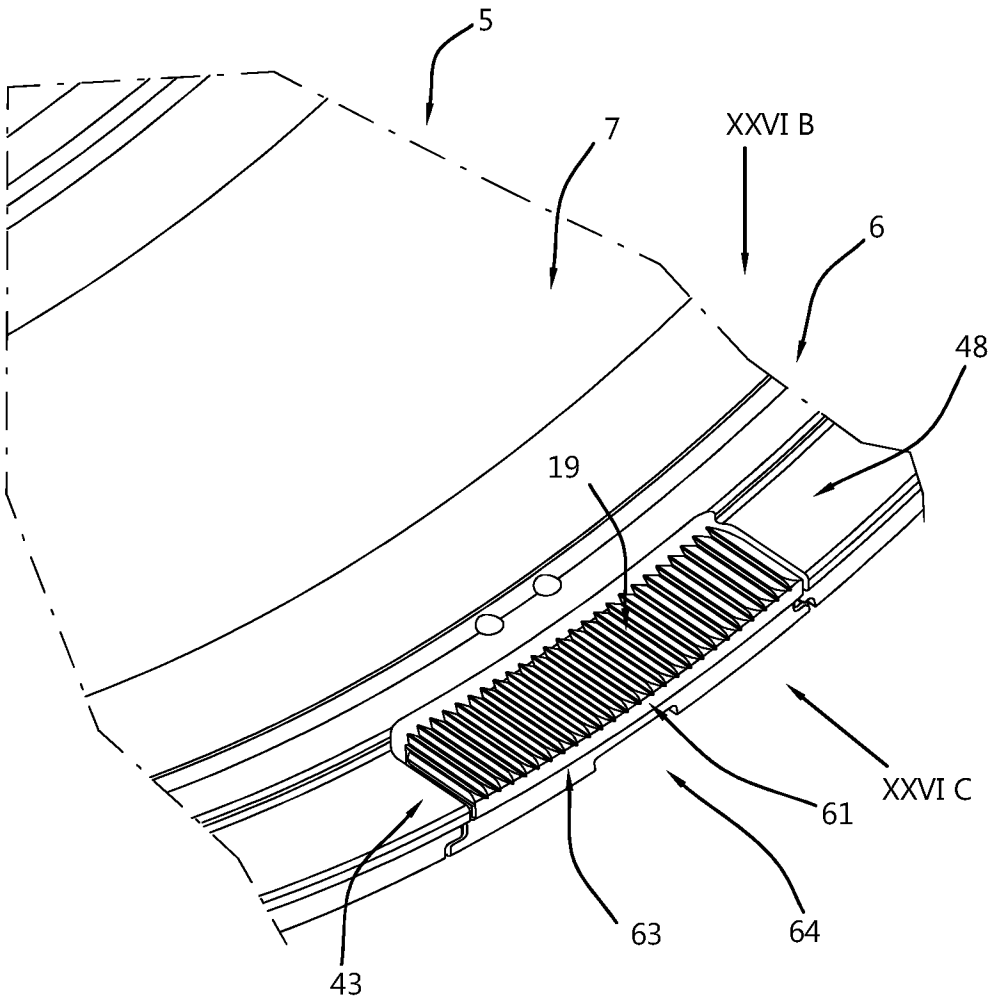
Figure 26B:
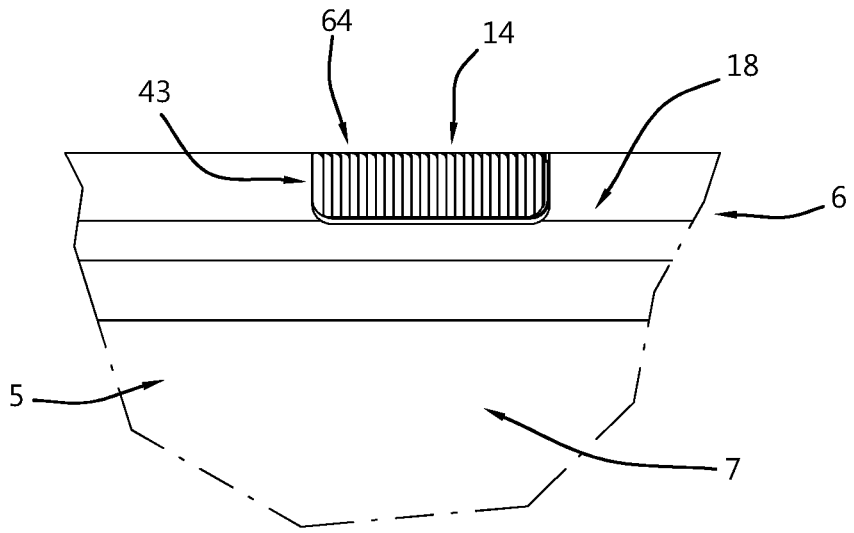
Figure 26C:
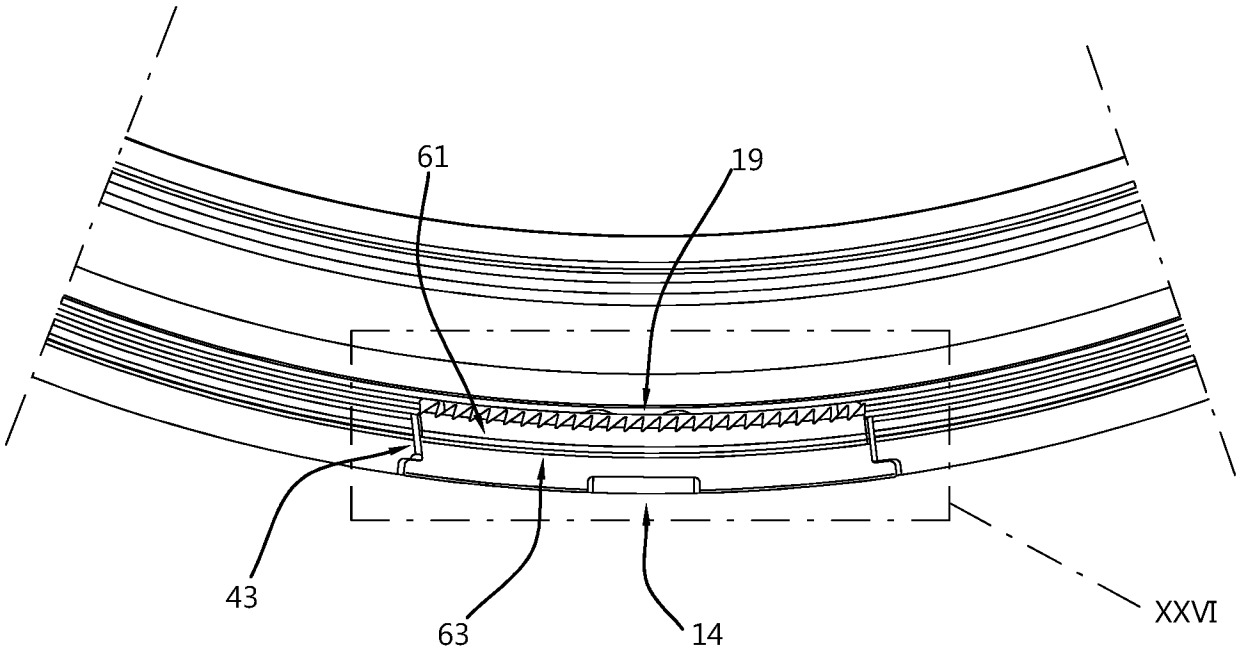
Figure 26D:
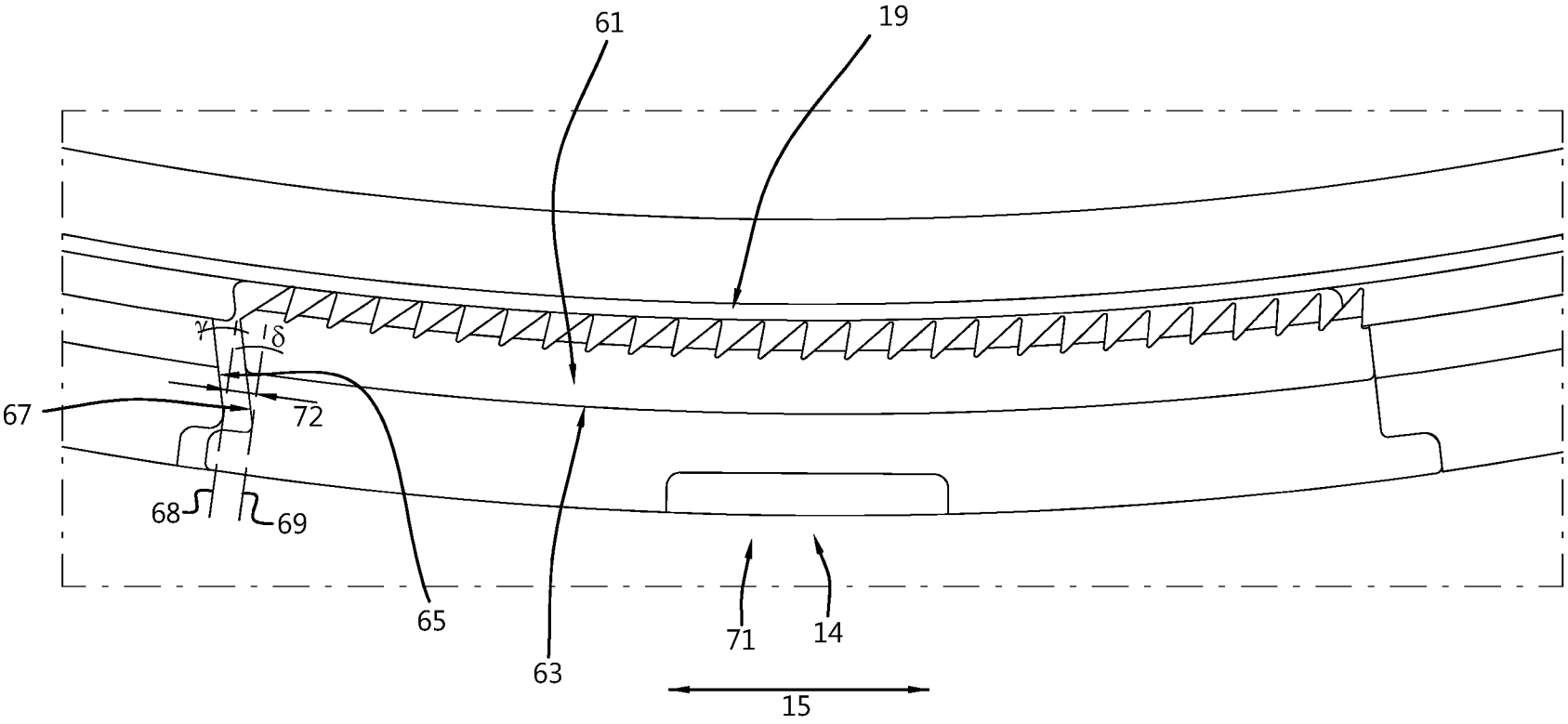
Figure 26E:
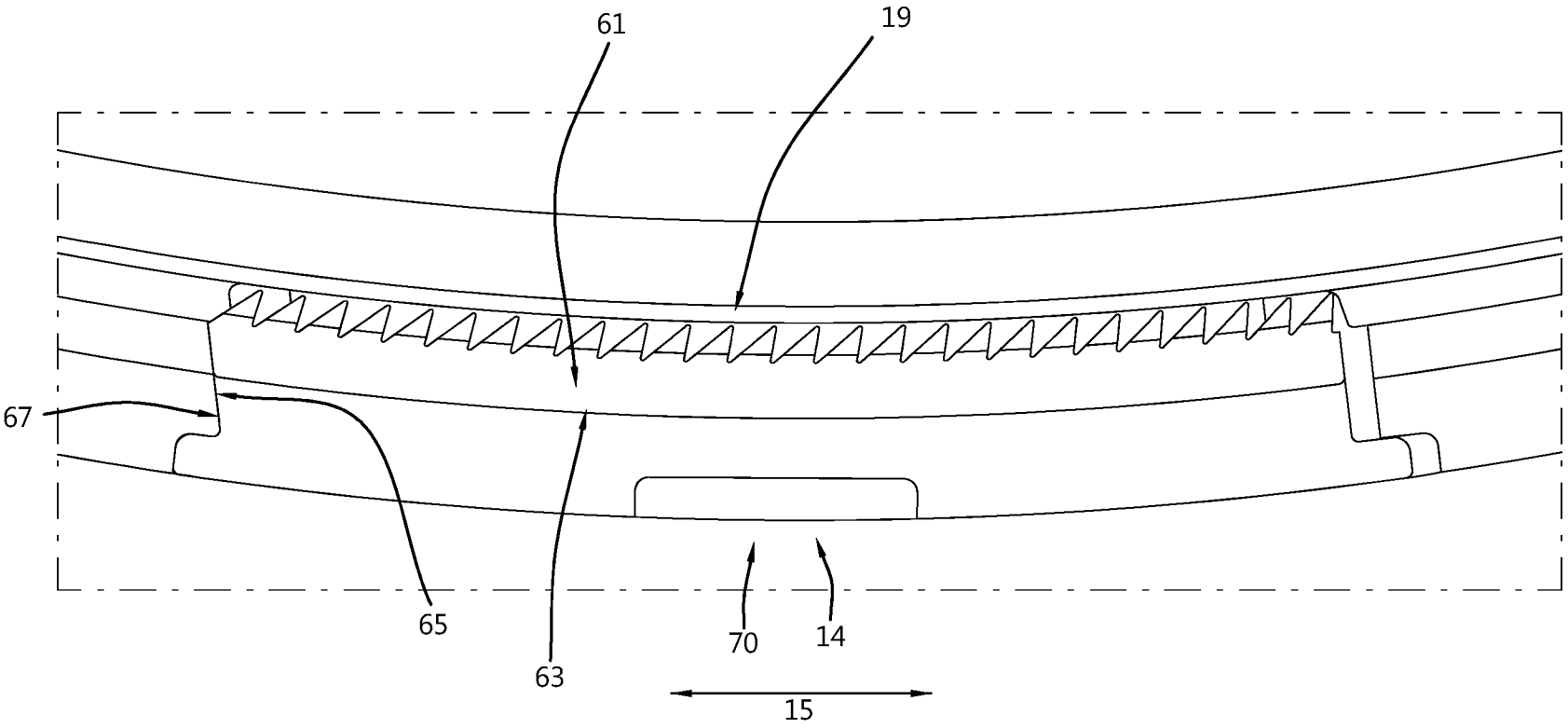

FIG. 26A shows another view in perspective of the second anti-rotation member 14 arranged in the second radial recess 43 provided in the box 5 of the threaded connection 1 of FIG. 19. FIG. 26B shows a top view in direction of arrow XXVI-B of FIG. 26A. FIG. 26C shows a side view in direction of arrow XXVI-C of FIG. 26A. The FIGS. 26D and 26E show enlarged views of the part XXVI of FIG. 26C.

Figure 27:
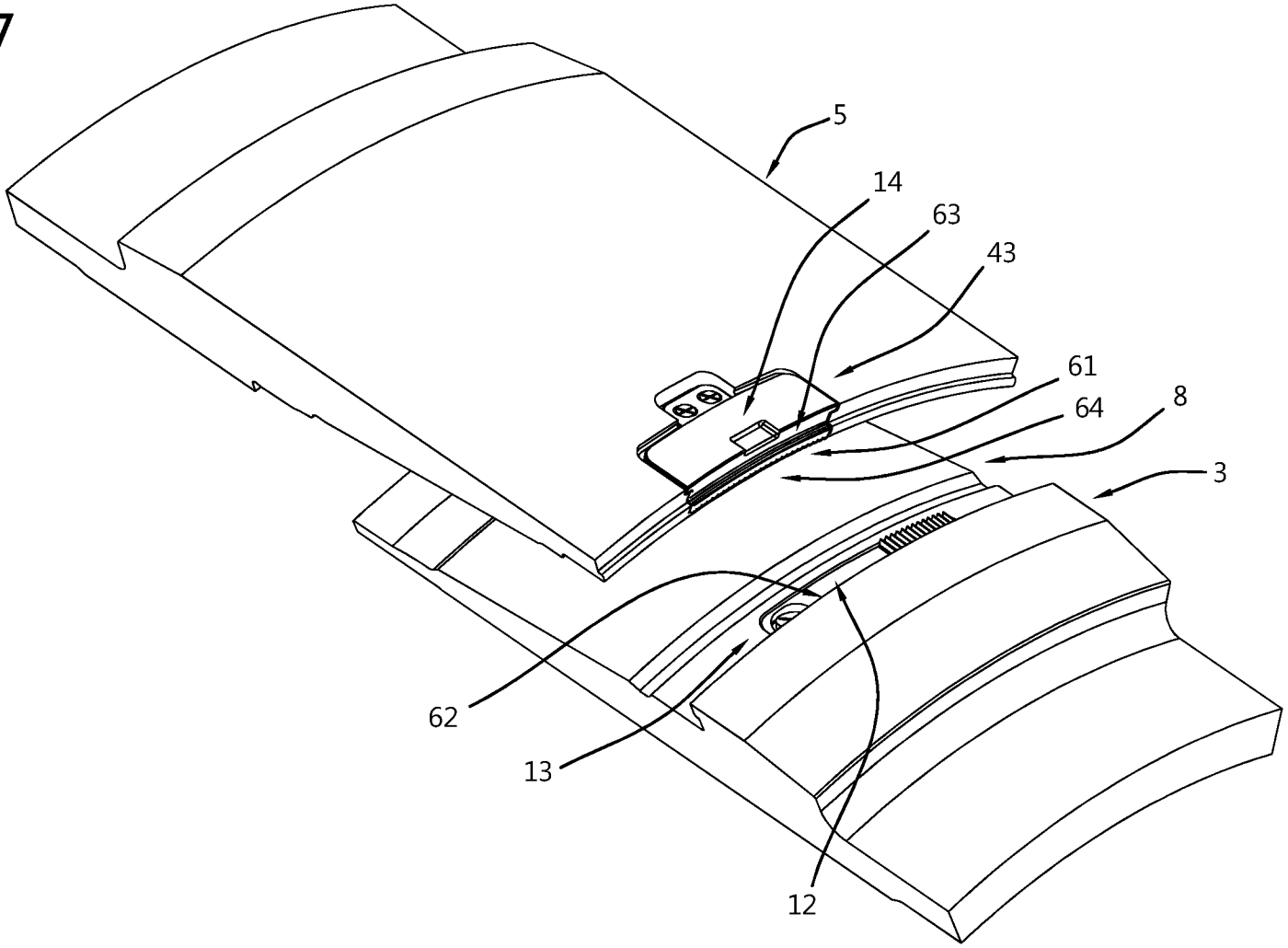

FIG. 27 shows a view in perspective of the first anti-rotation member 12 arranged in the first radial recess 13 provided in the pin 2 and the second anti-rotation member 14 arranged in the second radial recess 43 provided in the box 5 of the threaded connection 1 of FIG. 19.

Figure 28A:
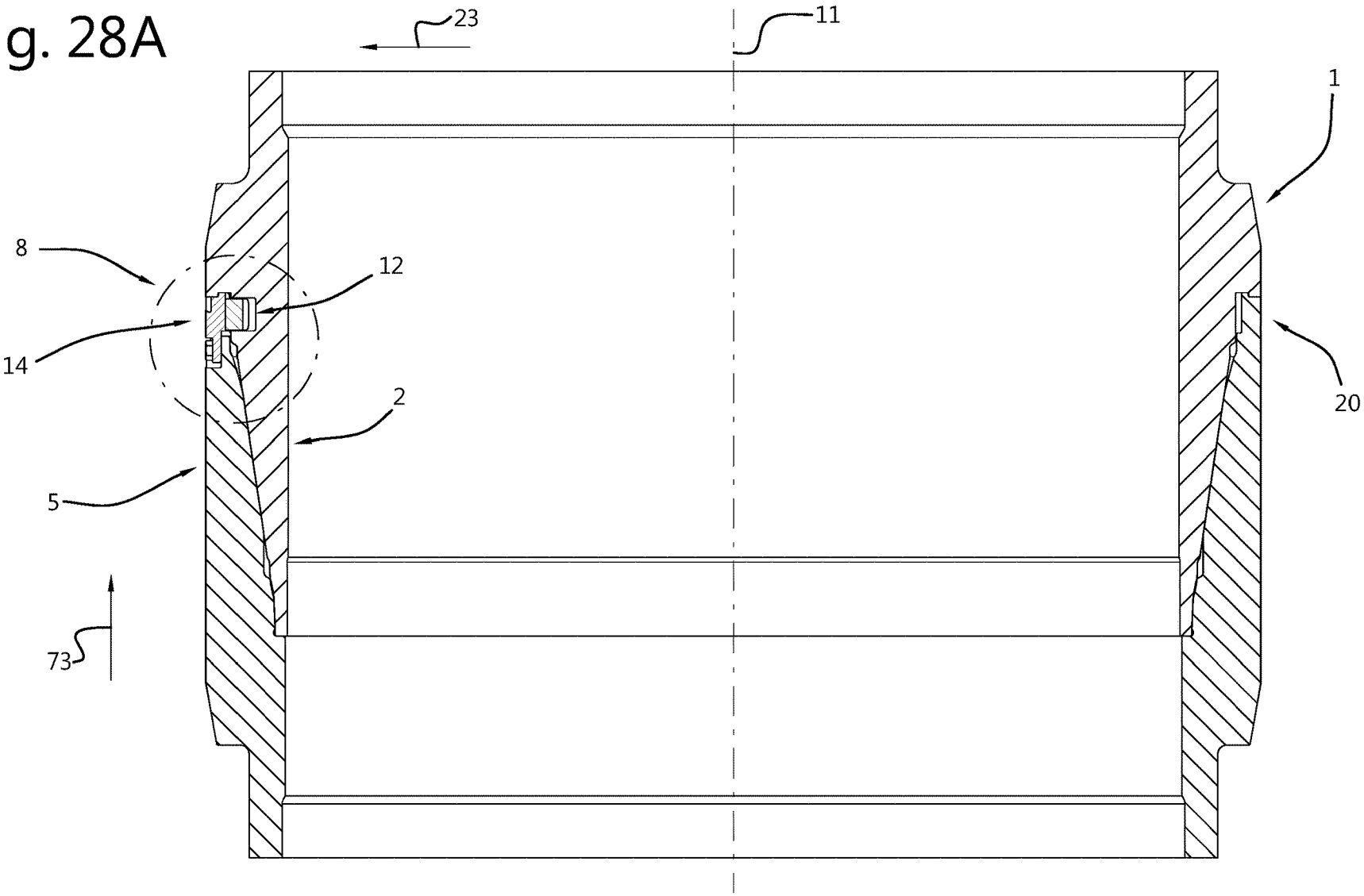
Figure 28B:
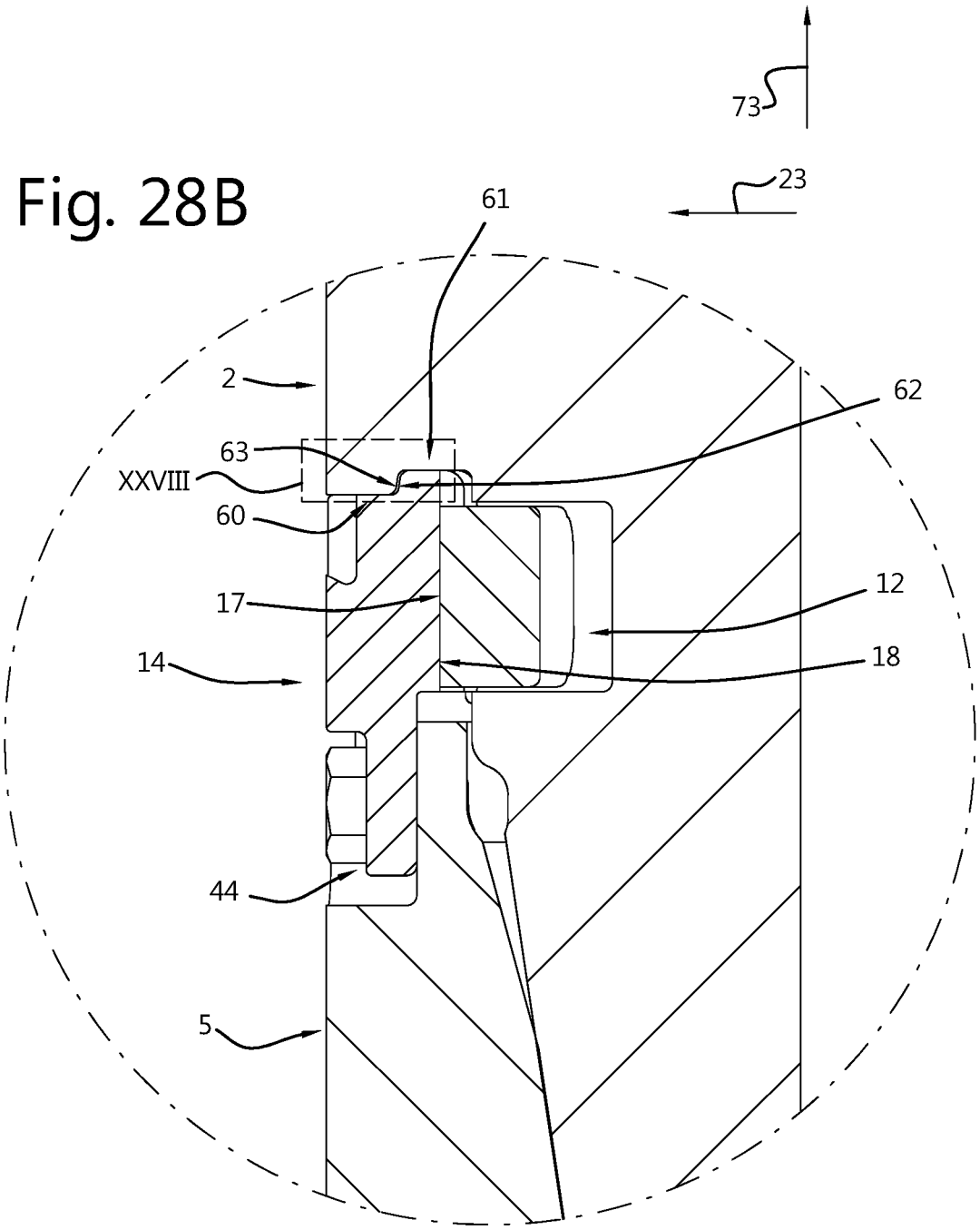
Figure 28C:
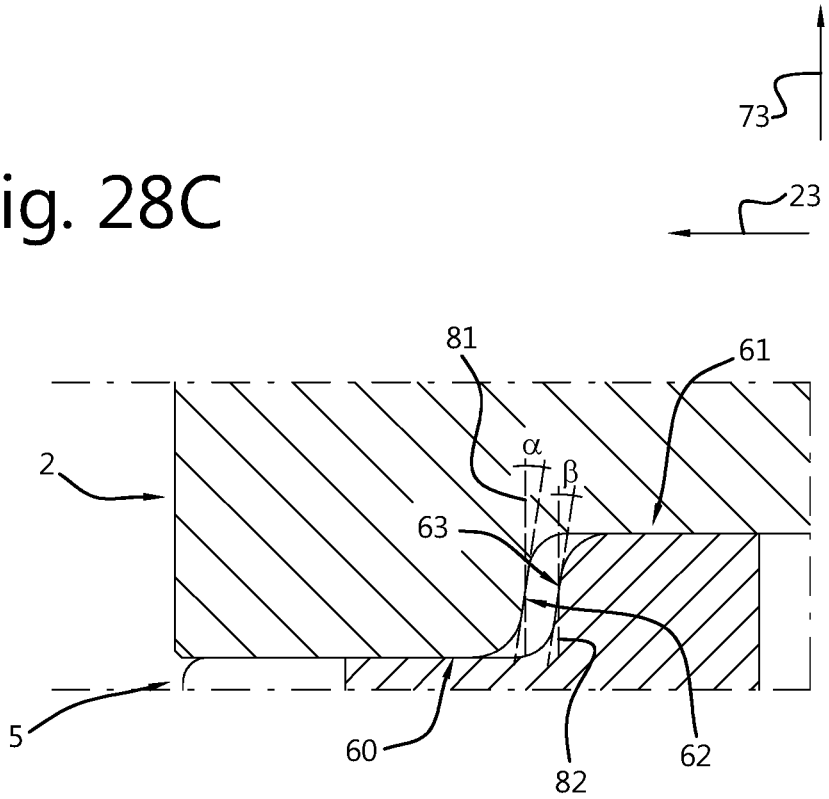

FIG. 28A schematically show a view in cross section along the longitudinal axis of the threaded connection 1 of FIG. 19 at final make-up 20. FIG. 28B shows an enlarged view of the first anti-rotation member 12 and the second anti-rotation member 14 of FIG. 28A. FIG. 28C shows an enlarged view of part XXVIII of FIG. 28B.

As amongst others shown in the FIGS. 28A-C, the pin 2 comprises a pin retainer part 60 and the second anti-rotation member 14 comprises a member retainer part 61. The member retainer part 61 is in radial direction 23 located closer to the longitudinal axis 11 than the pin retainer part 60. The pin retainer part 60 overlaps the member retainer part 61 at least partly in axial direction 73 relative to the longitudinal axis 11 at final make-up 20 of the threaded connection 1.

The pin retainer part 60 and the member retainer part 61 are configured to block movement of the second anti-rotation member 14 in radial direction 23 away from the longitudinal axis 11 at final make-up 20 of the threaded connection 1.

The pin retaining part 60 comprises a pin retainer surface 62. The member retaining part 61 comprises a member retainer surface 63. The member retainer surface 63 is in radial direction 23 located closer to the longitudinal axis 11 than the pin retainer surface 62. The pin retainer surface 62 overlaps the member retainer surface 63 at least party in axial direction 73 relative to the longitudinal axis 11 at final make-up 20 of the threaded connection 1.

The pin retainer surface 62 and the member retainer surface 63 are configured to contact each other in order to block movement of the second anti-rotation member 14 in radial direction 23 away from the longitudinal axis 11 at final make-up 20 of the threaded connection 1.

The fact that the pin retainer surface 62 and the member retainer surface 63 overlap each other at least party in axial direction 73 relative to the longitudinal axis 11 does not imply that it is required that the pin retainer surface 62 and/or the member retainer surface 63 extend solely in axial direction 73. The pin retainer surface 62 and/or the member retainer surface 63 may extend in axial direction 73 and/or may extend under an angle relative to the axial direction 73.

The pin retainer surface 62 and the member retainer surface 63 are at least partly facing each other at final make-up 20 of the threaded connection 1. The pin retainer surface 62 is directed towards the longitudinal axis 11 and the member retainer surface 63 is directed away from longitudinal axis 11.

The pin retainer surface 62 extends under a pin retainer angle $\alpha$ of between, and including, –12 and 12 degrees relative to the longitudinal axis 11, and the member retainer surface 63 extends under a member retainer angle $\beta$ of between, and including, –12 and 12 degrees relative to the longitudinal axis 11. The pin retainer surface 62 and the member retainer surface 63 may extend substantially in axial direction 73 relative to the longitudinal axis 11.

In FIG. 28C, the pin retainer angle $\alpha$ is indicated with respect to a first fictive line 81 extending parallel to the longitudinal axis 11 and the member retainer angle $\beta$ is indicted with respect to a second fictive line 82 extending parallel to the longitudinal axis 11.

In FIG. 28C, the pin retainer angle $\alpha$ and the member retainer angle $\beta$ have a positive a value. In the situation that the pin retainer angle $\alpha$ and the member retainer angle $\beta$ have a negative value, the pin retainer surface 62 and the member retainer surface 63 extend in opposite direction with respect to the longitudinal axis 11.

The member retainer part 61 is provided at a free box end 64 of the box 5, and the pin retainer part 60 is provided at the outer pin surface 3.

As shown amongst others in the FIGS. 26A-E, a second recess contact surface 65 defines a second recess boundary 66 of the second radial recess 43. The second anti-rotation member 14 comprises a second member contact surface 67 facing the second recess contact surface 65. The second recess contact surface 65 extends under a second recess contact surface angle $\gamma$ of between, and including. 0 and 45 degrees relative to a first fictive plane 68 extending through the longitudinal axis 11 and intersecting the second recess contact surface 65. The second member contact surface 67 extends under a second member contact surface angle $\delta$ of between, and including. 0 and 45 degrees relative to a second fictive plane 69 extending through the longitudinal axis 11 and intersecting the second member contact surface 67. The second recess contact surface 65 and the second member contact surface 67 are configured to contact each other when a predetermined break-out torque 35 is applied to the pin 2 and the box 5 in the break-out rotation direction 10.

In the embodiment of the threaded connection 1 shown in the FIGS. 26D-E, the second recess contact surface angle $\gamma$ is larger than 0 degrees and the second member contact surface angle $\delta$ is larger than 0 degrees. The second recess contact surface angle $\gamma$ is shown with respect to the first fictive plane 68 extending through the longitudinal axis 11. The first fictive plane 68 extends in radial direction 23 relative to the longitudinal axis 11 and intersects the second recess contact surface 65. The second member contact surface angle $\delta$ is shown with respect to the second fictive plane 69 extending through the longitudinal axis 11. The second fictive plane 68 extends in radial direction 23 relative to the longitudinal axis 11 and intersects the second member contact surface 67.

The second mounting part 44 is configured to allow tangential movement in a tangential direction 15 relative to the longitudinal axis 11 of the second anti-rotation member 14 in the second radial recess 43 from a third tangential member position 70 wherein the second member contact surface 67 of the second anti-rotation member 14 is in contact with the second recess contact surface 65 (see FIG. 26E) into a fourth tangential member position 71 wherein the second member contact surface 67 of the second anti-rotation member 14 is located at a second tangential member distance 72 from the second recess contact surface 65 (see FIG. 26D), and vice versa.

FIG. 26D shows the situation in which a predetermined break-out torque 35 is applied to the pin 2 and the box 5 in the break-out rotation direction 10. FIG. 26E shows the situation in which a predetermined make-up torque 34 is applied to the pin 2 and the box 5 in the make-up rotation direction 9.

The first anti-rotation member 12 is configured to push the second anti-rotation member 14 into the fourth tangential member position 71 when a predetermined make-up torque 34 is applied to the pin 2 and the box 5 in the make-up rotation direction 9, and into the third tangential member position 70 when a predetermined break-out torque 35 is applied to the pin 2 and the box 5 in the break-out rotation direction 10.

More specifically, the first ratchet teeth 17 of the first anti-rotation member 12 engage the second ratchet teeth 18 of the second anti-rotation member 14 to push the second anti-rotation member 14 into the fourth tangential member position 71 when the predetermined make-up torque 34 is applied, and into the third tangential member position 70 when the predetermined break-out torque 35 is applied.

The invention may further relate to a threaded connection, anti-rotation device and method according to any one of the following clauses.

Clause 1. Threaded connection for exploration and production of a hydrocarbon well, said threaded connection comprising: —a pin comprising an outer pin surface provided with an external thread, —a box comprising an inner box surface provided with an internal thread for mating with the external thread during rotational make-up of the threaded connection, and —an anti-rotation device to allow relative rotation between the pin and the box in a make-up rotation direction and prevent relative rotation between the pin and the box in an opposite break-out rotation direction, wherein: —the pin and the box extend along a longitudinal axis, —the anti-rotation device comprises a releasably mounted first anti-rotation member which is arranged in a first radial recess provided in one of the outer pin surface of the pin and the inner box surface of the box, and a second anti-rotation member provided at the other of the outer pin surface of the pin and the inner box surface of the box, —the first anti-rotation member comprises a first ratchet part provided with radially extending first ratchet teeth, —the second anti-rotation member comprises a second ratchet part provided with radially extending second ratchet teeth which engage the first ratchet teeth of the first anti-rotation member at final make-up of the threaded connection, and —the first anti-rotation member comprises a spring part which allows radial movement of the first ratchet part in radial direction relative to the longitudinal axis when first ratchet teeth slide along second ratchet teeth during relative rotation between the pin and the box in the make-up rotation direction.

Clause 2. Threaded connection according to clause 1, wherein the first ratchet part and the spring part of the first anti-rotation member are integrally formed.

Clause 3. Threaded connection according to clause 1 or 2, wherein the spring part has a spring stiffness which is smaller than a first ratchet stiffness of the first ratchet part.

Clause 4. Threaded connection according to any one of the preceding clauses, wherein the first anti-rotation member comprises a first mounting part to releasably mount the first anti-rotation member in the first radial recess.

Clause 5. Threaded connection according to clause 4, wherein the first mounting part comprises a first mounting through hole to receive a first mounting member, such as a first screw, which releasably mounts the first anti-rotation member to said one of the pin and box in which the first radial recess is provided.

Clause 6. Threaded connection according to clause 4 or 5, wherein the first ratchet part, the spring part and the first mounting part of the first anti-rotation member are integrally formed.

Clause 7. Threaded connection according to clause 6, wherein the spring part has a spring stiffness which is smaller than a first ratchet stiffness of the first ratchet part and/or smaller than a first mounting stiffness of the first mounting part.

Clause 8. Threaded connection according to any one of the clauses 4-7, wherein: —a first recess contact surface of the pin and the box in which the first radial recess is provided defines a first recess boundary of the first radial recess, —the first anti-rotation member comprises a first member contact surface facing the first recess contact surface, and —the first mounting part is configured to allow tangential movement in a tangential direction relative to the longitudinal axis of the first anti-rotation member in the first radial recess from a first tangential member position wherein the first member contact surface of the first anti-rotation member is in contact with the first recess contact surface into a second tangential member position wherein the first member contact surface of the first anti-rotation member is located at a first tangential member distance from the first recess contact surface, and vice versa.

Clause 9. Threaded connection according to clause 8, wherein the first recess contact surface and the first member contact surface are configured to distribute forces as a result of a break-out torque applied to the pin and the box in the break-out rotation direction mainly through the teeth of the first ratchet part and the second ratchet part.

Clause 10. Threaded connection according to clause 8 or 9, wherein the first recess contact surface and the first member contact surface are configured to direct forces from the first ratchet teeth of the first ratchet part towards the second ratchet teeth of the second ratchet part and/or from the second ratchet teeth of the second ratchet part towards the first ratchet teeth of the first ratchet part.

Clause 11. Threaded connection according to any one of the clause 8-10, wherein said recess contact surface is faced towards the first ratchet part.

Clause 12. Threaded connection according to any one of the clauses 8-10, wherein the first recess contact surface is faced towards the first ratchet part and the second ratchet part.

Clause 13. Threaded connection according to any one of the clauses 8-12, wherein the second anti-rotation member is configured to push the first anti-rotation member: —into the second tangential member position when a predetermined make-up torque is applied to the pin and the box in the make-up rotation direction, and —into the first tangential member position when a predetermined break-out torque is applied to the pin and the box in the break-out rotation direction.

Clause 14. Threaded connection according to clause 13, wherein second ratchet teeth which engage first ratchet teeth push the first anti-rotation member: —into the second tangential member position when the predetermined make-up torque is applied, and —into the first tangential member position when the predetermined break-out torque is applied.

Clause 15. Threaded connection according to any one of the clauses 8-14, wherein the first recess contact surface and the first member contact surface are configured to create a radial counter force acting against radial movement of the first ratchet part in radial direction relative to the longitudinal axis when the first anti-rotation member is located in the first tangential member position and a break-out torque is applied to the pin and the box in the break-out rotation direction.

Clause 16. Threaded connection according to clause 15, wherein the radial counter force is formed by a friction force between the first recess contact surface and the first member contact surface when the break-out torque is applied to the pin and the box in the break-out rotation direction.

Clause 17. Threaded connection according to any one of the clauses 8-16 and in combination with clause 4, wherein the first mounting through hole is in tangential direction relative to the longitudinal axis larger than a first mounting portion of the first mounting member being surrounded by the first mounting through hole to allow movement of the first anti-rotation member in tangential direction and relative to the first mounting member.

Clause 18. Threaded connection according to clause 17, wherein the first mounting through hole has an elongate form in tangential direction relative to the longitudinal axis or a circular form.

Clause 19. Threaded connection according to any one of the clauses 8-18, wherein the first recess contact surface and the first member contact surface are configured to block tangential movement of the first anti-rotation member beyond the first tangential member position when a break-out torque is applied to the pin and the box in the break-out rotation.

Clause 20. Threaded connection to clause 19 and in combination with clause 17 or 18, wherein the first mounting through hole is dimensioned to avoid forces in tangential direction working on the first mounting member by the first anti-rotation member being located in the first tangential member position when a break-out torque is applied to the pin and the box in the break-out rotation.

Clause 21. Threaded connection according to any one of the clauses 8-20, wherein the first tangential member distance allows radial movement of the first ratchet part in radial direction relative to the longitudinal axis when first ratchet teeth slide along second ratchet teeth during relative rotation between the pin and the box in the make-up rotation direction.

Clause 22. Threaded connection according to any one of the clauses 8-21, wherein the first mounting part comprises a first mounting slide surface surrounding the first mounting through hole and being in contact with a corresponding first recess slide surface provided at the first radial recess to facilitate the tangential movement of the first anti-rotation member from the first tangential member position into the second tangential member position, and vice versa.

Clause 23. Threaded connection according to any one of the clauses 8-22, wherein the spring part of the first anti-rotation member is in tangential direction relative to the longitudinal axis located between the first ratchet part and the first mounting part.

Clause 24. Threaded connection according to any one of the clauses 8-23, wherein the first member contact surface of the first anti-rotation member is located at the first ratchet part and the first ratchet teeth are in tangential direction relative to the longitudinal axis located between the first member contact surface and the spring part.

Clause 25. Threaded connection according to clause 24, wherein a radial first ratchet thickness of the first ratchet part increases in tangential direction relative to the longitudinal axis from the spring part to the first member contact surface.

Clause 26. Threaded connection according to any one of the clauses 8-25, wherein the first anti-rotation member is only mounted to said one of the pin and the box in which the first radial recess is provided via the first mounting part.

Clause 27. Threaded connection according to any one of the clauses 8-26, wherein the first anti-rotation member comprises one, and only one, first mounting part.

Clause 28. Threaded connection according to any one of the clauses 8-27, wherein the first anti-rotation member comprises one, and only one, spring part.

Clause 29. Threaded connection according to any one of the preceding clauses, wherein the second ratchet part of the second anti-rotation member is fixed in radial direction relative to the longitudinal axis Clause 30. Threaded connection according to any one of the preceding clauses, wherein the second anti-rotation member is releasably mounted in a second radial recess provided in said other of the outer pin surface of the pin and the inner box surface of the box.

Clause 31. Threaded connection according to any one of the preceding clauses, wherein the first anti-rotation member is arranged in the first radial recess being provided in the outer pin surface of the pin, and the second anti-rotation member is provided at the inner box surface of the box.

Clause 32. Threaded connection according to clause 31, wherein the second anti-rotation member is releasably mounted in a second radial recess being provided in the inner box surface of the box.

Clause 33. Threaded connection according to clause 32, wherein the second radial recess comprises a second recess through hole in which the second ratchet part of the second anti-rotation member is located.

Clause 34. Threaded connection according to clause 32 or 33, wherein the second anti-rotation member comprises at least one second mounting part to releasably mount the second anti-rotation member to the box.

Clause 35. Threaded connection according to clause 34, wherein the box comprises an outer box surface and the at least one second mounting part is releasably mounted to the box at the outer box surface.

Clause 36. Threaded connection according to clause 34 or 35, wherein the second anti-rotation member comprises two second mounting parts to releasably mount the second anti-rotation member to the box.

Clause 37. Threaded connection according to clause 36, wherein the two second mounting parts are located at opposite sides of the second radial recess.

Clause 38. Threaded connection according to any one of the clauses 31-37, wherein: —the pin comprises a pin retainer part, —the second anti-rotation member comprises a member retainer part, —the member retainer part is in radial direction located closer to the longitudinal axis than the pin retainer part, and —the pin retainer part overlaps the member retainer part at least partly in axial direction relative to the longitudinal axis at final make-up of the threaded connection.

Clause 39. Threaded connection according to clause 38, wherein the pin retainer part and the member retainer part are configured to block movement of the second anti-rotation member in radial direction away from the longitudinal axis at final make-up of the threaded connection.

Clause 40. Threaded connection according to clause 38 or 39, wherein: —the pin retaining part comprises a pin retainer surface, —the member retaining part comprises a member retainer surface, —the member retainer surface is in radial direction located closer to the longitudinal axis than the pin retainer surface, and —the pin retainer surface overlaps the member retainer surface at least party in axial direction relative to the longitudinal axis at final make-up of the threaded connection.

Clause 41. Threaded connection according to clause 40, wherein the pin retainer surface and the member retainer surface extend substantially in axial direction relative to the longitudinal axis.

Clause 42. Threaded connection according to any one of the clauses 38-41, wherein the member retainer part is provided at a free box end of the box, and the pin retainer part is provided at the outer pin surface.

Clause 43. Threaded connection according to any one of the clauses 38-42 and in combination with clause 32, wherein: —a second recess contact surface defines a second recess boundary of the second radial recess, —the second anti-rotation member comprises a second member contact surface facing the second recess contact surface, and —the second recess contact surface extends under a second recess contact surface angle $\gamma$ of between, and including, 0 and 45 degrees relative to a first fictive plane extending through the longitudinal axis and intersecting the second recess contact surface, —the second member contact surface extends under a second member contact surface angle $\delta$ of between, and including, 0 and 45 degrees relative to a second fictive plane extending through the longitudinal axis and intersecting the second member contact surface, and —the second recess contact surface and the second member contact surface are configured to contact each other when a predetermined break-out torque is applied to the pin and the box in the break-out rotation direction.

Clause 44. Threaded connection according to clause 43, and in combination with any one of the clauses 34-37, wherein the second mounting part is configured to allow tangential movement in a tangential direction relative to the longitudinal axis of the second anti-rotation member in the second radial recess from a third tangential member position wherein the second member contact surface of the second anti-rotation member is in contact with the second recess contact surface into a fourth tangential member position wherein the second member contact surface of the second anti-rotation member is located at a second tangential member distance from the second recess contact surface, and vice versa.

Clause 45. Threaded connection according to any one of the clauses 1-30, wherein the first anti-rotation member is arranged in the first radial recess being provided in the inner box surface of the box, and the second anti-rotation member is provided at the outer pin surface of the pin.

Clause 46. Threaded connection according to claim 45, wherein the second anti-rotation member is releasably mounted in a second radial recess being provided in the outer pin surface of the pin.

Clause 47. Threaded connection according to claim 45 or 46, wherein the first radial recess comprises a first recess through hole in which the first ratchet part of the first anti-rotation member is located.

Clause 48. Threaded connection according to any one of the claims 45-47, wherein the first anti-rotation member comprises at least one first mounting part to releasably mount the first anti-rotation member to the box.

Clause 49. Threaded connection according to claim 48 wherein the box comprises an outer box surface and the at least one first mounting part is releasably mounted to the box at the outer box surface.

Clause 50. Threaded connection according to claim 48 or 49, wherein the first anti-rotation member comprises two first mounting parts to releasably mount the first anti-rotation member to the box.

Clause 51. Threaded connection according to claim 50, wherein the two first mounting parts are located at opposite sides of the first radial recess.

Clause 52. Threaded connection according to claim 50 or 51, wherein the first anti-rotation member comprises two spring parts which together allows radial movement of the first ratchet part in radial direction relative to the longitudinal axis when first ratchet teeth slide along second ratchet teeth during relative rotation between the pin and the box in the make-up rotation direction.

Clause 53. Threaded connection according to claim 52, wherein each spring part is located between the first ratchet part and a different one of the two first mounting parts.

Clause 54. Threaded connection according to claim 52 or 53, wherein each spring part has a varying radial spring thickness, such as two radially narrowed sections.

Clause 55. Threaded connection according to any one of the preceding clauses, wherein the anti-rotation device is configured to be activated by relative rotation between the pin and the box in the make-up rotation direction until final make-up of the threaded connection is reached.

Clause 56. Threaded connection according to any one of the preceding clauses, wherein the first ratchet teeth and the second ratchet teeth extend in opposite radial directions relative to the longitudinal axis when engaging each other at final make-up of the threaded connection.

Clause 57. Threaded connection according to any one of the preceding clauses, wherein the first ratchet teeth of the first anti-rotation member extend in radial direction beyond the one of the pin outer surface and the box inner surface in which the first radial recess is provided, and the second ratchet teeth of the second anti-rotation member extend in radial direction beyond the other of the pin outer surface and the box inner surface at which the second anti-rotation member is provided.

Clause 58. Threaded connection according to any one of the preceding clauses, wherein the first radial recess extends along part of a circumference of said one of the outer pin surface of the pin and the inner box surface of the box.

Clause 59. Threaded connection according to any one of the preceding clauses, wherein the second radial recess extends along part of a circumference of said other of the outer pin surface of the pin and the inner box surface of the box.

Clause 60. Threaded connection according to any one of the preceding clauses, wherein the radial movement relative to the longitudinal axis of the first ratchet part moves the first ratchet teeth radially relative to the second ratchet teeth.

Clause 61. Method of making up a threaded connection for exploration and production of a hydrocarbon well, comprising the step of activating the anti-rotation device of the threaded connection according to any of the preceding clauses by relative rotation between the pin and the box in the make-up rotation direction until final make-up of the threaded connection is reached.

Clause 62. Anti-rotation device for a threaded connection for exploration and production of a hydrocarbon well, said threaded connection comprising a pin comprising an outer pin surface provided with an external thread, and a box comprising an inner box surface provided with an internal thread for mating with the external thread during rotational make-up of the threaded connection, which pin and the box extend along a longitudinal axis, and wherein: —the anti-rotation device is configured to allow relative rotation between the pin and the box in a make-up rotation direction and prevent relative rotation between the pin and the box in an opposite break-out rotation direction, —the anti-rotation device comprises a releasably mounted first anti-rotation member which is arranged in a first radial recess provided in one of the outer pin surface of the pin and the inner box surface of the box, and a second anti-rotation member provided at the other of the outer pin surface of the pin and the inner box surface of the box, —the first anti-rotation member comprises a first ratchet part provided with radially extending first ratchet teeth, —the second anti-rotation member comprises a second ratchet part provided with radially extending second ratchet teeth which engage the first ratchet teeth of the first anti-rotation member at final make-up of the threaded connection, and —the first anti-rotation member comprises a spring part which allows radial movement of the first ratchet part in radial direction relative to the longitudinal axis when first ratchet teeth slide along second ratchet teeth during relative rotation between the pin and the box in the make-up rotation direction.

Clause 63. Anti-rotation device for a threaded connection for exploration and production of a hydrocarbon well, said threaded connection comprising a pin comprising an outer pin surface provided with an external thread, and a box comprising an inner box surface provided with an internal thread for mating with the external thread during rotational make-up of the threaded connection, which pin and the box extend along a longitudinal axis, and wherein: —the anti-rotation device is configured to allow relative rotation between the pin and the box in a make-up rotation direction and prevent relative rotation between the pin and the box in an opposite break-out rotation direction, —the anti-rotation device comprises a releasably mounted first anti-rotation member which is arranged in a first radial recess provided in one of the outer pin surface of the pin and the inner box surface of the box, and a second anti-rotation member provided at the other of the outer pin surface of the pin and the inner box surface of the box, —the first anti-rotation member comprises a first ratchet part provided with radially extending first ratchet teeth, —the second anti-rotation member comprises a second ratchet part provided with radially extending second ratchet teeth which engage the first ratchet teeth of the first anti-rotation member at final make-up of the threaded connection, —the first anti-rotation member comprises a spring part which allows radial movement of the first ratchet part in radial direction relative to the longitudinal axis when first ratchet teeth slide along second ratchet teeth during relative rotation between the pin and the box in the make-up rotation direction, —the first anti-rotation member is arranged in the first radial recess being provided in the outer pin surface of the pin, and the second anti-rotation member is provided at the inner box surface of the box, —the pin comprises a pin retainer part, —the second anti-rotation member comprises a member retainer part, —the member retainer part is in radial direction located closer to the longitudinal axis than the pin retainer part, and —the pin retainer part overlaps the member retainer part at least partly in axial direction relative to the longitudinal axis at final make-up of the threaded connection.

Clause 64. Anti-rotation device according to clause 63, wherein the pin retainer part and the member retainer part are configured to block movement of the second anti-rotation member in radial direction away from the longitudinal axis at final make-up of the threaded connection.

As required, detailed embodiments of the present invention are disclosed in the figures; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The terms "a" or "an", as used herein, are defined as one or more than one. The terms multiple and plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

It will be apparent to those skilled in the art that various modifications can be made to the shown threaded connection, anti-rotation device, and method according to the invention without departing from the scope as defined in the claims.

The invention claimed is:

1. A threaded connection for exploration and production of a hydrocarbon well, said threaded connection comprising:

a pin comprising an outer pin surface provided with an external thread, a box comprising an inner box surface provided with an internal thread for mating with the external thread during rotational make-up of the threaded connection, and an anti-rotation device to allow relative rotation between the pin and the box in a make-up rotation direction and prevent relative rotation between the pin and the box in an opposite break- out rotation direction, wherein:

the pin and the box extend along a longitudinal axis, the anti-rotation device comprises a releasably mounted first anti-rotation member which is arranged in a first radial recess provided in one of the outer pin surface of the pin and the inner box surface of the box, and a second anti-rotation member provided at the other of the outer pin surface of the pin and the inner box surface of the box, the first anti-rotation member comprises a first ratchet part provided with radially extending first ratchet teeth, the second anti-rotation member comprises a second ratchet part provided with radially extending second ratchet teeth which engage the first ratchet teeth of the first anti-rotation member at final make-up of the threaded connection, the first anti-rotation member comprises a spring part which allows radial movement of the first ratchet part in radial direction relative to the longitudinal axis when first ratchet teeth slide along second ratchet teeth during relative rotation between the pin and the box in the make-up rotation direction, the first anti-rotation member is arranged in the first radial recess being provided in the outer pin surface of the pin, and the second anti-rotation member is provided at the inner box surface of the box, the pin comprises a pin retainer part, the second anti-rotation member comprises a member retainer part, the pin retainer part and the member retainer part are configured to block movement of the second anti-rotation member in radial direction away from the longitudinal axis at final make-up of the threaded connection, the member retainer part is in radial direction located closer to the longitudinal axis than the pin retainer part, and the pin retainer part overlaps the member retainer part at least partly in axial direction relative to the longitudinal axis at final make-up of the threaded connection.

2. The threaded connection according to claim 1, wherein: the pin retaining part comprises a pin retainer surface, the member retaining part comprises a member retainer surface, the member retainer surface is in radial direction located closer to the longitudinal axis than the pin retainer surface, and the pin retainer surface overlaps the member retainer surface at least partly in axial direction relative to the longitudinal axis at final make-up of the threaded connection.

3. The threaded connection according to claim 2, wherein the pin retainer surface and the member retainer surface extend substantially in axial direction relative to the longitudinal axis.

4. The threaded connection according to claim 1, wherein the member retainer part is provided at a free box end of the box, and the pin retainer part is provided at the outer pin surface.

5. The threaded connection according to any one of the claim 1, wherein:

the second anti-rotation member is releasably mounted in a second radial recess being provided in the inner box surface of the box, a second recess contact surface defines a second recess boundary of the second radial recess, the second anti-rotation member comprises a second member contact surface facing the second recess contact surface, the second recess contact surface extends under a second recess contact surface angle $\gamma$ of between, and including, 0 and 45 degrees relative to a first fictive plane extending through the longitudinal axis and intersecting the second recess contact surface, the second member contact surface extends under a second member contact surface angle $\delta$ of between, and including, 0 and 45 degrees relative to a second fictive plane extending through the longitudinal axis and intersecting the second member contact surface, and the second recess contact surface and the second member contact surface are configured to contact each other when a predetermined break-out torque is applied to the pin and the box in the break-out rotation direction.

6. The threaded connection according to claim 5, wherein:

the second anti-rotation member comprises at least one second mounting part to releasably mount the second anti-rotation member to the box, and the second mounting part is configured to allow tangential movement in a tangential direction relative to the longitudinal axis of the second anti-rotation member in the second radial recess from a third tangential member position wherein the second member contact surface of the second anti-rotation member is in contact with the second recess contact surface into a fourth tangential member position wherein the second member contact surface of the second anti-rotation member is located at a second tangential member distance from the second recess contact surface, and vice versa.

7. The threaded connection according to claim 6, wherein the box comprises an outer box surface and the at least one second mounting part is releasably mounted to the box at the outer box surface.

8. The threaded connection according to claim 5, wherein the second radial recess comprises a second recess through hole in which the second ratchet part of the second anti-rotation member is located.

9. A method of making up a threaded connection for exploration and production of a hydrocarbon well, the method comprising the step of; activating the anti-rotation device of the threaded connection according claim 1 by relative rotation between the pin and the box in the make-up rotation direction until final make-up of the threaded connection is reached.

* * * * *